US011136826B2

(12) United States Patent
Walker et al.

(10) Patent No.: US 11,136,826 B2
(45) Date of Patent: Oct. 5, 2021

(54) GUIDANCE SYSTEMS AND APPARATUS FOR POWER SWIVEL

(71) Applicant: National Oilwell Varco, L.P., Houston, TX (US)

(72) Inventors: Christopher Brian Walker, Cypress, TX (US); Henry Do, Katy, TX (US); Robert Ioan Papp, Houston, TX (US); Mihail Puscas, Rosenberg, TX (US); Calvin Ronald Blankenship, Katy, TX (US); Delfino Moreno, III, El Campo, TX (US); James Cirone, Pampa, TX (US)

(73) Assignee: National Oilwell Varco, L.P., Houston, TX (US)

( * ) Notice: Subject to any disclaimer, the term of this patent is extended or adjusted under 35 U.S.C. 154(b) by 504 days.

(21) Appl. No.: 15/777,872

(22) PCT Filed: Nov. 21, 2016

(86) PCT No.: PCT/US2016/063033
§ 371 (c)(1),
(2) Date: May 21, 2018

(87) PCT Pub. No.: WO2017/091495
PCT Pub. Date: Jun. 1, 2017

(65) Prior Publication Data

US 2020/0308911 A1 Oct. 1, 2020

Related U.S. Application Data

(60) Provisional application No. 62/258,696, filed on Nov. 23, 2015, provisional application No. 62/304,575, filed on Mar. 7, 2016.

(51) Int. Cl.
*E21B 15/00* (2006.01)
*E21B 3/025* (2006.01)
(Continued)

(52) U.S. Cl.
CPC ..... *E21B 3/025* (2013.01); *E21B 7/023* (2013.01); *E21B 15/00* (2013.01); *E21B 19/16* (2013.01)

(58) Field of Classification Search
CPC ..... E21B 3/025; E21B 7/023; E21B 15/00; E21B 19/16
(Continued)

(56) References Cited

U.S. PATENT DOCUMENTS 4,865,135 A * 9/1989 Moses ..... E21B 3/02 175/57
4,878,546 A 11/1989 Shaw et al.
(Continued)

FOREIGN PATENT DOCUMENTS

EP 0342949 A1 11/1989
WO 2011/109075 A2 9/2011

OTHER PUBLICATIONS

International Patent Application No. PCT/US2016/063033 International Search Report and Written Opinion dated Sep. 19, 2017 (23 pages).

*Primary Examiner* — Taras P Bemko
(74) *Attorney, Agent, or Firm* — Conley Rose, P.C.

(57) ABSTRACT

A system for drilling a subterranean borehole. In an embodiment, the system includes a mast, and a pipe rotator coupled to the mast. The pipe rotator includes a stem that is configured to be coupled to an end of a drillstring and a motor that is configured to rotate the stem. In addition, the system includes a guide beam coupled to the mast. The guide beam includes a longitudinal axis and is configured to guide vertical motion of the pipe rotator. The guide beam includes a plurality of elongate sections configured to be generally aligned along the longitudinal axis. In addition, the guide beam includes a plurality of coupling assemblies configured
(Continued)

to interconnect the plurality of elongate sections and align the plurality elongate sections along the longitudinal axis.

16 Claims, 42 Drawing Sheets

(51) Int. Cl.
*E21B 7/02* (2006.01)
*E21B 19/16* (2006.01)

(58) Field of Classification Search
USPC ..... 175/162
See application file for complete search history.

(56) References Cited

U.S. PATENT DOCUMENTS

| | | | | |
|---|---|---|---|---|
| 5,038,871 | A | 8/1991 | Dinsdale | |
| 6,742,596 | B2 * | 6/2004 | Haugen | E21B 44/00 166/380 |
| 2005/0269104 | A1 * | 12/2005 | Folk | E21B 19/16 166/379 |
| 2013/0299190 | A1 | 11/2013 | Reddy et al. | |

* cited by examiner

GUIDANCE SYSTEMS AND APPARATUS FOR POWER SWIVEL

CROSS-REFERENCE TO RELATED APPLICATIONS

This application is a 35 U.S.C. § 371 national stage entry of PCT/US2016/063033, filed Nov. 21, 2016, and entitled "Guidance Systems and Apparatus for Power Swivel," which claims the benefit of U.S. Provisional Patent Application No. 62/258,696, filed Nov. 23, 2015, and entitled "Guidance System For Power Swivel and Related Methods," and the benefit of U.S. Provisional Patent Application No. 62/304,575, filed Mar. 7, 2016, and entitled "Guidance Systems And Apparatus for Power Swivel," the contents of each being hereby incorporated herein by reference in their entirety for all purposes.

STATEMENT REGARDING FEDERALLY SPONSORED RESEARCH OR DEVELOPMENT

Not applicable.

BACKGROUND

This disclosure relates to oil and gas drilling and production operations. More particularly, this disclosure relates to the drilling of a subterranean borehole for the production of oil and/or gas from a formation.

In drilling operations, a power swivel is often used to drive rotation of a tubular string (known as a "drillstring") and drill bit to form or extend a subterranean wellbore. The power swivel may be driven, in at least some examples, by a hydraulic motor that transfers torque to the drill bit and attached drillstring through a gear box. The power swivel is typically suspended by steel cables from a mast of a drilling structure, as opposite to being more rigidly attached to the vertically-extending drilling structure, such as is the case with track-mounted top drives that are typically employed, for example, in offshore drilling. During drilling operations, the power swivel traverses vertically relative to the mast as the drillstring advances into the newly formed borehole and when new sections of pipe are added to the drillstring. In addition, during these operations, the power swivel must pivot or rotate away from the drilling structure to allow a new section or joint of drill pipe to be attached thereto.

BRIEF SUMMARY OF THE DISCLOSURE

Some embodiments disclosed herein are directed to a system for drilling a subterranean borehole. In an embodiment, the system includes a mast, and a pipe rotator coupled to the mast. The pipe rotator includes a stem that is configured to be coupled to an end of a drillstring and a motor that is configured to rotate the stem. In addition, the system includes a guide system coupled to the mast and configured to guide vertical motion of the pipe rotator relative to the mast. The guide system includes a guide beam coupled to the mast, the guide beam including a longitudinal axis and a radially outer surface, and a dolly assembly coupled the guide beam and coupled to the pipe rotator. The dolly assembly is configured to traverse axially along the guide beam between the first end and the second end. The dolly assembly is pivotally coupled to the pipe rotator such that the pipe rotator is configured to pivot about a pivot axis relative to the dolly assembly, guide beam, and mast.

Other embodiments disclosed herein are directed to a system for guiding a pipe rotator along a mast, the pipe rotator including a stem that is configured to be coupled to an end of a drillstring and a motor that is configured to rotate the stem. In an embodiment, the system includes a guide beam configured to be coupled to the mast, the guide beam including a longitudinal axis. The guide beam includes a plurality of elongate sections configured to be axially aligned, a tensioning assembly coupled to a first of the elongate sections, and a linear actuator coupled to a second of the elongate sections, the linear actuator including a rod that is actuatable along the longitudinal axis. The tensioning assembly is coupled to the rod of the linear actuator; and the linear actuator is configured to actuate the rod to move in a direction along the longitudinal axis to translate the second elongate section toward the first elongate section along the longitudinal axis relative to the tensioning assembly.

Other embodiments disclosed herein are directed to a system for drilling a subterranean borehole. I an embodiment, the system includes a mast and a pipe rotator coupled to the mast. The pipe rotator includes a stem that is configured to be coupled to an end of a drillstring and a motor that is configured to rotate the stem. In addition, the system includes a guide beam coupled to the mast and configured to guide vertical motion of the pipe rotator relative to the mast, and a torque transfer assembly coupled to the guide beam and configured to transfer torque from the guide beam to the mast. The torque transfer assembly includes a torque post having a longitudinal axis, a first end, and a second end. The second end is coupled to the mast such that the second end is prevented from rotating relative to the mast about the longitudinal axis. The first end is received through a mounting collar coupled to the mast such that the torque post is free to rotate about the longitudinal axis relative to the mounting collar.

Other embodiments disclosed herein are directed to a guide system for guiding motion of a pipe rotator relative to a mast during drilling of a subterranean borehole. In an embodiment, the guide system includes a guide beam including a longitudinal axis, a first end, and a second end opposite the first end. In addition, the guide system includes a dolly assembly configured to pivotally couple to the pipe rotator, and configured to traverse axially along the guide beam between the first end and the second end.

Other embodiments disclosed herein are directed to a kit including a single shipping support member, including a support surface, and a guide beam comprising a plurality of axially connectable sections supported by the support surface. The plurality of axially connectable sections are configured to be axially coupled to one another along a common longitudinal axis to assembly the guide beam, and the guide beam is configured to be coupled to a drilling mast. In addition, the kit includes a dolly assembly disposed supported by the support surface. The dolly assembly is configured to couple a pipe rotator to the guide beam, and the dolly assembly includes at least one roller configured to engage the guide beam.

Still other embodiments disclosed herein are directed to a system for drilling a subterranean borehole. In an embodiment, the system includes a mast, and a pipe rotator coupled to the mast. The pipe rotator includes a stem that is configured to be coupled to an end of a drillstring and coupled to a motor that is configured to rotate the stem. In addition, the system includes a guide beam coupled to the mast, the guide beam including a longitudinal axis and configured to guide vertical motion of the pipe rotator. The guide system includes a plurality of elongate sections configured to be disposed generally along the longitudinal axis, and a plurality of coupling assemblies configured to interconnect the plurality of elongate sections and maintain the plurality of elongate sections in position along the longitudinal axis.

Embodiments described herein comprise a combination of features and advantages intended to address various shortcomings associated with certain prior devices, systems, and methods. The foregoing has outlined rather broadly the features and technical advantages of the disclosed embodiments in order that the detailed description that follows may be better understood. The various characteristics described above, as well as other features, will be readily apparent to those skilled in the art upon reading the following detailed description, and by referring to the accompanying drawings. It should be appreciated by those of ordinary skill in the art that the conception and the specific embodiments disclosed may be readily utilized as a basis for modifying or designing other structures for carrying out the same purposes as the disclosed embodiments. It should also be realized by those of ordinary skill in the art that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF THE DISCLOSED EXEMPLARY EMBODIMENTS

Figure 1:
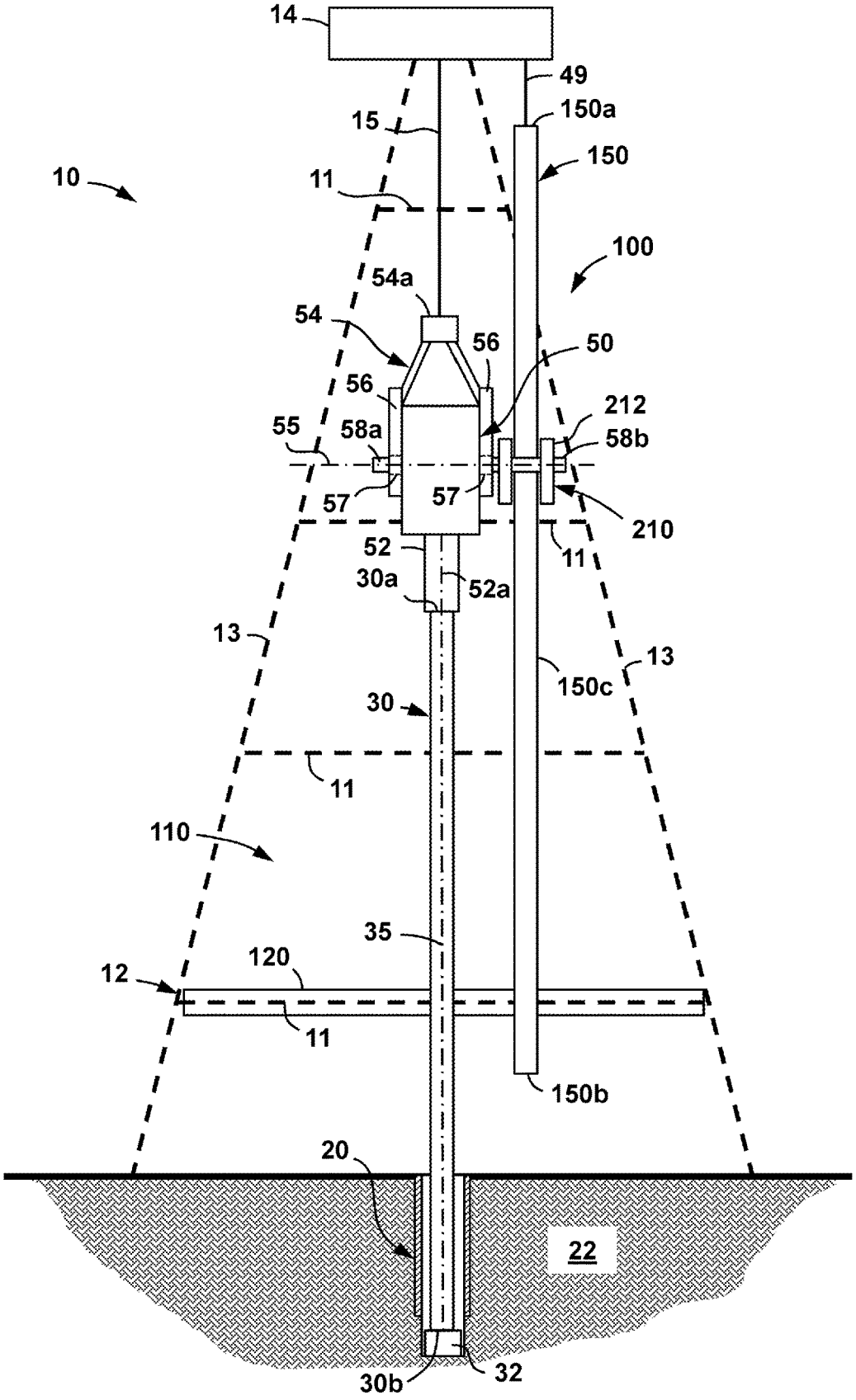
FIG. 1 is a front schematic view of a system for drilling a wellbore including a power swivel and guide system in accordance with at least some embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As previously described, a power swivel is typically suspended from a mast of a drilling apparatus such that the power swivel may be supported during drilling operations. Conventionally, a series of tensioned cables are coupled to power swivel and mast such that reaction forces (e.g., torque) resulting from resistance experienced by the drill bit during drill operations is transferred to the tensioned cables and into the support structure of the mast. Further, the tensioned cables also provide a guidance system for the power swivel such that all vertical movement of the power swivel during drilling operations can be controlled. However, it would be beneficial to have a more rigid system for both guiding a power swivel and for taking up the resulting torque loads during drilling operations, while still allowing the power swivel to pivot relative to the mast such that sections of drill pipe may be attached thereto. Thus, embodiments disclosed herein disclose a guide system for a power swivel that includes a rigid guide beam for guiding the vertical movement of the power swivel and a torque transfer assembly for coupling the guide beam to the mast of the drilling system. In addition, the embodiments disclosed herein also allow the power swivel to pivot relative to the guide system to facilitate the attachment of new sections of drill pipe.

Figure 2:
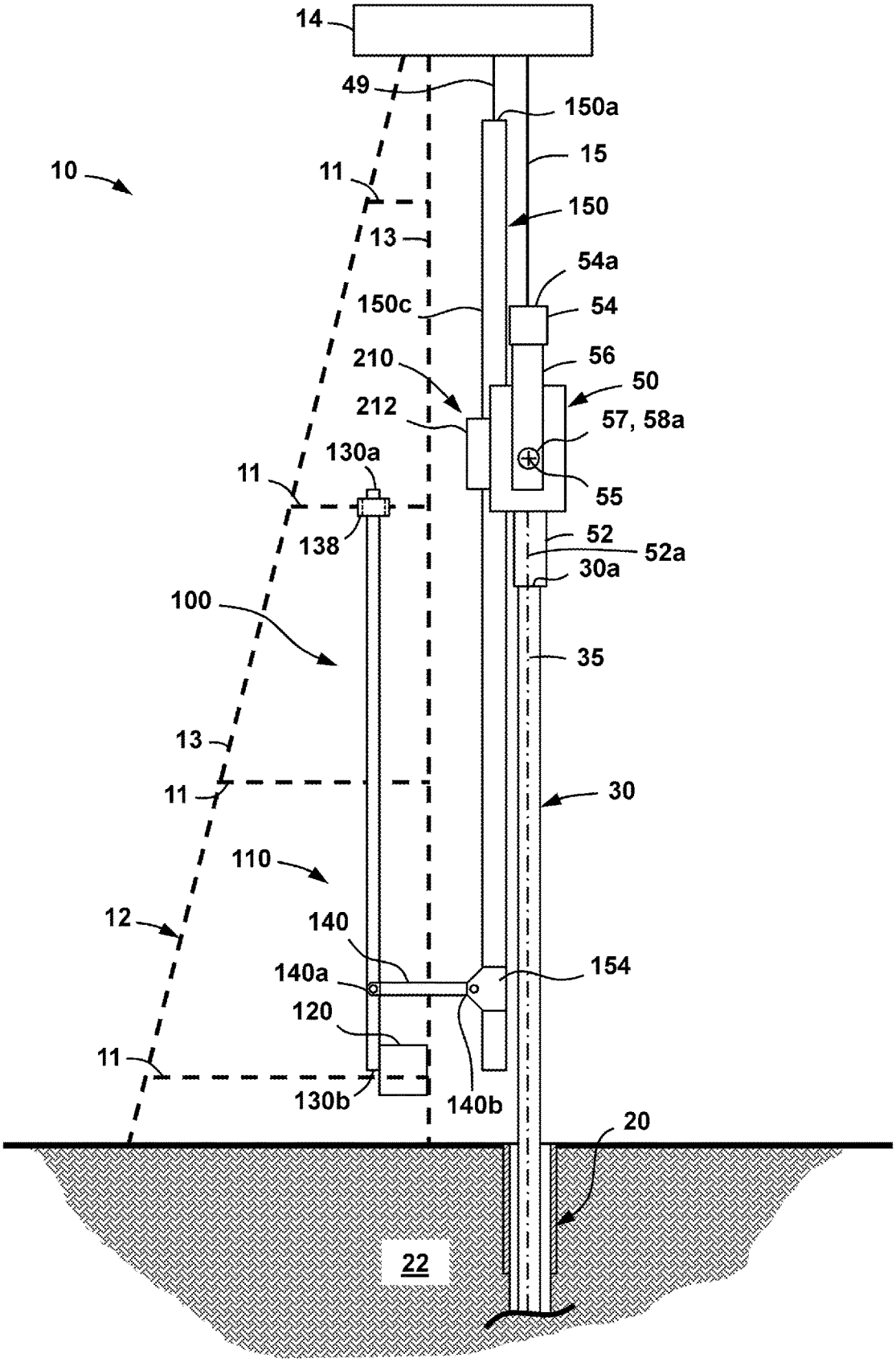
FIG. 2 is a side schematic view of the system of FIG. 1.

Referring now to FIGS. 1 and 2, a system 10 for drilling a wellbore 20 into a subterranean formation is shown. System 10 generally includes a mast 12, a power swivel 50, and a guide system 100 coupling power swivel 50 to mast 12 and guiding vertical movements of the power swivel 50 relative to mast 12. Mast 12 is a generally vertically oriented structure that comprises a plurality of more or less vertically oriented support members 13 and a plurality of substantially horizontally oriented support members 11. Each horizontally oriented support member 11 extends or spans between a pair of the vertically oriented support members 13. Additional members may be included along mast 10 (e.g., cross-members); however, these additional members are not shown so as not to unduly complicate the figures. A top or crown 14 is disposed at the vertically upper end of mast 12. As will be described in more detail below, crown 14 supports one or more blocks for routing cables, chains, or other tension members that support and lift other components relative to mast 12 (e.g., lines 15, 49).

Power swivel 50 is suspended from crown 14 via a line 15 (which may comprise a cable, chain, or other suitable tension device). Power swivel 50 is a pipe rotating apparatus or pipe rotator that is configured to impart rotative motion to one or more sections of tubular pipe. As previously described, power swivel 50 includes a motor (not shown in FIGS. 1 and 2) that drives rotation of a drillstring 30 coupled thereto. Specifically, power swivel 50 includes a stem 52 having a central axis 52*a*, that is coupled to the motor and is also coupled to an upper end 30*a* of drillstring 30 such that axis 52*a* of stem 52 is aligned with a central axis 35 of drillstring 30. Thus, during operations, stem 52 is driven (via the motor) to rotate about axes 52*a*, 35, such that drillstring 30 also rotates about axes 52*a*, 35.

Power swivel 50 is pivotably coupled to line 15 via a bail 54. Bail 54 includes an upper end 54*a* that is coupled to line 15 and a pair of arms 56 extending from upper end 54*a*. Each arm 56 has an aperture 57 extending therethrough, such that the apertures 57 of each arm 56 are aligned along a common horizontally oriented axis 55. In addition, each aperture 57 slidably receives a corresponding connector post 58*a*, 58*b* that extends from power swivel 50 such that power swivel 50 may rotate freely about axis 55 relative to bail 54.

Referring still to FIGS. 1 and 2, as previously described, power swivel 50 is coupled to a guide system 100 so that power swivel 50 may travel along a defined and desired vertical path, and so that reaction forces experienced by the power swivel 50 during drilling operations may be transferred to the structural members (e.g., members 11, 13) of mast 12. As shown, guide system 100 includes a guide beam 150, a dolly assembly 210 coupled to power swivel 50 and guide beam 150, and a torque transfer assembly 110 coupled to guide beam 150 and mast 12.

Guide beam 150 comprises an elongate member that includes a first or upper end 150*a*, a second or lower end 150*b* opposite upper end 150*a*, and a radially outer surface 150*c* extending axially between ends 150*a*, 150*b*. Upper end 150*a* is coupled to a line 49 that extends from crown 14 (or some other structural member, component, or feature disposed on mast 12). In addition, a mounting bracket 154 is disposed along guide beam 150 between ends 150*a*, 150*b*. In this embodiment, mounting bracket 154 is more proximate lower end 150*b* than upper end 150*a*. Also, as will be described in more detail below, mounting bracket 154 is used to couple guide beam 150 to torque transfer assembly 110 (particularly to connecting member 140).

Referring now to FIG. 3, in this embodiment, guide beam 150 comprises three (3) elongate sections 151, 152, 153 that are coupled end-to-end to one another along a common central, longitudinal axis 155 with a tensioning assembly 190. Specifically, guide beam 150 includes a first or upper section 151, a second or middle section 152, and a third or lower section 153. Each section 151, 152, 153 is a hollow member that includes a first or upper end 151*a*, 152*a*, 153*a*, respectively, a second or lower end 151*b*, 152*b*, 153*b*, respectively, axially opposite upper end 151*a*, 152*a*, 153*a*, respectively. In addition, each section 151, 152, 153 includes an internal through passage that extends axially between the respective ends—with upper section 151 including a through passage 157 extending axially between ends 151*a*, 151*b*, middle section 152 including a through passage 158 that extending axially between ends 152*a*, 152*b*, and lower section 153 including a through passage 159 extending axially between ends 153*a*, 153*b*. Further, in this embodiment, mounting bracket 154 is disposed along lower section 153.

Upper end 151*a* of upper section 151 is coincident with upper end 150*a* of guide beam 150. As shown in FIG. 3, upper end 151*a* of upper section 151 includes a connector 156 that connects to line 49 to suspend guide beam 150 from mast 12 (e.g., from crown 14). Connector 156 may comprise any suitable connector or coupling member that is suitable for connecting to a line, chain, rope, cable, etc. For example, in this embodiment, connector 156 comprises a pad eye. Lower end 153*b* of lower section 153 is coincident with lower end 150*b* of guide beam 150. As shown in FIG. 3, a linear actuator 200 is inserted within through passage 159 axially from lower end 153*b*. Linear actuator 200 may comprise any suitable device for extending or retracting along a defined linear direction, such as, for example, a hydraulic actuator, a pneumatic actuator, a motorized actuator, etc. In this embodiment, linear actuator 200 comprises a hydraulic actuator that has a rod 202 extending axially therefrom. As will be described in more detail below, actuator 200 is utilized to draw sections 151, 152, 153 axially toward one another via the tensioning assembly 190 to form guide beam 150.

In addition, the interconnecting ends (e.g., ends 151*b*, 152*a*, 152*b*, 153*a*) of sections 151, 152, 153 include coupling assemblies having connectors that allow for proper angular alignment between members 151, 152, 153 regardless of the rotational orientation of members 151, 152, 153 about axis 155. Specifically, lower end 151*b* of upper section 151 includes a male connector 161, upper end 152*a* of middle section 152 includes a female connector 170, lower end 152*b* of middle section 152 includes a male connector 160, and upper end 153*a* of lower section 153 includes another female connector 170. Connector 161 on lower end 151*b* of upper section 151 is configured to mate and engage with connector 170 on upper end 152*a* of middle section 152, and connector 160 on lower end 152*b* of middle section 152 is configured to mate and engage with connector 170 on upper end 153*a* of lower section 153.

Figures 4A, 4B, 4C, 4D:
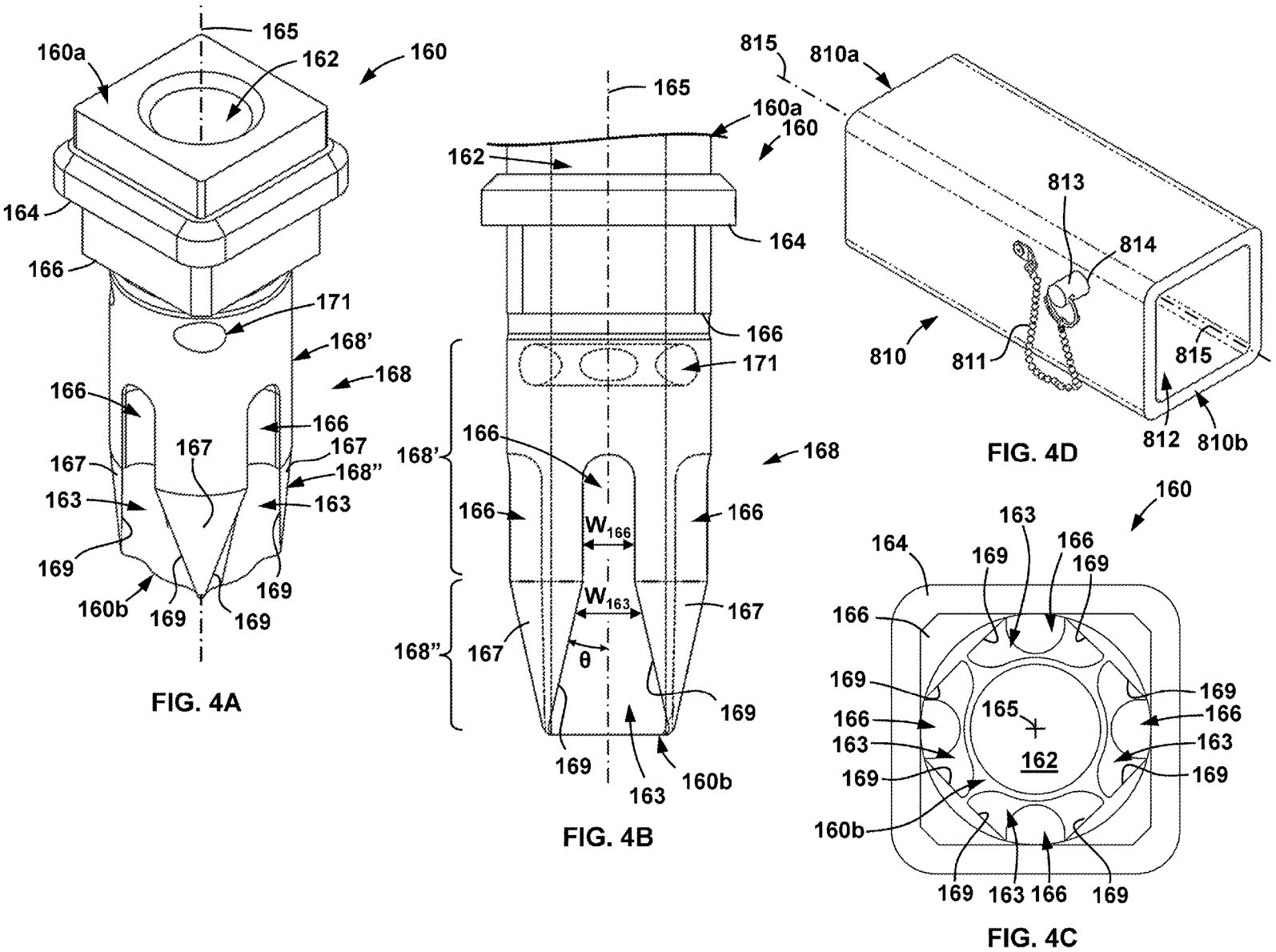
FIGS. 4A-4C are a perspective, front, and bottom view, respectively, of a male connector of the guide beam of FIG. 3.
FIG. 4D is a perspective view of a cover for engagement with the male connector of FIGS. 4A-4C.

Referring now to FIGS. 4A-4C, male connector 160 on lower end 152*b* of middle section 152 is shown. Connector 160 includes a central or longitudinal axis 165 that is aligned with axis 155 when guide beam 150 is fully assembled. In addition, connector 160 includes a first or upper end 160*a*, a second or lower end 160*b* opposite upper end 160*a*, and a throughbore 162 extending axially between ends 160*a*, 160*b*. Upper end 160*a* is coupled to lower end 152*b* of middle section 152 and lower end 160*b* extends axially away from lower end 152*b* along the aligned axes 155, 175. A first or upper landing shoulder 164 extends radially outward and angularly about connector 160 between ends 160*a*, 160*b*, and a second or lower landing shoulder 166 extends radially outward and angularly about connector 160 between upper landing shoulder 164 and lower end 160*b*. As best shown in FIGS. 4B and 4C, the upper landing shoulder 164 extends radially beyond the lower landing shoulder 166. As will be described in more detail below, landing shoulders 164, 166 each engage or abut a corresponding landing surface or shoulder within the corresponding connector 170 (e.g., the female connector 170 on upper end 153*a* of lower section 153) during assembly of guide beam 150.

In addition, connector 160 includes an angular alignment section 168 extending axially between lower landing shoulder 166 and lower end 160*b*. In this embodiment, angular alignment section 168 includes a cylindrical portion 168' extending axially from lower landing shoulder 166 and a conical portion 168" extending axially between cylindrical section 168' and lower end 160*b*. Conical portion 168" includes a plurality of radially extending recesses 163 that define a plurality of conical projections 167 extending angularly between each recess 163. Each recess 163 is defined by a pair of ramped surfaces 169 that converge with one another when moving axially upward from lower end 160*b*. Thus, surfaces 169 may each be referred to herein as a "converging surface 169." As best shown in FIG. 4B, each surface 169 forms an angle θ with a plane containing central axis 165 when connector is viewed from the side (e.g., as shown in FIG. 4B). In some embodiments, the angle θ is preferably between 0° and 90°, inclusive, is more preferably between 0° and 20°, inclusive, and is still more preferably between 10° and 15°, inclusive. In this embodiment, the angle θ is equal to 13°. A plurality of slots 166 extend axially through cylindrical portion 168', with each slot 166 extending axially from one of the recesses 163. Each recess 163 includes a width $W_{163}$ that decreases when moving from lower end 160*b* toward cylindrical portion 168' and each slot 166 includes a width $W_{166}$ that preferably equals the width $W_{163}$ of the corresponding recess 163 at the upper most portion of recess 163.

In addition, as is best shown in FIG. 4C, each of the recesses 163 are uniformly or equally angularly spaced about axis 165 and each of the slots 166 are uniformly or equally angularly spaced about axis 165. In this embodiment, there are a total of four (4) recesses 163 and a total of four (4) slots 166. Thus, in this embodiment, each recess 163 is angularly spaced 90° from each immediately angularly adjacent recess 163 and each slot 166 is angularly spaced 90° from each immediately angularly adjacent slot 166.

Also, connector 160 includes a bore 171 that extends perpendicularly through a plane containing the central axis 165 (e.g., the plane extending perpendicularly into connector 160 and through axis 165 along the view shown in FIG. 4B). However, in this embodiment, bore 171 does not intersect axis 165 (i.e., bore 171 is radially offset from axis 165). As will be described in more detail below, bore 171 receives a pin (e.g., pin 185 shown in FIG. 7) to secure connector 160 to a corresponding one of the connectors 170 during assembly of guide beam 150 (e.g., the female connector 170 on upper end 153*a* of lower section 153).

Referring now to FIG. 4D, male connector 160 may also include a cover 810, that is configured to slip over male connector 160 and shield one or more structural features thereof while sections 151, 152, 153 of guide beam 150 are uncoupled (e.g., during transit, storage, handling, etc. of sections 151, 52, 153 of guide beam 150). Cover 810 includes a central axis 815, a first or closed end 810*a*, a second or open end 810*b* opposite open end 810*a*, and a recess or cavity 812 extending from open end 810*b* toward closed end 810*a*. In addition, cover 810 includes a mounting aperture 814 extending in a direction that is perpendicular to axis 810. In this embodiment, mounting aperture 814 is more proximate open end 810*b* than closed end 810*a*. A mounting pin 813 is disposed within aperture 814 that is further secured to cover 810 via a chain 811 or other connecting cable (e.g., rope, metal cable, wire, etc.).

During operations, cover 810 may be slipped over male member 160 so that angular alignment section 168 and lower end 160*b* are received within cavity 812 so that axis 815 is aligned with axis 165 and until open end 810*b* abuts or engages with lower landing shoulder 164. In other embodiments, open end 810*b* may abut landing shoulder 166 or may not abut either shoulder 164, 166. Once connector 160 (or at least lower end 160*b* and angular alignment section 168) is received within cavity 812, aperture 812 is aligned with bore 171 in male connector 160 and pin 813 is inserted through the aligned aperture 812 and bore 171 to secure cover 810 to male connector 160 when desired.

It should be appreciated that connector 161 on lower end 151*b* of upper section 151 is configured the same as connector 160 shown in FIGS. 4A-4C, except that connector 161 does not include throughbore 162. Thus, a detailed description of connector 161 is omitted herein in the interests of brevity and the description above with regard to connector 160 can be applied to fully describe connector 161, with the exception of throughbore 162.

Figure 5D:
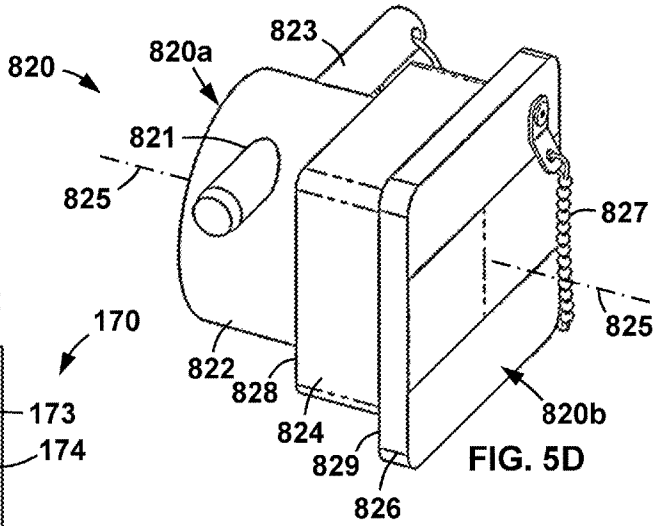
FIG. 5D is a perspective view of a cover for engagement with the female connector of FIGS. 5A-5C.
Figure 5C:
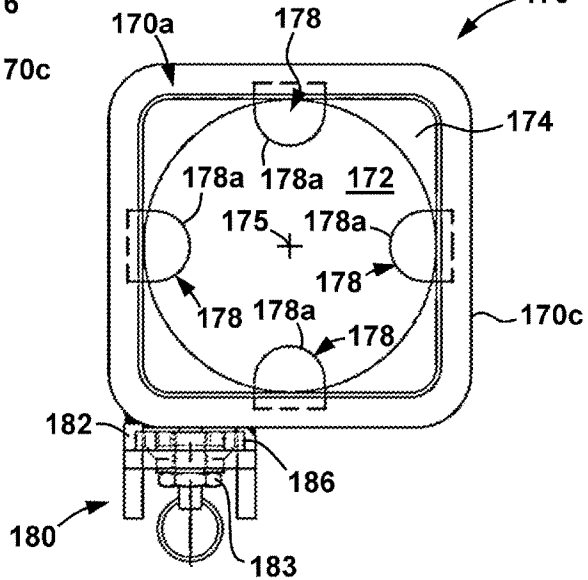
FIGS. 5A-5C are a front, side, and top view of a female connector of the guide beam of FIG. 3.
Figure 5B:
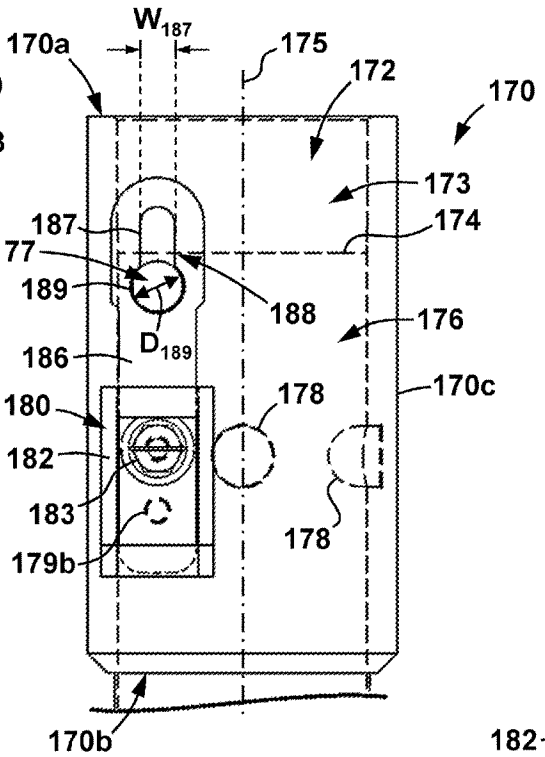
Figure 5A:
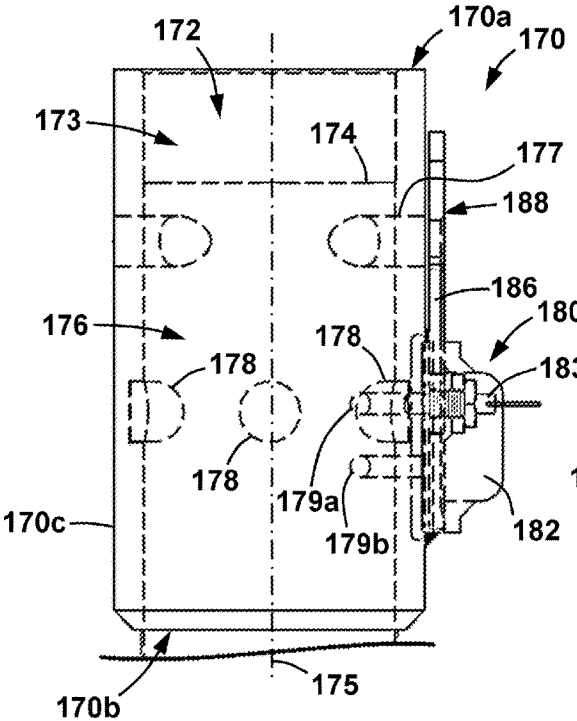

Referring now to FIGS. 5A-5C, female connector 170 on upper end 152*a* of middle section 152 and upper end 153*a* of lower section 153 is shown. Connector 170 includes a central or longitudinal axis 175 that is aligned with axis 155 of guide beam 150 during operations, a first or upper end 170*a*, a second or lower end 170*b* opposite upper end 170*a*, a radially outer surface 170*c* extending axially between ends 170*a*, 170*b*, and a throughbore 172 also extending axially between ends 170*a*, 170*b*. Lower end 170*b* is coupled to upper end 153*a* of lower section 153 and upper end 170*a* extends axially away from upper end 153*a* along the aligned axes 155, 175. Throughbore 172 includes a first or upper rectangular portion 173 extending axially from upper end 170*a*, and a second or lower cylindrical portion 176 extending axially between upper rectangular portion 173 to lower end 170*b*. A landing shoulder 174 is formed at the intersection of upper rectangular portion 173 and lower cylindrical portion 176, that extends radially inward or toward axis 175 within throughbore 172.

Lower cylindrical portion 176 includes a plurality of projections 178 extending radially inward toward axis 175. Specifically, as shown in FIG. 5C, projections 178 each comprise a convex spherical surface 178*a* that projects radially inward toward axis 175 from lower cylindrical portion 176 of throughbore 172. Projections 178 are uniformly or equally angularly spaced about axis 175. In this embodiment there are a total of four (4) projections 178, and thus, each projection 178 is angularly spaced 90° from each immediately angularly adjacent projection 178. As will be described in more detail below, each projection 178 engages with and slides within one of the recesses 163 and slots 166 to angularly align connectors 160, 161, 170 about axis 155 during assembly of guide beam 150.

Also, as is best shown in FIGS. 5A and 5B, connector 170 includes a bore 177 that extends perpendicularly through a plane containing the central axis 175 (e.g., the plane extending perpendicularly into connector 170 and through axis 175 along the view shown in FIG. 5A). However, in this embodiment, bore 177 does not intersect axis 175 (i.e., bore 177 is radially offset from axis 175). As will be described in more detail below, bore 177 aligns with bore 171 on connector 160 (or connector 161) and receives a pin (e.g., pin 185 shown in FIGS. 6A, 6B, and 7) to secure connector 160 to a corresponding one of the connectors 170 during assembly of guide beam 150.

Figure 6A:
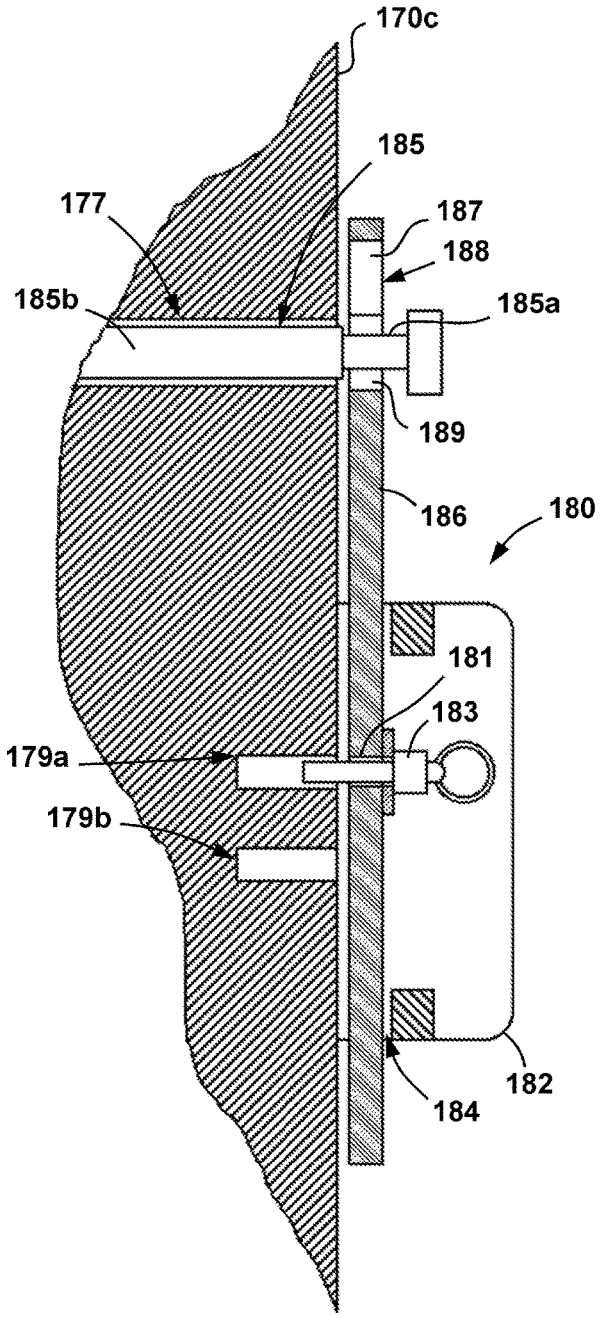
FIGS. 6A and 6B are sequential schematic cross-sectional views showing the locking assembly of the female connector of FIGS. 5A-5C transitioning between an unlocked and locked position.
Figure 6B:
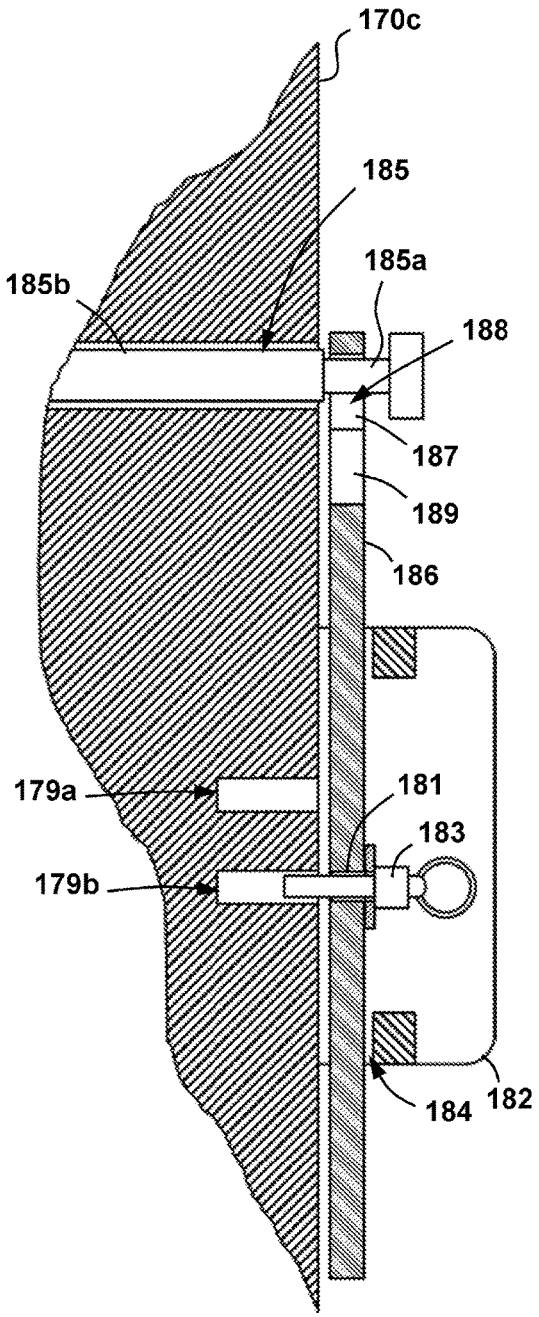

Referring now to FIGS. 5A-5C, 6A, and 6B, female connector 170 also includes a locking assembly 180 disposed on radially outer surface 170*c*. As best shown in FIGS. 6A and 6B, locking assembly 180 includes a bracket 182, a sliding member 186, and a biased locking pin 183. Bracket 182 is secured to radially outer surface 170*c* of connector 170 and forms a slot 184 for slidably receiving sliding member 186 therein. Sliding member 186 is an elongate member that includes a first or upper aperture 188 and a second or lower aperture 181 axially below upper aperture 188. Upper aperture 188 comprises a circular hole 189 and a slot 187 extending axially from hole 189. As best shown in FIG. 5B, slot 187 has a width $W_{187}$ (see FIG. 5B) that is smaller than an inner diameter $D_{189}$ of hole 189. Lower aperture 181 receives biased locking pin 183 therethrough.

Referring specifically to FIGS. 6A and 6B, a first or upper locking aperture 179*a* extends into radially outer surface 170*c* axially between ends 170*a*, 170*b* of connector 170 (e.g., see FIG. 5A) and a second or lower locking aperture 179*b* extends into radially outer surface 170*c* axially between upper locking aperture 179*a* and lower end 170*b*. Locking apertures 179*a*, 179*b* are each configured to receive pin 183 therein to place sliding member 186 into an unlocked position (e.g., FIG. 6A) and a locked position (e.g., FIG. 6B), respectively. Locking pin 183 is biased into and through aperture 181 and into one of the apertures 179*a*, 179*b* such that a force (e.g., tension) must be applied to pin 183 to withdrawal pin 183 from aperture 181 and the aligned one of the aperture 179*a*, 179*b*. Pin 183 may be biased in any suitable manner, such as, for example, with a coiled spring. As is best shown in FIGS. 5A and 6A, when sliding member 186 is in the unlocked position (FIG. 6A), hole 189 is generally axially aligned with bore 177, and lower aperture 181 is axially aligned with upper locking aperture 179*a*. Conversely, when sliding member 186 is in the locked position (FIG. 6B), slot 187 is generally axially aligned with bore 177 and lower aperture 181 is axially aligned with lower locking aperture 179*b*.

Referring now to FIG. 5D, as similarly described above for male connector 160, female connector 170 may also include a cover 820, that is configured to engage with female connector 160 and shield one or more structural features thereof while sections 151, 152, 153 of guide beam 150 are uncoupled (e.g., during transit, storage, handling, etc. of sections 151, 52, 153 of guide beam 150). Cover 820 includes a central axis 825, a first end 820*a*, and a second end 820*b* opposite open end 820*a*. In addition, cover 820 includes a cylindrical member 822 extending axially from first end 820*a*, a terminal flange 826 at second end 820*b*, and a rectangular member 824 extending axially between cylindrical member 82 and flange 826. A first radially extending landing shoulder 828 is formed axially between cylindrical member 822 and rectangular member 824, and a second radially extending landing shoulder 829 is formed axially between rectangular member 824 and flange 826. Further, a mounting aperture 821 extends through cylindrical member 822 in a direction that is perpendicular to axis 825, and a mounting pin 823 is disposed within aperture 821 that is further secured to cover 826 via a chain 827 or other connecting cable (e.g., rope, metal cable, wire, etc.).

During operations, cover 820 is engaged with female member 170 so that axis 825 is aligned with axis 175 and so that both cylindrical member 822 and rectangular member 824 are received within throughbore 172 from upper end 170*a*. Specifically, cylindrical member 822 is received within lower cylindrical portion 176 of throughbore 172 and rectangular member 824 is received within upper rectangular portion 173 of throughbore 173. In addition, members 822, 824 are received within throughbore 172 from upper end 170*a* until first landing shoulder 828 engages or abuts with landing shoulder 174, and second landing shoulder 829 engages or abuts with upper end 170*a*. Once connector 170 receives cover 820 in the manner described above, aperture 821 is aligned with bore 177 in female connector 170 and pin 823 is inserted through the aligned aperture 821 and bore 177 to secure cover 820 to female connector 170 when desired.

Figure 7:
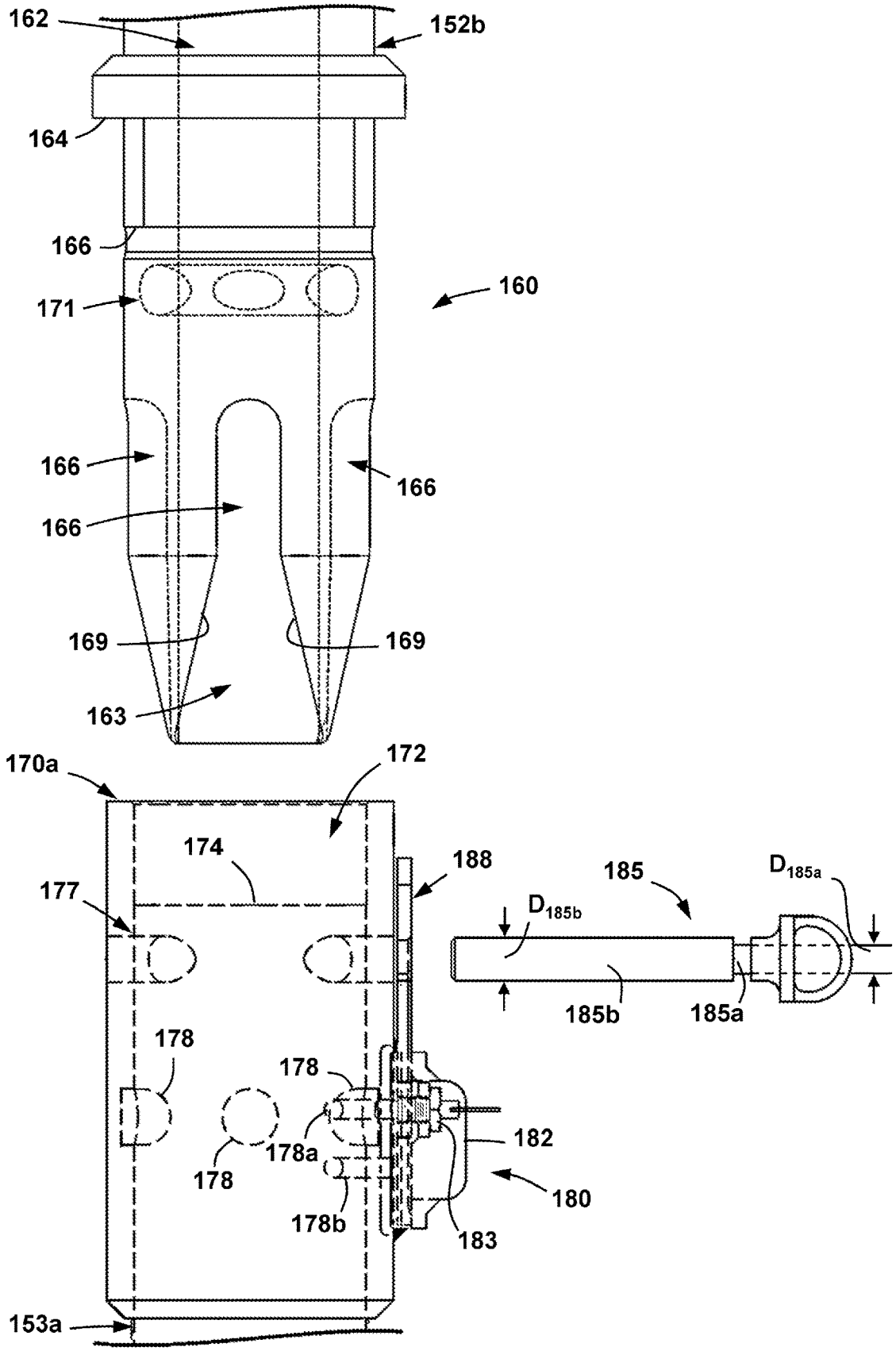
FIG. 7 is a side view of the male connector of FIGS. 4A-4C being inserted within the female connector of FIGS. 5A-5C.

Referring now to FIGS. 6A, 6B, and 7, during assembly of guide beam 150 (discussed in more detail below), connector 161 on lower end 151*b* of upper section 151 engages with connector 170 on upper end 152*a* of middle section 152 and connector 160 on lower end 152*b* of middle section 152 engages with connector 170 on upper end 153*a* of lower section 153. During this assembly, convex spherical surfaces 178*a* on projections 178 in connectors 170 slidingly engage with recesses 163 (particularly surfaces 169) and slots 166 on connectors 160, 161 such that connectors 160, 161, 170 (and thus sections 151, 152, 153) rotate about axis 155 and angularly align with one another. For example, with specific reference to FIG. 7 which shows connector 160 on lower end 152*b* of middle section 152 being inserted within connector 170 on upper end 153*a* of lower section 153, each projection 178 enters and slides along one of the recesses 163 and then eventually enters one of the slots 166. The alignment of slots 166 and projections 178 ensures that connectors 160, 170 and sections 152, 153 are angularly aligned with one another about axis 155.

As is also best shown in FIG. 7, axial insertion of connector 160 into connector 170 continues until lower landing shoulder 166 of connector 160 engages or abuts landing shoulder 174 within throughbore 172 and upper landing shoulder 164 of connector 160, engages or abuts upper end 170*a* of connector 170. The engagement of shoulders 166, 174 and shoulder 166 and end 170*a* also causes axial alignment between bores 171, 177 in connectors 160, 170, respectively.

Referring still to FIGS. 6A, 6B, and 7, during the insertion of connector 160 into connector 170, locking assembly 180 is placed in the unlocked position (e.g., FIG. 6A) such that hole 189 in aperture 188 is generally axially aligned with aperture 177 in connector 170. As a result, the alignment of bores 171, 177 during insertion of connector 160 into connector 170 also causes axial alignment between bore 171 and hole 189. Thus, once connector 160 is fully seated within female connector 170, a locking pin 185 is inserted through hole 189 of aperture 188 in sliding member 186 and through the aligned bores 171, 177. Pin 185 includes a small diameter portion 185*a* that has an outer diameter $D_{185a}$ and a large diameter portion 185*b* that has an outer diameter $D_{185b}$. As shown in FIG. 7, the outer diameter $D_{185b}$ of the large diameter portion 185*b* is larger than the outer diameter $D_{185a}$ of the small diameter portion 185*a*. In addition, outer diameter $D_{185b}$ of large diameter portion 185*b* is larger than the width $W_{187}$ of slot 187 and outer diameter $D_{185a}$ of small diameter portion 185*a* is smaller than the width $W_{187}$.

As shown in the sequence from FIG. 6A to FIG. 6B, after alignment of bores 171, 177, and insertion of pin 185 through hole 189 and bores 171, 177, locking assembly 180 is transitioned from the unlocked position (e.g., FIG. 6A) to the locked position (e.g., FIG. 6B) to prevent removal of pin 185 (and thereby disconnection of connectors 160, 170). Specifically, pin 183 is withdrawn from upper locking aperture 179*a* and then sliding member 186 is translated axially downward through slot 184 in bracket 182 to thereby align aperture 181 and pin 183 with lower locking aperture 179*b*. In addition, as sliding member 186 translates axially downward, small diameter portion 185*a* of pin 185 is received within slot 187. Because the diameter $D_{185b}$ of large diameter portion 185*b* is larger than the width $W_{187}$ of slot 187 as previously described, the reception of small diameter portion 185*a* into slot 187 prevents pin 185 from being withdrawn from bores 171, 177 and aperture 188 due to engagement of sliding member 186 and large diameter portion 185*b* (see FIG. 6B).

It should be appreciated that the connection procedure between connector 161 on lower end 151*b* of upper section 151 and connector 170 on upper end 152*a* of middle section 152 is the same as that described and shown herein for connector 160 on lower end 152*b* of section 152 and connector 170 on upper end 153*a* of section 153. Thus, a detailed description of the connection between connector 161 on lower end 151*b* of section 151 and connector 170 on upper end 153*a* of section 153 is omitted in the interests of brevity.

Referring again to FIG. 3, as previously described, guide beam 150 includes a tensioning assembly 190 extending through one of more of the sections 151, 152, 153 and coupled to rod 202 of linear actuator 200. Tensioning assembly 190 couples each of the sections 151, 152, 153 to one another along axis 155 and transfers tension generated by linear actuator to each of the sections 151, 152, 153 to transition the guide beam 150 between an axially extended position and an axially retracted position. In this embodiment, tensioning assembly 190 comprises a plurality of chains 192*a*, 192*b* coupled to and interspersed between a plurality of rigid tensioning members 194. Particularly, tensioning assembly 190 comprises a first or upper chain 192*a* extending between connector 160 at lower end 151*b* of upper section 151 and a first or upper tensioning member 194*a* disposed within through passage 158 of middle section 152, and a second or lower chain 192*b* extending from the upper tensioning member 194*a* to a second or lower tensioning member 194*b* disposed within through passage 159 of lower section 153. The lower tensioning member 194*b* is coupled to output rod 202 of actuator 200. In this embodiment, tensioning members 194*a*, 194*b* each have a length that is substantially smaller than the length of sections 151, 152, 153; however, it should be appreciated that in other embodiments tensioning members 194*a*, 194*b* may have lengths that are substantially similar to or just under the lengths of sections 151, 152, 153. Without being limited to this or any other theory, making tensioning members 194*a*, 194*b* longer imparts a greater rigidity, shortens the length of chains 192*a*, 192*b*, allows for some additional flexibility of tensioning members 194*a*, 194*b* during operations.

Figure 3A:
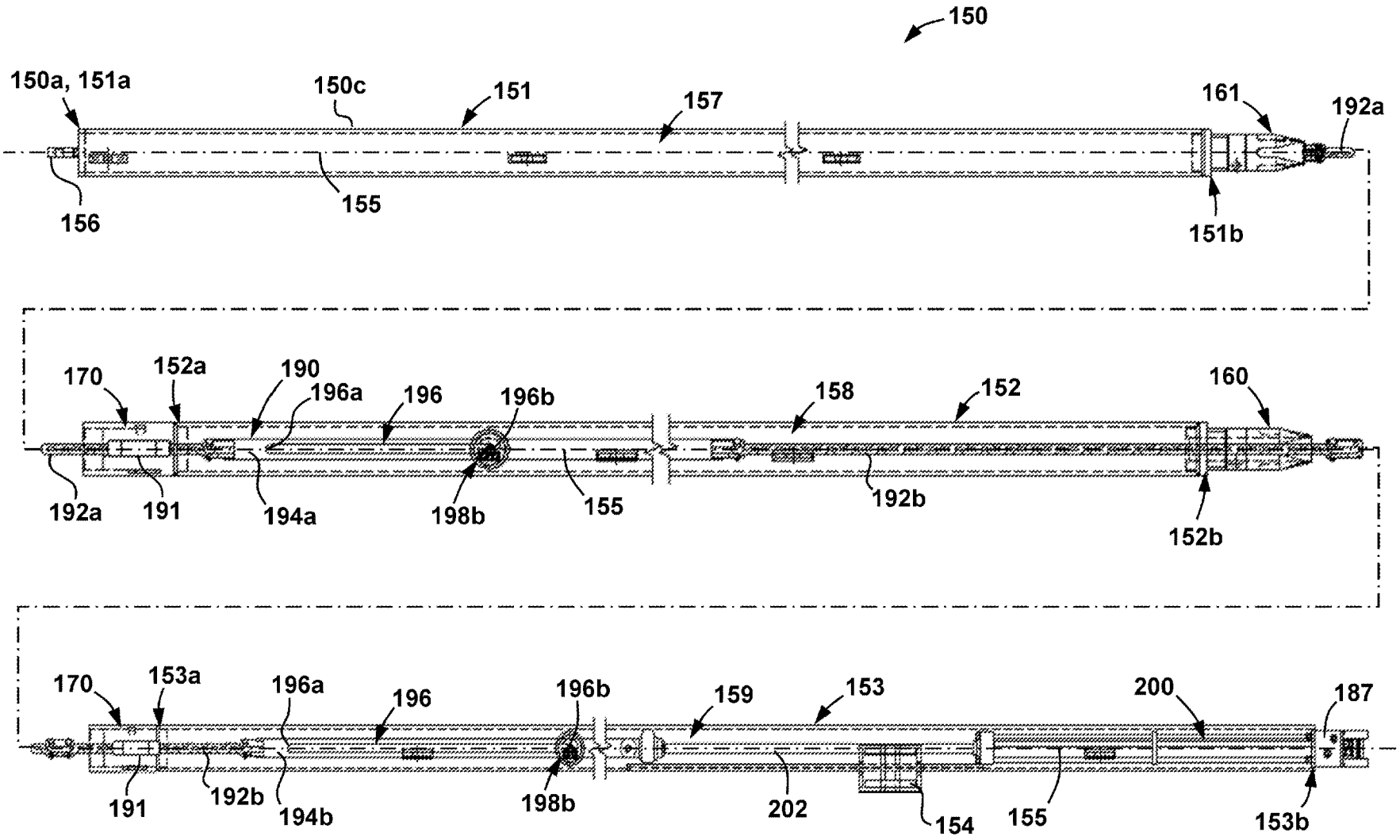
FIG. 3A is a side view of a guide beam of the guide system of FIG. 1

In addition, as shown in FIG. 3A, each chain 192*a*, 192*b* includes a swivel joint 191 disposed therealong. Swivel joint 191 includes a pair of bearings or other devices to facilitate rotation of one portion of chains 192*a*, 192*b* relative to another portion of the chains 192*a*, 192*b*, respectively. Specifically, referring now to FIG. 3B, each swivel joint 191 includes a central axis 95, a first end 191*a*, and a second end 191*b* opposite first end 191*a*. In addition, swivel joint 191 includes a first coupling section 193' extending axially from first end 191*a*, and a second coupling section 193" extending axially from second end 191*b*. In addition, a central body section 199 is disposed axially between and coupled to each of first coupling section 193' and second coupling section 193".

Each coupling section 193', 193" includes an axially extending recess 195 extending from the corresponding end 191*a*, 191*b* (i.e., from first end 191*a* for first coupling section 193', and from second end 191*b* for second coupling section 193"). Further, each coupling section 193', 193" includes a pair of mounting apertures 197 extending radially therethrough and across recess 195 so that for each coupling section 193', 193", the apertures 197 are radially opposite one another across axis 95. During operations, swivel joints 191 are coupled to chains 192*a*, 192*b* by coupling one link of the corresponding chain 192*a*, 192*b* to one of the coupling sections 193', 193" and coupling another link of the corresponding chain 192*a*, 192*b* to the other of the coupling sections 193', 193". In particularly, coupling sections 193', 193" may be coupled to chains 192*a*, 192*b* by coupling a coupling member (e.g., shackle, chain connector, chain link, etc.) to one of the leading links of the chain 192*a* and to coupling apertures 197 extending through the corresponding coupling section 193', 193".

Central body section 199 is generally cylindrical in shape in this embodiment; although it should be appreciated that central body section 199 and coupling sections 193', 193" may take a variety of shapes and forms in other embodiments. Also, while not specifically shown central body section 199 is coupled to teach of the coupling sections 193', 193" via a corresponding bearing or rotation assembly (not shown) that facilitates and allows coupling sections 193', 193" to rotate or pivot freely about axis 95 relative to central body section 199.

Figure 3B:
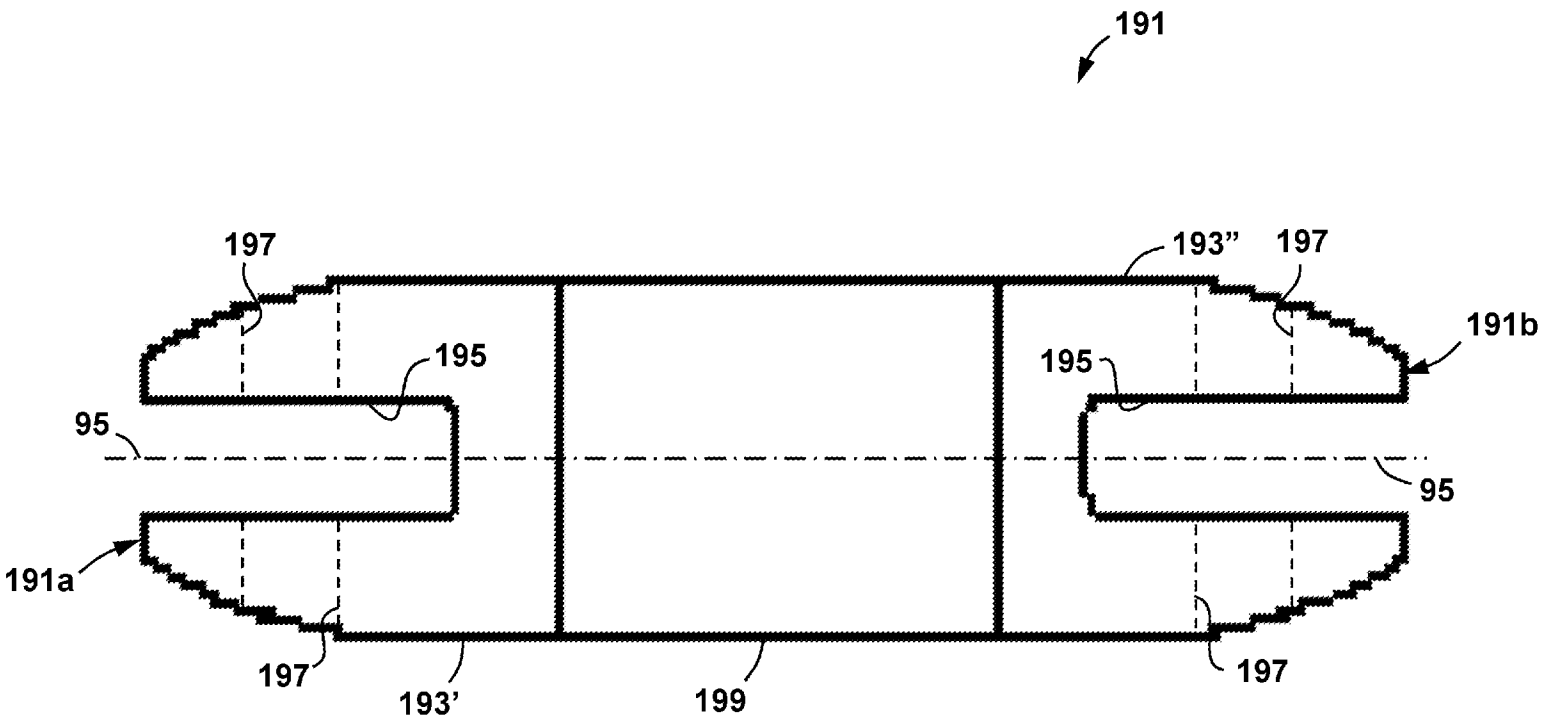
FIG. 3B is a side view of one of the swivel joints of the guide beam of FIG. 3A.

Referring now to FIGS. 3A and 3B, each chain 192*a*, 192*b* includes a swivel joint 191 disposed therealong so that chains 192*a*, 192*b* may freely twist and rotate about axis 95 (or axis 155) at swivel joint 191 within placing a toque on either connection point for chains 192*a*, 192*b*. Specifically, chain 192*a* may freely twist or rotation about axes 95, 155 at the corresponding swivel joint 191 without placing a torque on either the connection point with connector 161 or at the connection point with upper tensioning member 194*a*. Similarly, chain 192*b* may freely twist or rotation about axes 95, 155 at the corresponding swivel joint 191 without placing a torque on either the connection point with upper tensioning member 194*a* or at the connection point with lower tensioning member 194*b*. Without being limited to this or any other theory, the inclusion of swivel joints 191 along chains 192*a*, 192*b* improves the relative rotation between sections 151, 152, 153 of guide beam 150 to allow for proper alignment of connectors (e.g., connectors 160, 170) during operations (discussing in more detail below).

Upper tensioning member 194*a* and lower tensioning member 194*b* each include a slot 196 extending therethrough. Each slot 196 has a first or upper end 196*a*, and a second or lower end 196*b*. A pin 198*a* extends through middle section 152 and slot 196 in upper tensioning member 194*a* such that upper tensioning member 194*a* may traverse axially within through passage 158 of middle section 152 in a range set by the length of slot 196 (e.g., the axial length between ends 196*a*, 196*b*). Similarly, a pin 198*b* extends through lower section 153 and slot 196 in lower tensioning member 194*b* such that lower tensioning member 194*b* may traverse axially within through passage 159 lower section 153 in a range set by the length of slot 196 (e.g., the axial length between ends 196*a*, 196*b*).

Figure 8A:
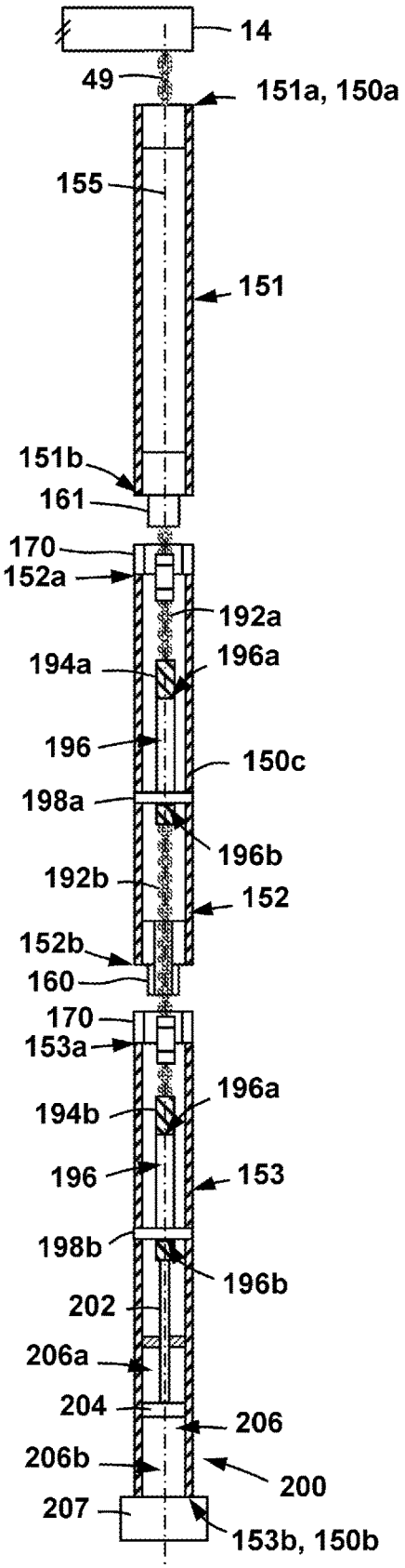
FIGS. 8A and 8B are sequential, schematic cross-sectional views showing the guide beam of FIG. 3 transitioning from an extended position to a retracted position.
Figure 8B:
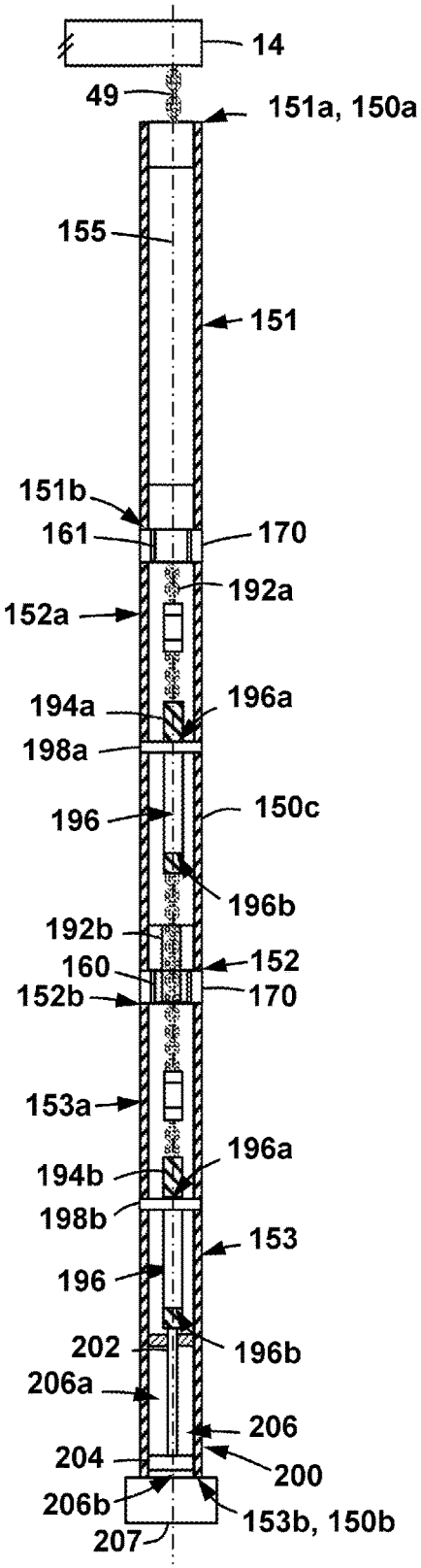
Figure 9:
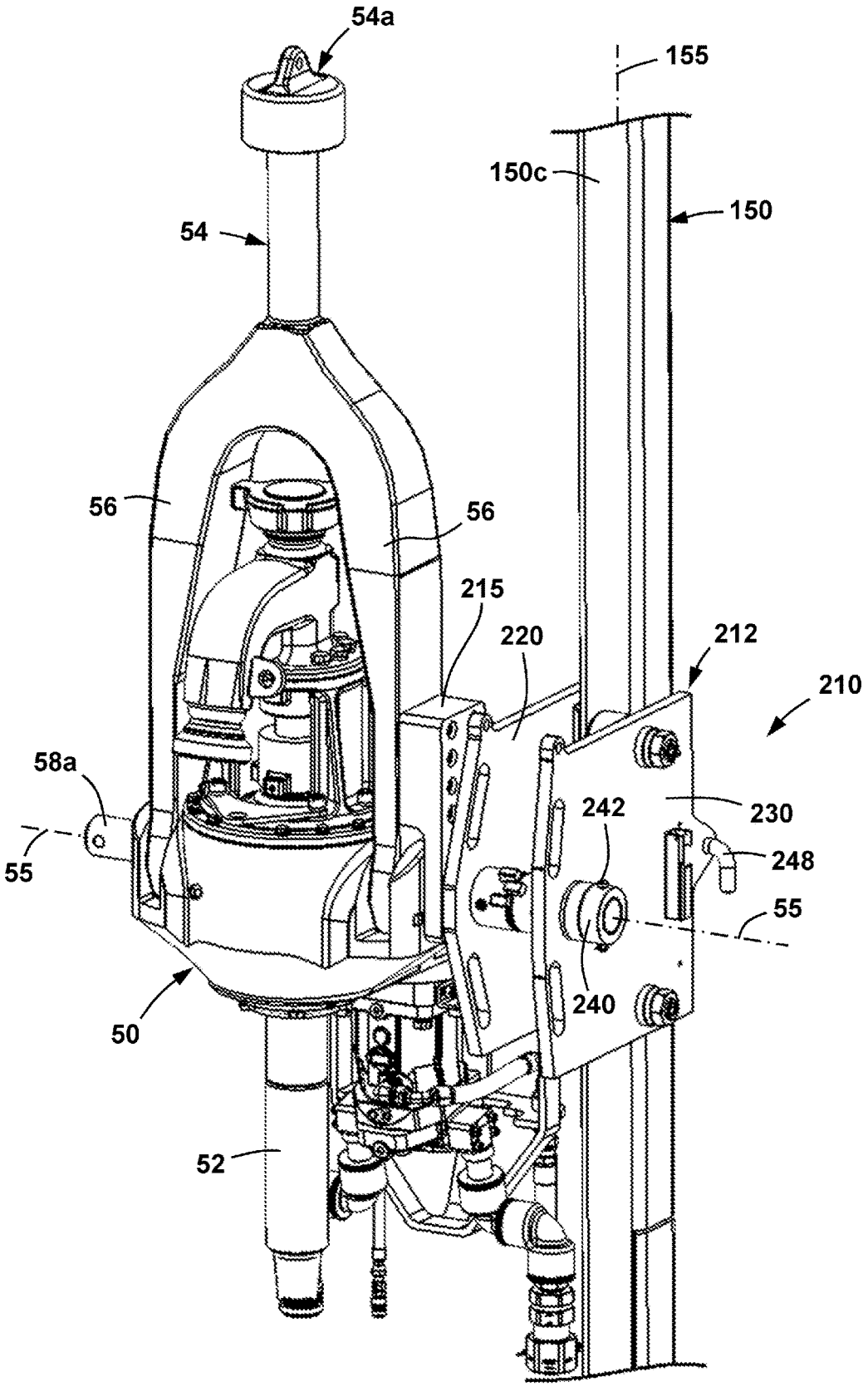
FIG. 9 is a schematic view of the power swivel, dolly assembly, and guide beam of the system of FIG. 1.

Referring now to FIGS. 8A and 8B, guide beam 150 may be initially placed in an axially extended position (e.g., FIG. 8A) where upper section 151 is suspended from line 49, and middle and lower sections 152, 153 are each suspended from tensioning assembly 190. In addition, when guide beam 150 is in the axially extended position (FIG. 8A), sections 151, 152 and their connectors 161, 170, respectively, are axially separated from one another along tensioning assembly 190 and sections 152, 153, and thus, their connectors 160, 170, respectively, are axially separated from one another along tensioning assembly 190.

Guide beam 150 may also be transitioned from the axially extended position to an axially retracted position (e.g., FIG. 8B) by actuating linear actuator 200 retract rod 202 toward lower end 153*b* of lower section 153 and thereby drawing sections 152, 153 axially toward upper section 151 along axis 155 relative to and along chains 192*a*, 192*b*, and rigid tension members 194*a*, 194*b* of tensioning assembly 190. Specifically, as previously described, in this embodiment, actuator 200 is a hydraulic actuator, and thus includes a piston 204 that is coupled to rod 202 and that is slidably disposed within a chamber 206 thereby separating chamber 206 in to a first or upper subchamber 206*a* and a second or lower subchamber 206*b*. Subchambers 206*a*, 206*b* are fluidly sealed and isolated from one another by piston 204. Actuator 200 also includes a manifold 207 at lower end 153*b* that includes at least one communication passage in communication with upper subchamber 206*a* and at least one communication passage in communication with lower subchamber 206*b* (note: the internal communication passages within manifold 207 are not shown so as not to unduly complicate the figure). During operation, piston 204 and thus rod 202 may be translated axially relative to chamber 206 by pressurizing one of the subchambers 206*a*, 206*b*. Specifically, piston 204 and rod 202 are actuated axially upward or toward upper end 153*a* of lower section 153 by pressurizing lower subchamber 206*b* with hydraulic fluid and piston 204 and rod 202 are actuated axially downward or toward lower end 153*b* of lower section 153 by pressurizing upper subchamber 206*a* with hydraulic fluid.

Referring still to FIGS. 8A and 8B, after guide rod 150 is suspended from line 49 and placed in the axially extended position (FIG. 8A), upper subchamber 206*a* of actuator 200 is pressurized with hydraulic fluid to translate piston 204 and rod 202 axially downward and toward lower end 153*b* of lower section 153 to transition guide beam 150 to the axially retracted position (FIG. 8B). Because lower tension member 194*b* of tensioning assembly 190 is coupled to rod 202 as previously described, as rod 202 moves axially downward toward lower end 153*b*, lower section 153 is drawn axially upward toward middle section until connectors 160, 170 meet and engage in the manner described above. Thereafter, continued axial movement of rod 202 toward lower end 153*b* causes the now engaged lower section 153 and middle section 152 to be drawn axially upward toward upper section 151 until connectors 170, 161 meet an engage in the manner described above. Thereafter, pins 185 may be placed within the aligned bores 171, 177 and sliding members 186 on locking assemblies 180 may be transitioned to the locked positions (e.g., FIG. 6B) on the now engaged connectors 160, 170 between sections 152, 153, respectively, and on the now engaged connectors 161, 170 between sections 151, 152, respectively. As a result, sections 151, 152, 153 are secured to one another to form a continuous rigid guide beam 150 as shown in FIG. 8B. During these operations, it should be appreciated that sections 151, 152, 153 of guide beam 150 may be linked together via chains 192*a*, 192*b*, and tensioning members 194*a*, 194*b* prior to suspending sections 151, 152, 153 from line 49 in the extended position. However, it should also be appreciated that sections 151, 152, 153 may also be individually linked to one another via chains 192*a*, 192*b* and tensioning members 194*a*, 194*b* as each section 151, 152, 153 is lifted and suspended from line 49. Any and all connection methods and procedures are possible and contemplated herein for sections 151, 152, 153 of guide beam 15.

Referring again to FIGS. 1 and 2, as previously described, power swivel 50 is pivotally secured to guide beam 150 via dolly assembly 210. Dolly assembly 210 generally includes a body 212 that rotatably supports a plurality of rollers (not shown in FIGS. 1 and 2) that engage with radially outer surface 150*c* of guide beam 150 during operations such that body 212 is allowed to freely traverse axially along guide beam 150, between ends 150*a*, 150*b* with respect to axis 155. Body 212 is also coupled to power swivel 50 such that power swivel 50 is configured to traverse axially along guide beam 150 along with body 212 during operations. Specifically, as will be described in more detail below in this embodiment, body 212 pivotally receives one of the connector posts 58*b* therethrough so that power swivel 50 may pivot about axis 55 relative to body 212, guide beam 150, and mast 12.

Referring now to FIGS. 9-13, in this embodiment body 212 of dolly assembly 210 includes a first or inner housing plate 220, a second or outer housing plate 230, and a spacer member 215. Spacer member 215 is secured to one of the arms 56 of bail 54, inner housing plate 220 is disposed axially between spacer member 215 and guide beam 150 along axis 55, and outer housing plate 230 is disposed axially adjacent guide beam 150 such that guide beam 150 is axially disposed between housing plates 220, 230 with respect to axis 55.

Figure 12:
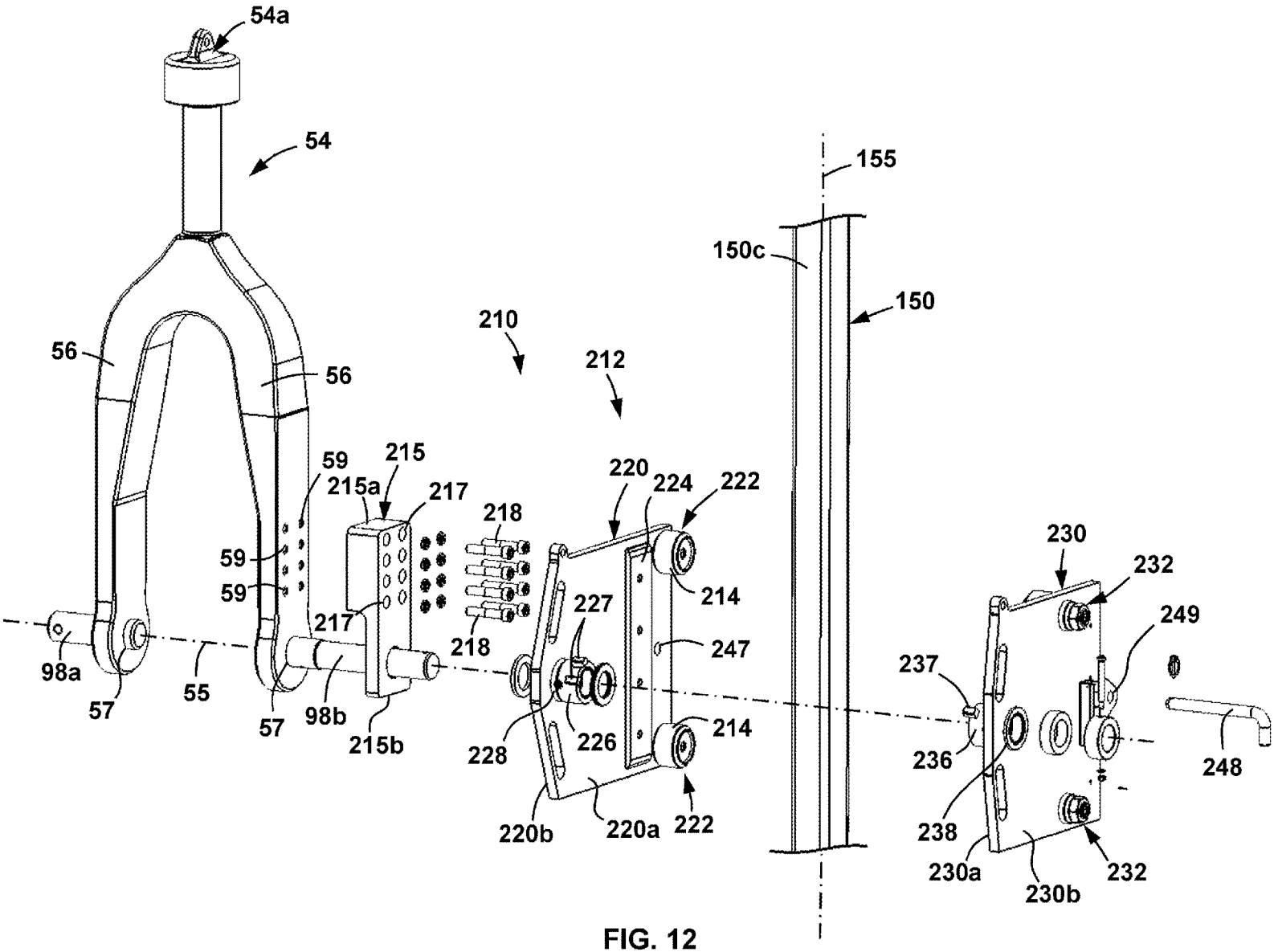
FIG. 12 is an exploded view of the dolly assembly of the system of FIG. 1.
Figure 13:
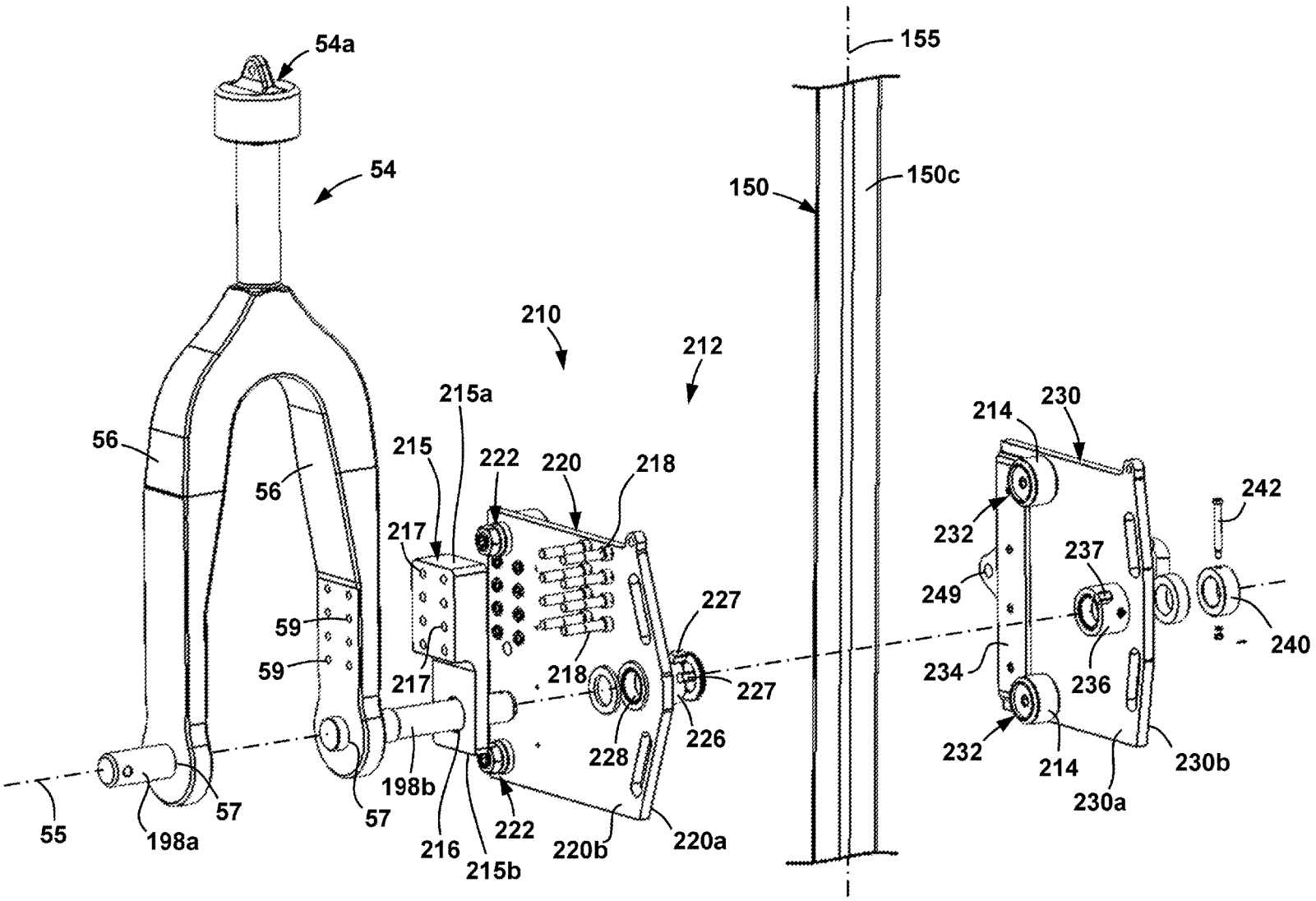
FIG. 13 is another exploded view of the dolly assembly of the system of FIG. 1.

Referring specifically to FIGS. 12 and 13, spacer member 215 includes a first or upper end 215*a*, and a second or lower end 215*b* opposite upper end 215*a*. A first or lower aperture 216 extends through spacer member 215 proximate lower end 215*b* that slidably receives connector post 58*b* therethrough. The inner diameter of lower aperture 216 is sufficiently larger than the outer diameter of post 58*b* such that post 58*b* may freely pivot about axis 55 within and relative to aperture 216. In addition, spacer member 215 includes a plurality of mounting apertures 217 extending therethrough proximate upper end 215*a*. Each of the mounting apertures 217 aligns with a corresponding one of a plurality of corresponding mounting apertures 59 extending through one of the arms 56. To secure spacer member 215 to the corresponding arm 56 of bail 54, a plurality of coupling members 218 are each inserted through one of the aligned apertures 218, 59 in spacer member 215 and arm 56, respectively. Coupling members 218 may comprise any suitable coupling member for joining and securing two adjacent components to one another, and in some embodiment may comprise, for example, bolts, screws, nails, rivets, etc.

Inner housing plate 220 includes a first or interior side 220*a* and a second or exterior side 220*b*. Side 220*a* is referred to herein as an "interior side" because it faces toward guide beam 150 along axis 55 and side 220*b* is referred to herein as an "exterior side" because it faces away from guide beam 150 along axis 55. Inner housing plate 220 also includes an aperture 228 extending between sides 220*a*, 220*b* that receives connector post 58*b* of power swivel 50 therethrough during operations. A spacer collar 226 is mounted to interior side 220*a* of housing plate 220 about aperture 228. As with aperture 216 on spacer member 215, aperture 228 and spacer collar 226 each include an inner diameter that is sufficiently larger than the outer diameter of connector post 58*b* such that post 58*b* may pivot about axis 55 within and relative to aperture 228 and collar 226 during operations. Spacer collar 226 also includes a pair of rotation limiters 227 that are angularly spaced from one another about axis 55 along collar 226. As will be described in more detail below, rotation limiters 227 interlock with a similar rotation limiter 237 on a corresponding spacer collar on outer plate 230 (e.g., collar 236) to limit relative rotation of housing plates 220, 230 about axis 55 during operations. In addition, inner housing plate 220 includes an engagement member 224 that is secured to and extends along interior side 220*a*. As will be described in more detail below, engagement member 224 slidingly engages radially outer surface 150*c* of guide beam 150 during operations.

Figure 11:
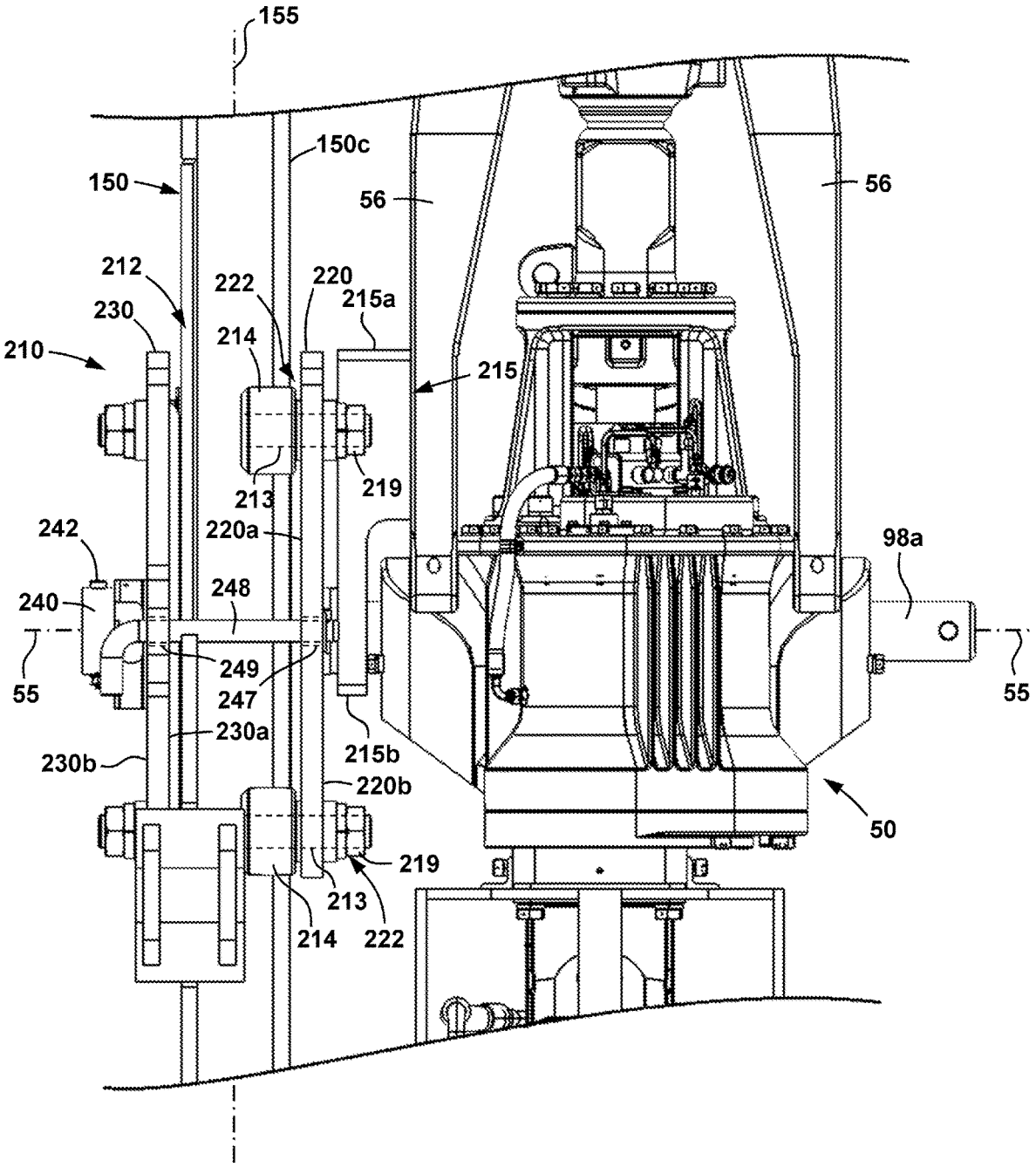
FIG. 11 is a rear view of the power swivel, dolly assembly, and guide beam of the system of FIG. 1.

Referring still to FIGS. 12 and 13, inner housing plate 220 also includes a plurality of roller assemblies 222 coupled thereto. Referring briefly to FIG. 11, each roller assembly 222 includes a roller 214 rotatably disposed on one end of a central shaft 213 that extends between sides 220*a*, 220*b* of plate 220. A coupling member 219, which in this embodiment comprises a threaded bolt, is threadably secured to the opposite end of shaft 213 (i.e., the side opposite to the roller 214) to thereby secure roller assembly 222 to inner plate 220. In this embodiment, roller 214 is disposed along or proximate the interior side 220*a* of plate 220 while coupling member 219 is disposed along exterior side 220*b*. Referring back now to FIGS. 12 and 13, in this embodiment, plate 220 includes a total of two (2) roller assemblies 222; however, the number and arrangement of roller assemblies 222 may be greatly varied in other embodiments.

Outer housing plate 230 includes a first or interior side 230*a* and second or exterior side 230*b*. As explained above for inner housing plate 220, side 230*a* is referred to herein as an "interior side" because it faces toward guide beam 150 along axis 55 and side 230*b* is referred to herein as an "exterior side" because it faces away from guide beam 150 along axis 55. Inner housing plate 230 also includes an aperture 238 extending between sides 230*a*, 230*b* that receives connector post 58*b* therethrough during operations. A spacer collar 236 is mounted to interior side 230*a* of housing plate 230 about aperture 238. As with aperture 216 on spacer member 215 and aperture 228 in inner housing plate 220, aperture 238 and spacer collar 236 each include an inner diameter that is sufficiently larger than the outer diameter of connector post 58*b* such that post 58*b* may pivot freely about axis 55 within and relative to aperture 238 and collar 236 during operations. Spacer collar 236 also includes a rotation limiter 237 that is configured to interlock with rotation limiters 227 on spacer collar 226 to limit relative rotation between plates 220, 230 as previously mentioned above and as will be described in more detail below. In addition, outer housing plate 230 includes an engagement member 234 that is secured to and extends along interior side 220*a*. As will be described in more detail below, engagement member 224 slidingly engages radially outer surface 150*c* of guide beam 150 during operations.

Figure 10:
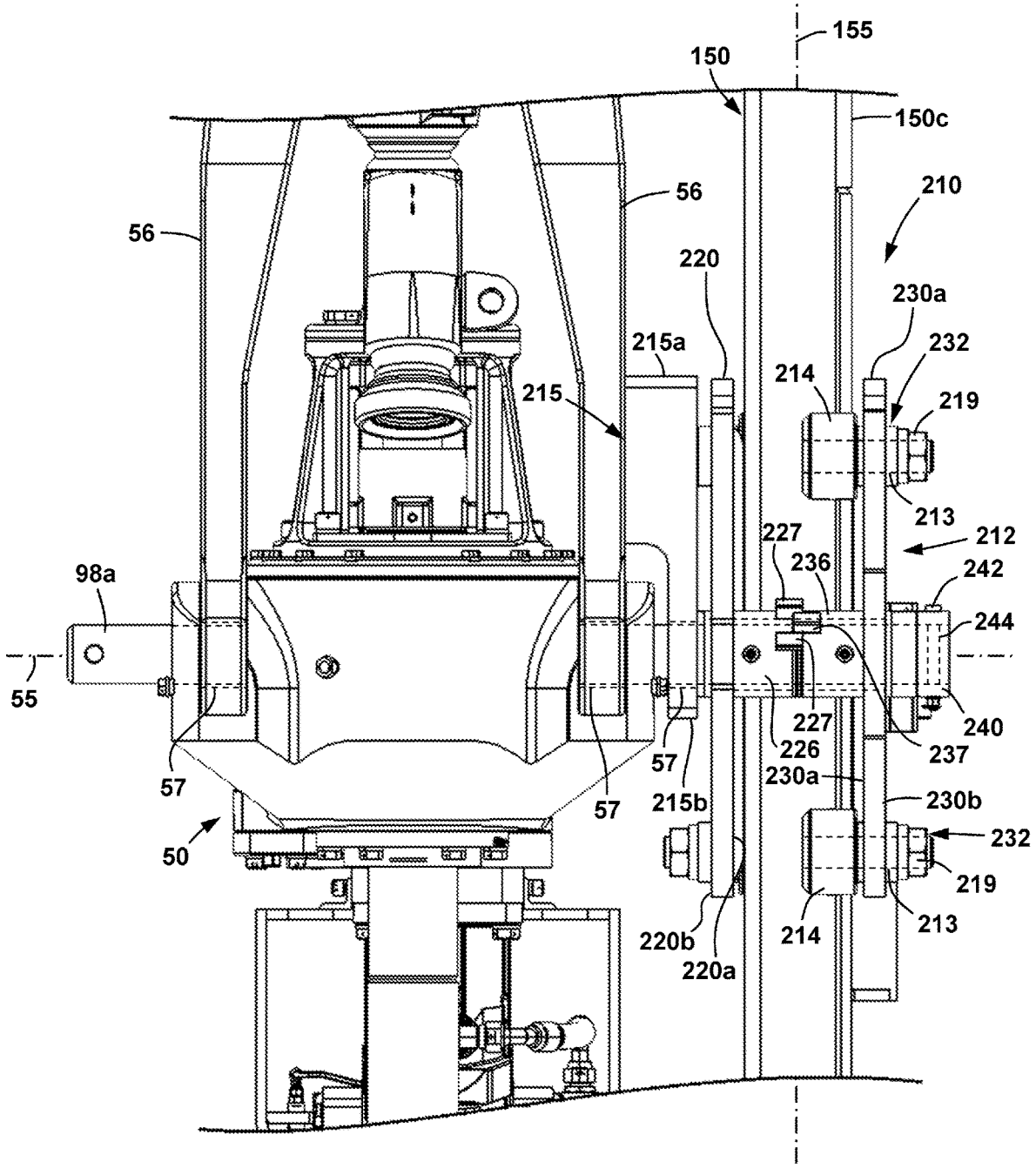
FIG. 10 is a front view of the power swivel, dolly assembly, and guide beam of the system of FIG. 1.

Referring still to FIGS. 12 and 13, outer housing plate 230 also includes a plurality of roller assemblies 232 coupled thereto. Referring briefly to FIG. 10, each roller assembly 232 includes a roller 214 rotatably disposed on a central shaft 213 in substantially the same manner as previously described for roller assemblies 222. In addition, as is also described above for roller assemblies 222, a coupling member 219 is threadably secured to shaft 213 to secure roller assembly 232 to outer plate 230. In this embodiment, roller 214 is disposed along or proximate the interior side 230*a* of plate 230 while coupling member 219 is disposed along exterior side 230*b*. Referring back now to FIGS. 12 and 13, in this embodiment, plate 230 includes a total of two (2) roller assemblies 232; however, the number and arrangement of roller assemblies 232 may be greatly varied in other embodiments.

Referring again to FIGS. 9-13, during construction of dolly assembly 210, spacer member 215 is mounted to one of the arms 56 with coupling members 218 such that connector post 58*b* extends through aperture 216 as previously described. Thereafter, inner housing plate 220 is installed by inserting connector post 58*b* through aperture 228 and spacer collar 226. Next, guide beam 150 is maneuvered toward interior side 220*a* of inner plate 220 such that radially outer surface 150*c* engages with each of the engagement member 224 and rollers 214 on roller assemblies 222. Outer housing plate 230 is then installed by inserting connector post 58*b* through aperture 238 and spacer collar 236 and then advancing plate 230 axially along axis 55 toward guide beam 150 and inner housing plate 220 until each of the engagement member 234 and rollers 214 on roller assemblies 232 engage with radially outer surface 150*c*. During this process, spacer collars 226, 236 engage with one another such that rotation limiter 237 on collar 236 is received between rotation limiters 227 on collar 226. Thus, relative rotation of housing plates 220, 230 is limited, among other things, by the engagement of rotation limiter 237 on collar 236 with one of the rotation limiters 227 on collar 226. In addition, as best shown in FIGS. 11 and 12, plates 220, 230 are the secured to one another by inserting a locking bar 248 through both an aperture 247 in inner plate 220 and an aligned aperture 249 in outer plate 230.

To prevent excessive axial movement of connector post 58*b* along axis 55 within apertures 216, 228, 238, a locking collar 240 is inserted onto a radially outermost end of connector post 58*b*. Thereafter a locking pin 242 is inserted radially (with respect to axis 55) through a locking hole in collar 240 and an aligned locking hole 244 extending through connector post 58*b* (see FIG. 10). Thus, connector post 58*b* (and thereby also power swivel 50) is free to rotate about axis 55 relative to plates 220, 230, and guide beam 150, but is prevented from axially withdrawing from plates 220, 230 during operations. In addition, vertical movement of power swivel 50 is facilitated along guide beam 150 by engagement of rollers 214 on assemblies 222, 232 and radially outer surface 150*c* of guide beam 150 and by sliding engagement of engagement members 224, 234 and radially outer surface 150*c*.

Figure 14:
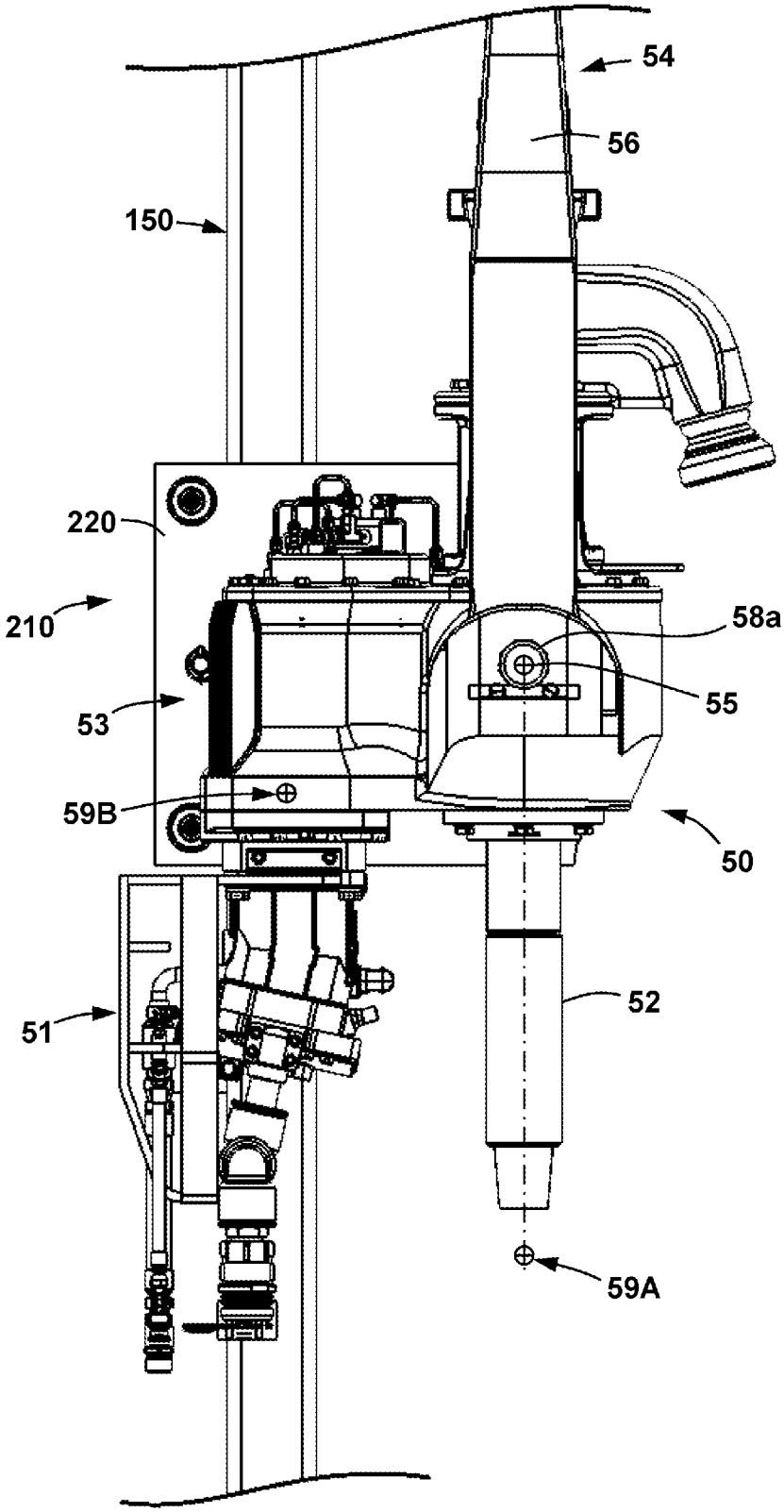
FIG. 14 is a side view of the power swivel pivotally coupled to the guide beam of the guide system of FIG. 1, that schematically shows the positions of the center of gravity for the power swivel and drillstring during operations.

Referring now to FIG. 14, as previously described, due to the pivotal connection between post 58*b* and dolly assembly 210, and the pivotal connections between posts 58*a*, 58*b* and arms 56 of bail 54, during operations, power swivel 50 is free to pivot relative to axis 55 relative to bail 54, dolly assembly 210, guide beam 150, and mast 12. Specifically, as shown in FIG. 14, in at least some embodiments, power swivel 50 includes a motor 51 and a gear box 53 that are both radially offset from axis 55. When a drillstring 30 (or a section of drill pipe) is coupled to stem 52, the weight of the coupled drillstring 30 (or drill pipe section) causes the center of gravity of the coupled swivel 50 and drillstring 30 to shift toward a first position 59A that is disposed along or near the aligned axes 35, 52*a* of drillstring 30 and stem 52, respectively (note: axis 35 and drillstring 30 are not shown in FIG. 14 so as not to unduly complicate the figure). Thus, when drillstring 30 (or a section of drill pipe) is coupled to stem 52, the power swivel 50 pivots about axis 55 to place the stem 52 and drillstring 30 vertically below axis 55 such that axis 52*a* of stem 52 is generally oriented vertically (i.e., the orientation shown in FIG. 14). However, when no drillstring 30 (or drill pipe section) is coupled to stem 52 the weight and arrangement of motor 51 and gear box 53 cause the center of gravity of power swivel 50 to shift horizontally away from axis 55 and toward a second position 59B proximate the motor 51 and gear box 53. Thus, when no drillstring 30 (or section of drill pipe) is coupled to stem 52, power swivel 50 pivots about axis 55 to place motor 51 and gear box 53 generally vertically below axis 55 such that axis 52*a* of stem 52 is generally oriented horizontally or near horizontally (e.g., within 45° from horizontal. In some embodiments, post 58*b* and power swivel 50 may pivot as much as 45° about axis 55 relative to dolly assembly 210 and guide beam 150. It should also be appreciated that in at least some embodiments, axis 52*a* of stem 52 is prevented from being oriented above the horizontal plane or direction, and thus, rotation of power swivel 50 is limited to maintain the axis 52*a* of stem 52 below (i.e., toward the ground) the horizontal direction during operations. Specifically, in some embodiments, rotation of power swivel 50 is limited to maintain axis 52*a* of stem 52 between 0° of horizontal and 45° beneath horizontal, and preferably between 5° below horizontal and 20° below horizontal.

Referring again to FIG. 2, torque transfer assembly 110 couples guide beam 150 to mast 12 such that reaction forces experienced by power swivel 50 during drilling operations are transferred into mast 12. In this embodiment, torque transfer assembly 110 comprises a mast tie-back member 120, a torque post 130, and a connecting member 140.

Figure 15:
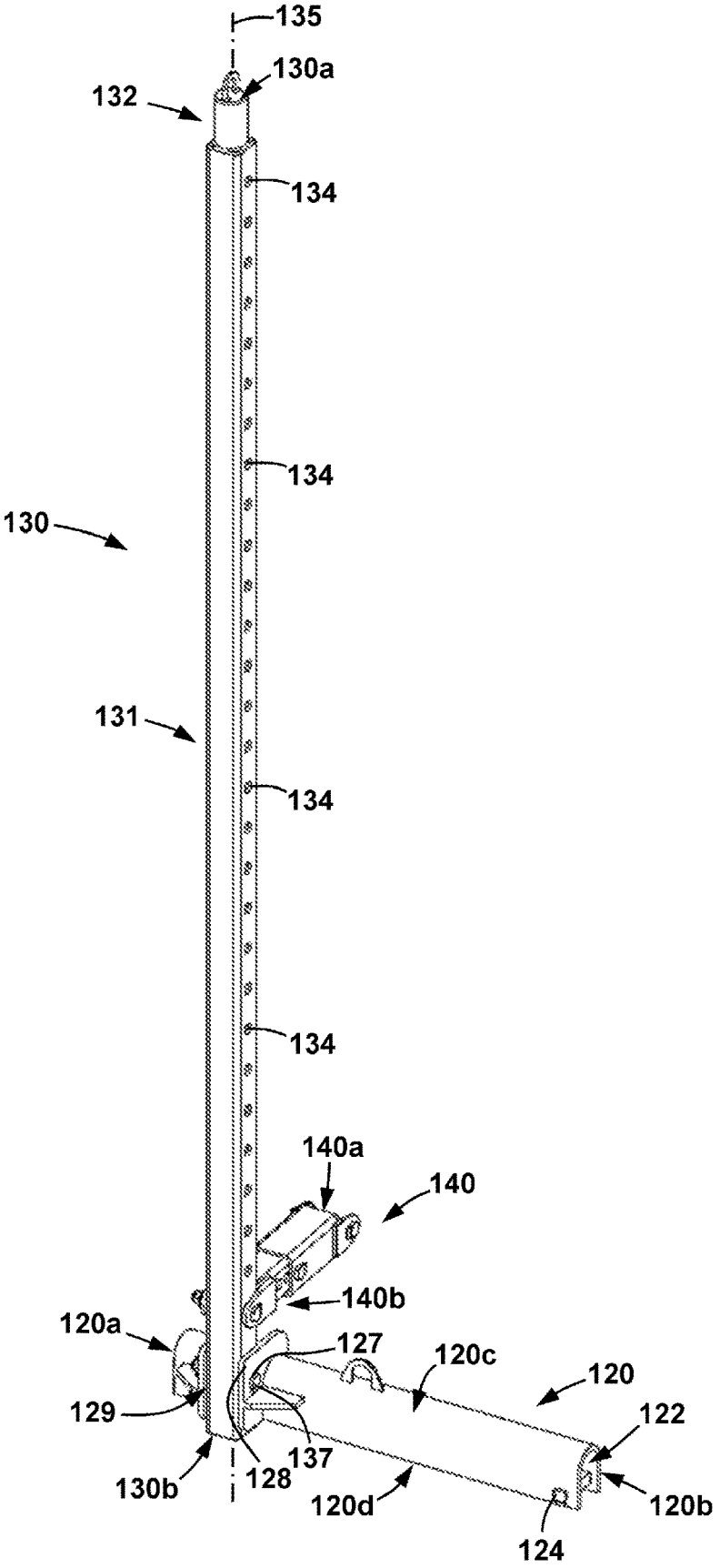
FIG. 15 is a perspective view of the torque transfer assembly of the system of FIG. 1.
Figure 16:
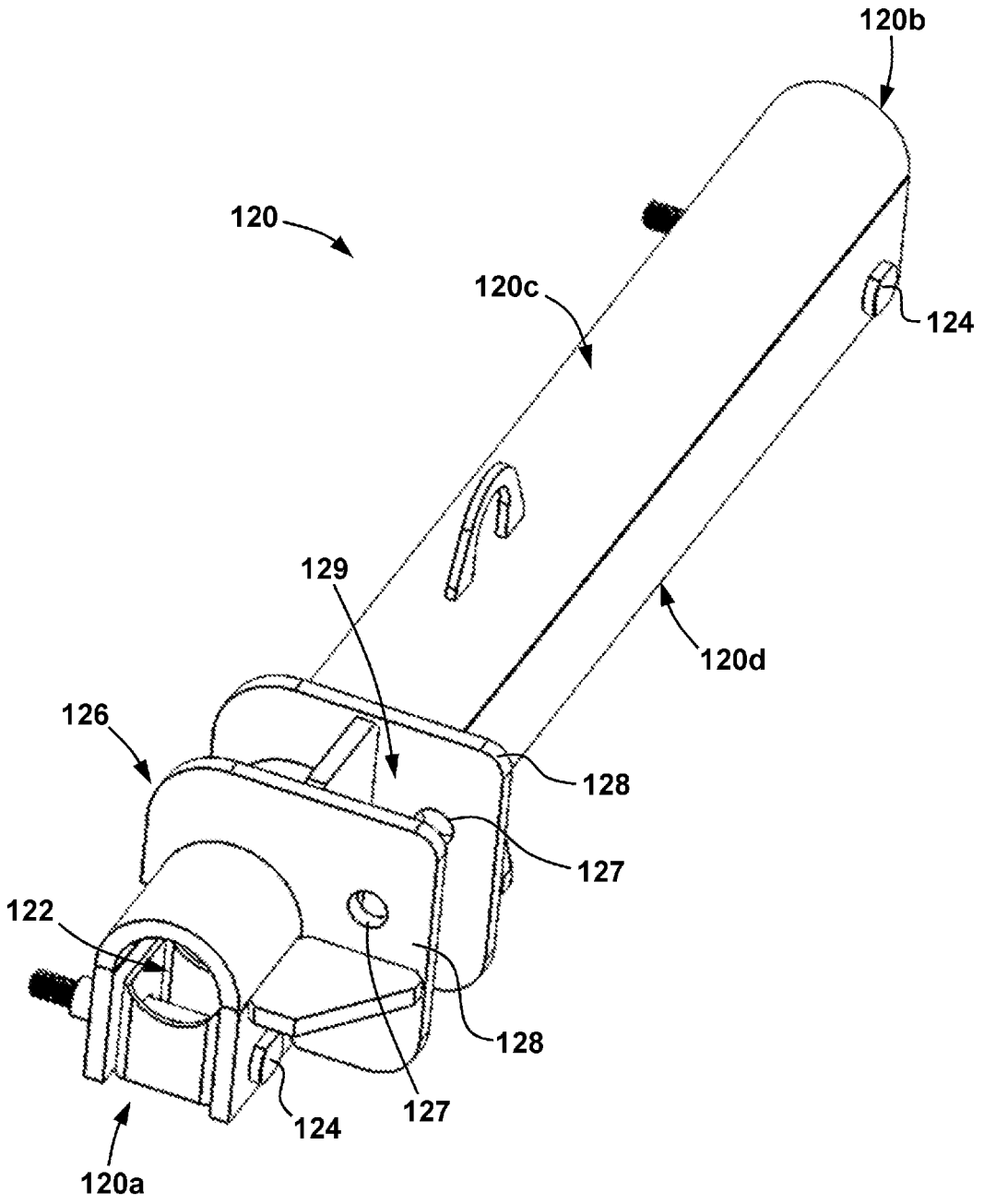
FIG. 16 is a perspective view of the mast tie-back member of the torque transfer assembly of FIG. 15.

Referring now to FIGS. 15 and 16, mast tie-back member 120 is a horizontally oriented member that is coupled to one of the horizontal support members 11 of mast 12 during operations. Specifically, as best shown in FIG. 16, mast tie-back member 120 is an elongate member that includes a first end 120*a*, a second end 120*b* opposite first end 120*a*, an upper closed side 120*c* extending between ends 120*a*, 120*b*, and a lower open side 120*d* also extending between ends 120*a*, 120*b*. Together, closed side 120*c* and open side 120*d* form a recess 122 extending between ends 120*a*, 120*b*. In this embodiment, upper closed side 120*c* is curved in shape such that mast tie-back member 120 is substantially "U" shaped in cross-section with the upper closed end 120*c* forming the bottom of the "U"; however, other shapes are possible. A pair of locking pins 124 extend through tie-back member 120, with a first locking pin 124 extending through member 120 proximate first end 120*a*, and a second locking pin 124 extending through member 120 proximate second end 120*b*. In addition, tie-back member 120 also includes a mounting bracket 126 proximate first end 120*a* that includes a pair of plates 128 forming a recess 129 therebetween. Each plate 128 includes an aperture 127 extending therethrough. As will be described in more detail below, during construction of torque transfer assembly 110, torque post 130 is received within recess 129 and a pin (e.g., pin 137 shown in FIGS. 15 and 17) is inserted through the apertures 127 and an aligned aperture in torque post 130 (e.g., aperture 136 shown in FIG. 18) to thereby secure post 130 to mast tie-back member 120.

Figure 17:
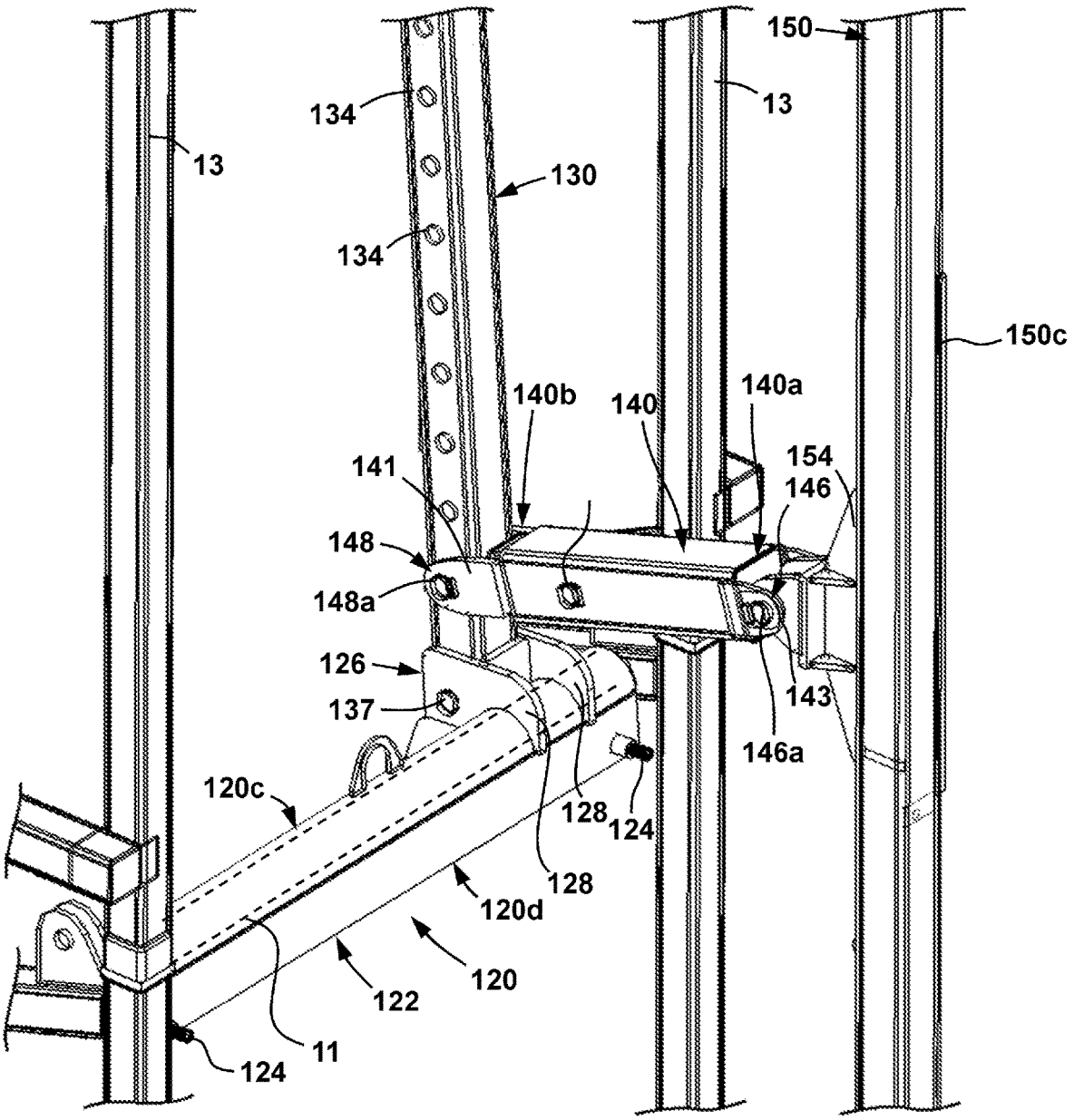
FIG. 17 is a perspective view of the torque transfer assembly of FIG. 15 installed on the mast of the system of FIG. 1.

Referring now to FIG. 17, mast tie-back member 120 is installed onto one of the horizontal support members 11 of mast 12 by first removing pins 124 and inserting horizontal support member 11 into the recess 122 from the open lower end 120*d*. Thereafter, pins 124 are reinserted through member 120 to secure members 120, 11 to one another.

Figure 18:
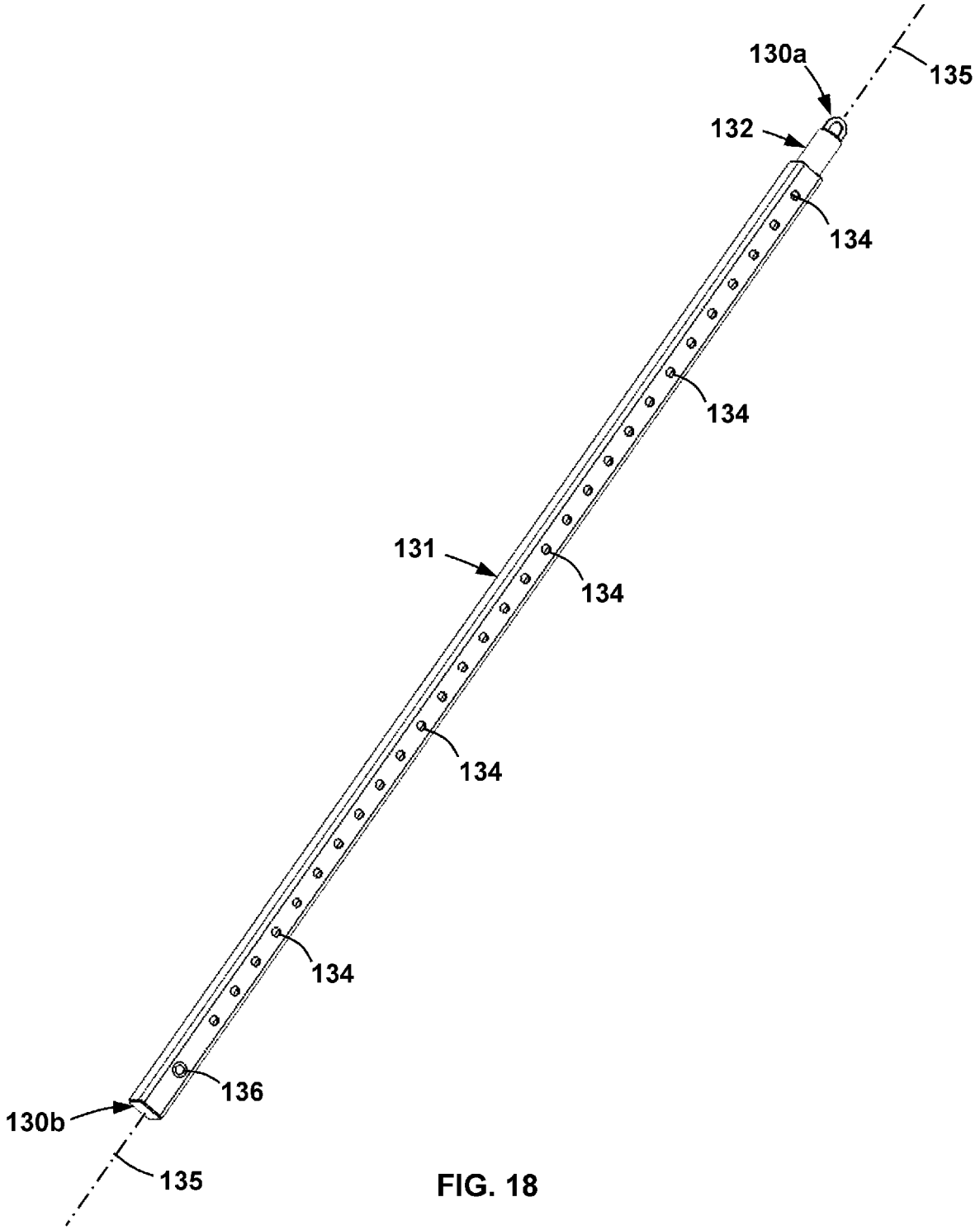
FIG. 18 is a perspective view of the torque post of the torque transfer assembly of FIG. 15.

Referring again to FIGS. 15, 17, and 18, torque post 130 is an elongate member that includes a central, longitudinal axis 135, a first or upper end 130*a*, and a second or lower end 130*b* opposite upper end 130*a*. Torque post 130 also includes a rectangular section 131 extending axially from lower end 130*b* and a cylindrical section 132 extending axially between rectangular section 131 and upper end 130*a*. Rectangular section 131 is rectangular in cross-section and includes a plurality of axially spaced apertures 134 extending radially through section 131 with respect to axis 135. In addition, as best shown in FIG. 18, torque post 130 also includes a mounting aperture 136 positioned axially between the apertures 134 and lower end 130*b*. As best shown in FIGS. 15 and 17, lower end 130*b* is received with recess 129 between plates 128 on mast tie-back member 120. Thereafter, a coupling pin 137 is inserted through the aligned apertures 129 in plates and through the mounting aperture 136 in torque post 130 thereby securing torque post to mast tie-back member 120.

Figure 19:
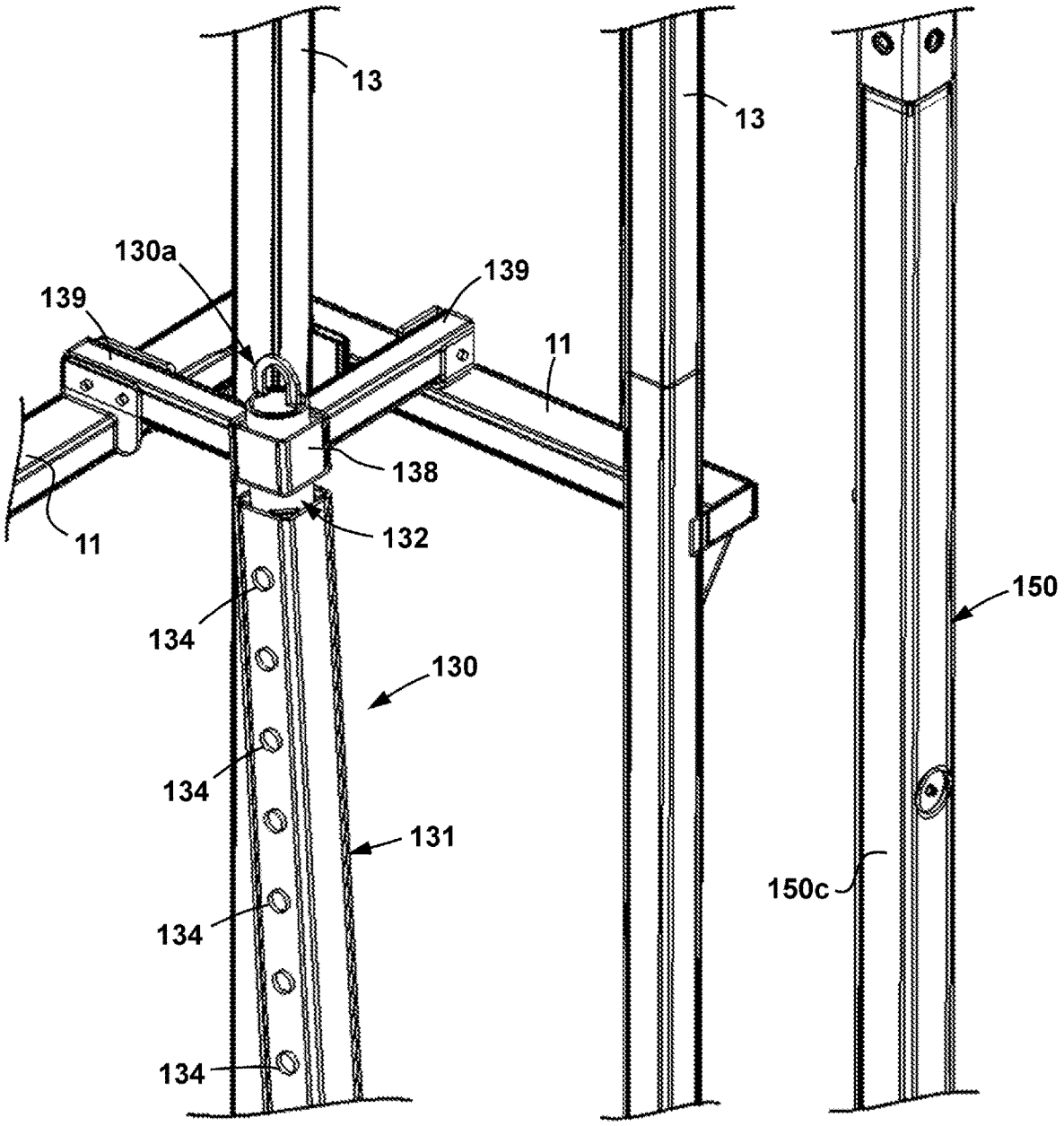
FIG. 19 is a perspective view of the upper end of the torque post of FIG. 18 coupled to the mast of the system of FIG. 1.

Referring now to FIG. 19, cylindrical section 132 at upper end 130*a* of torque post 130 is received through a mounting collar 138 secured to mast 12 with one or more support members 139. Specifically, in this embodiment, mounting collar 138 is secured to a pair of the horizontal support members 11 with support members 139. Also, in this embodiment, collar 138 is sized such that cylindrical section 132 may be loosely inserted therein. In other words, there is sufficient clearance between cylindrical section 132 and collar 138 such that cylindrical section 132 may freely move within collar 138 after being inserted therein. In some embodiments, the clearance between cylindrical section 132 and collar 138 may be about ¼ of an inch in the radial direction with respect to axis 135. Thus, during operations, torque that is transferred to torque post 130 is not transferred to mast 12 through collar 138 and support members 139 (such that all such torque is transferred to mast 12 via mast tie-back member 120). While collar 138 is shown as a rectangular member, it should be appreciated that in other embodiments, collar 138 may be cylindrical in shape. In these embodiments, to ensure that cylindrical section 132 is loosely fit inside of collar 138 to avoid the transfer of torque as described above, the inner diameter of collar 138 is set sufficiently higher than the outer diameter of cylindrical section 132. For example, in some embodiments, the inner diameter of collar 138 is ¼ of an inch larger than the outer diameter of cylindrical section 132. Also, it should be appreciated that sections 131, 132 may be differently shaped in other embodiments (e.g., rectangular section 131 may be cylindrical and cylindrical section 132 may be rectangular).

Figure 20:
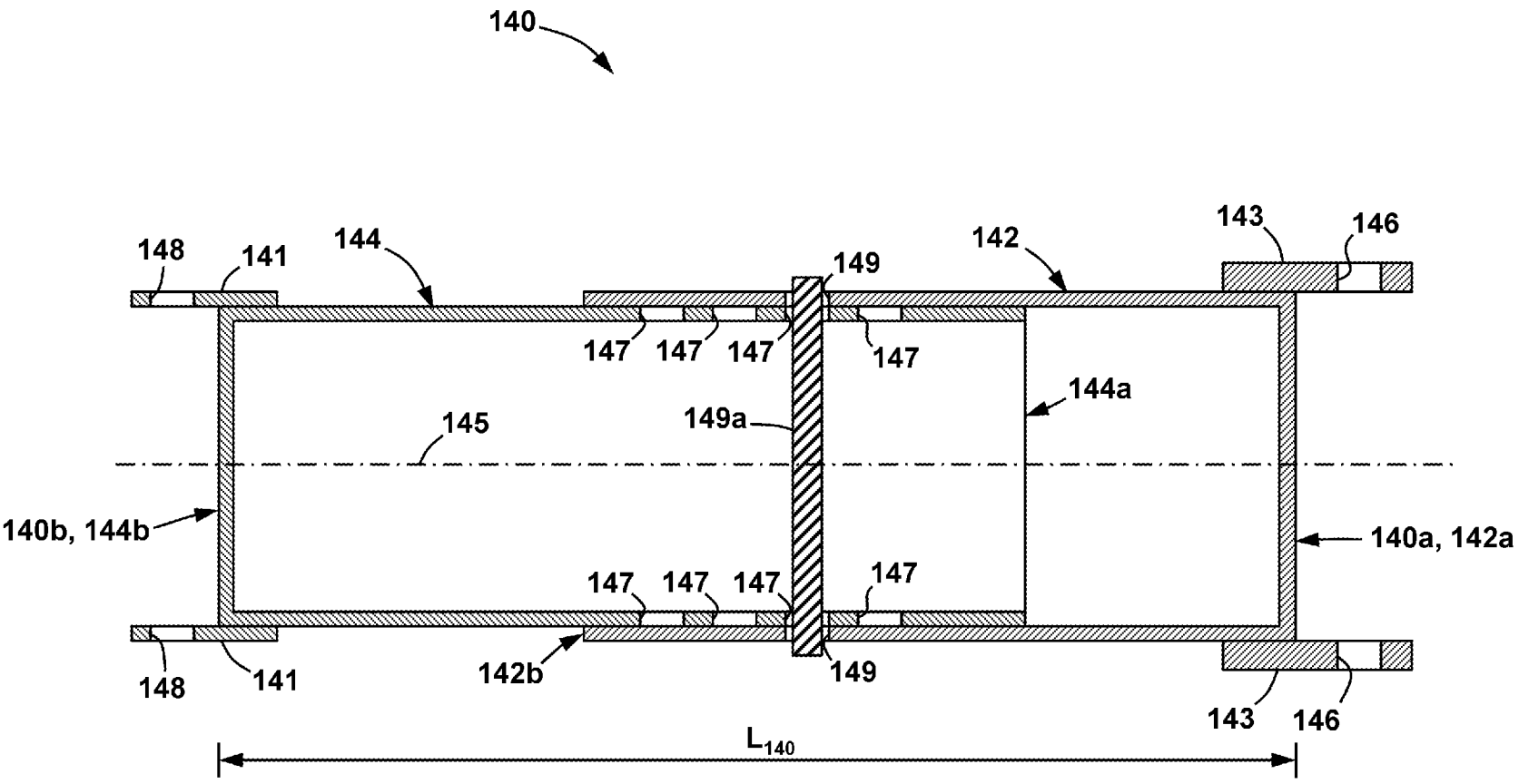
FIG. 20 is a cross-sectional view of the connecting member of the torque transfer assembly of FIG. 15.

Referring now to FIGS. 15, 17, and 20, connecting member 140 is an elongate member that includes a central or longitudinal axis 145, a first end 140*a*, and a second end 140*b* opposite the first end 140*a*. As is best shown in FIG. 20, connecting member 140 includes an axial length $L_{140}$ extending axially between ends 140*a*, 140*b* along axis 145.

In addition, as is also best shown in FIG. 20, connecting member 140 includes a first or inner member 144 that is telescopically received with an a second or outer member 142 along axis 145. Inner member 144 includes a first end 144*a* and a second end 144*b* that is opposite first end 144*a* and coincident with second end 140*b* of connecting member 140. A pair of mounting plates 141 is mounted to inner member 144 at second end 144*b*. Each mounting plate 141 includes an aperture 148 extending therethrough. Also, inner member 144 includes a plurality of axially spaced apertures 147 that are proximate first end 144*a*. Further, as shown in FIG. 20, each aperture 147 is radially aligned with another of the apertures 147 on an opposite side of inner member 144.

Outer member 142 includes a first end 142*a* that is coincident with the first end 140*a* of connecting member 140, and a second end 142*b* opposite first end 142*a*. A pair of mounting plates 143 is mounted to the outer member 142 at first end 142*a*. Each mounting plate 143 includes an aperture 146 extending therethrough. Also, outer member 142 includes a pair of radially aligned mounting aperture 149 extending therethrough axially between ends 142*a*, 142*b*.

Inner member 144 is inserted axially within outer member 142 such that a pair of the apertures 147 extending through inner member 144 are axially aligned with the pair of apertures 149 on outer member 142. Thereafter, a pin 149*a* may be inserted through the aligned apertures 147, 149 to thereby fix and secure outer member 142 to inner member 144, and form connecting member 140. As a result, the axial length $L_{140}$ of connecting member 140 may be adjusted by aligning the apertures 149 in outer member 142 with another pair of the apertures 147 in inner member 144 and inserting pin 149*a* radially therethrough.

Referring now to FIGS. 15 and 17, first end 140*a* of connecting member 140 is coupled guide beam 150. Specifically, the apertures 146 in the mounting plates 143 at the first end 140*a* of connecting member 140 are aligned with corresponding apertures in the mounting bracket 154 of guide beam 150. Thereafter a pin 146*a* is inserted through the aligned apertures in plates 143 and bracket 154 to fix first end 140*a* to guide beam 150. Also, second end 140*b* of connecting member 140 is coupled to torque post 130. Specifically, the apertures 148 in plates 141 at second end 140*b* of connecting member 140 are aligned with one of the apertures 134 extending through torque post 130. Thereafter a pin 148*a* is inserted through the aligned apertures 148, 134 to fix second end 140*b* to torque post 130.

Figure 21:
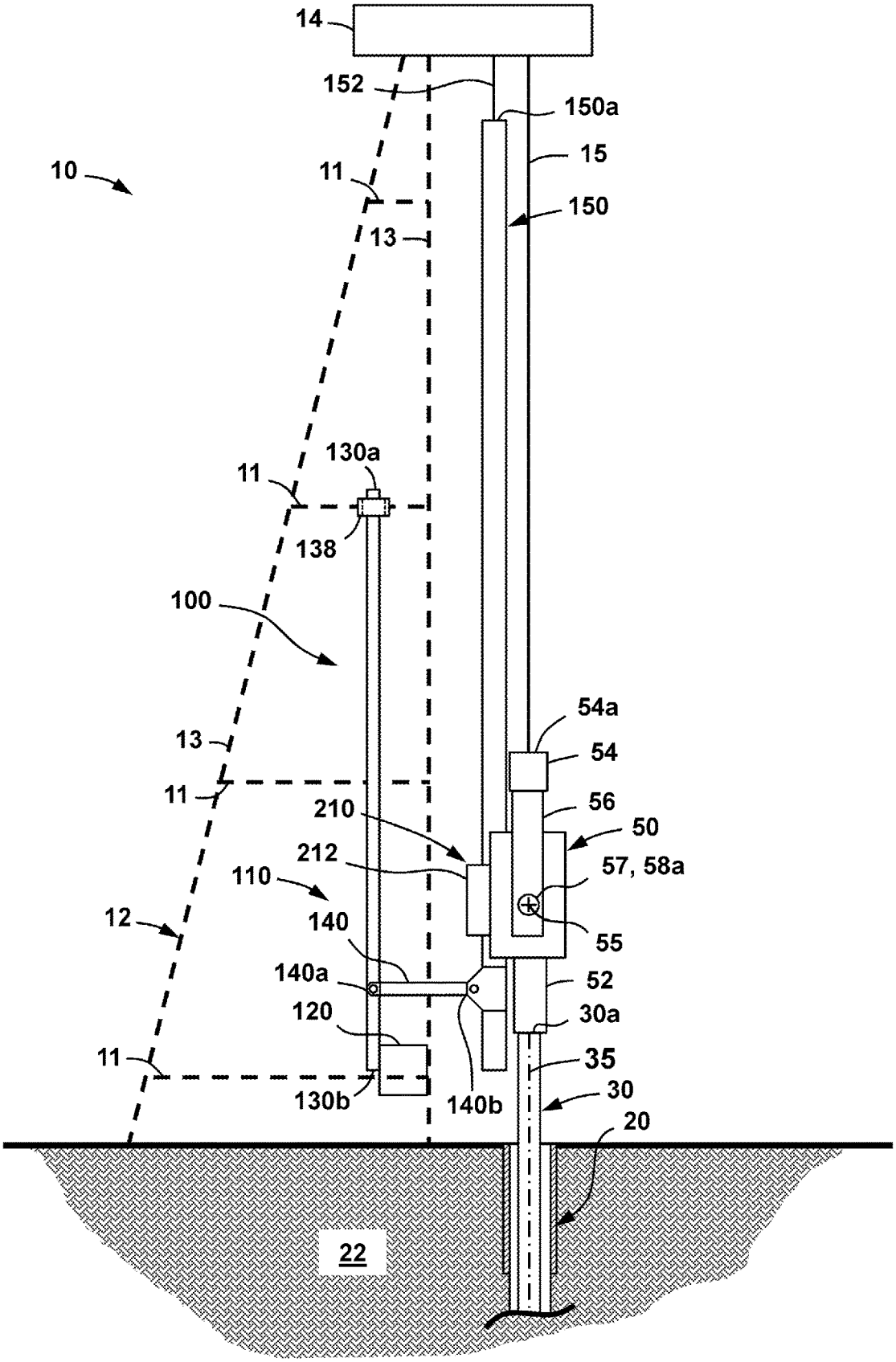
FIGS. 21-23 are schematic side views of the system of FIG. 1 during a drilling operation.

Referring now to FIGS. 1, 2, and 21, during drilling operations, stem 52 of power swivel 50 is coupled to upper end 30*a* of drillstring 30 as previously described. For example, in some embodiments, stem 52 is threadably coupled to upper end 30*a*. In addition, a drill bit 32 (see FIG. 1) is coupled to a lower end 30*b* of drillstring 30 and the lower end 30*b* and drill bit 32 are lowered into wellbore 20 until drill bit 32 is placed in contact with the with the subterranean formation 22. Thereafter, power swivel 50 is operated to rotate stem 52, drillstring 30, and drill bit 32 about axes 52*a*, 35 such that drill bit 32 engages with formation 22 and lengthens borehole 20.

As best shown in FIG. 21, as borehole 20 lengthens, upper end 30*a* of drillstring 30 and thus power swivel 50 progressively moves vertically downward or toward borehole 20. The vertical travel of power swivel 50 is guided by guide system 100. Specifically, rollers 214 in roller assemblies 222, 232 (see FIGS. 10 and 11) mounted on housing plates 220, 230, respectively, of dolly assembly 210 engage with radially outer surface 150*c* of guide beam 150 to guide power swivel 50 downward along axis 155.

Figure 22:
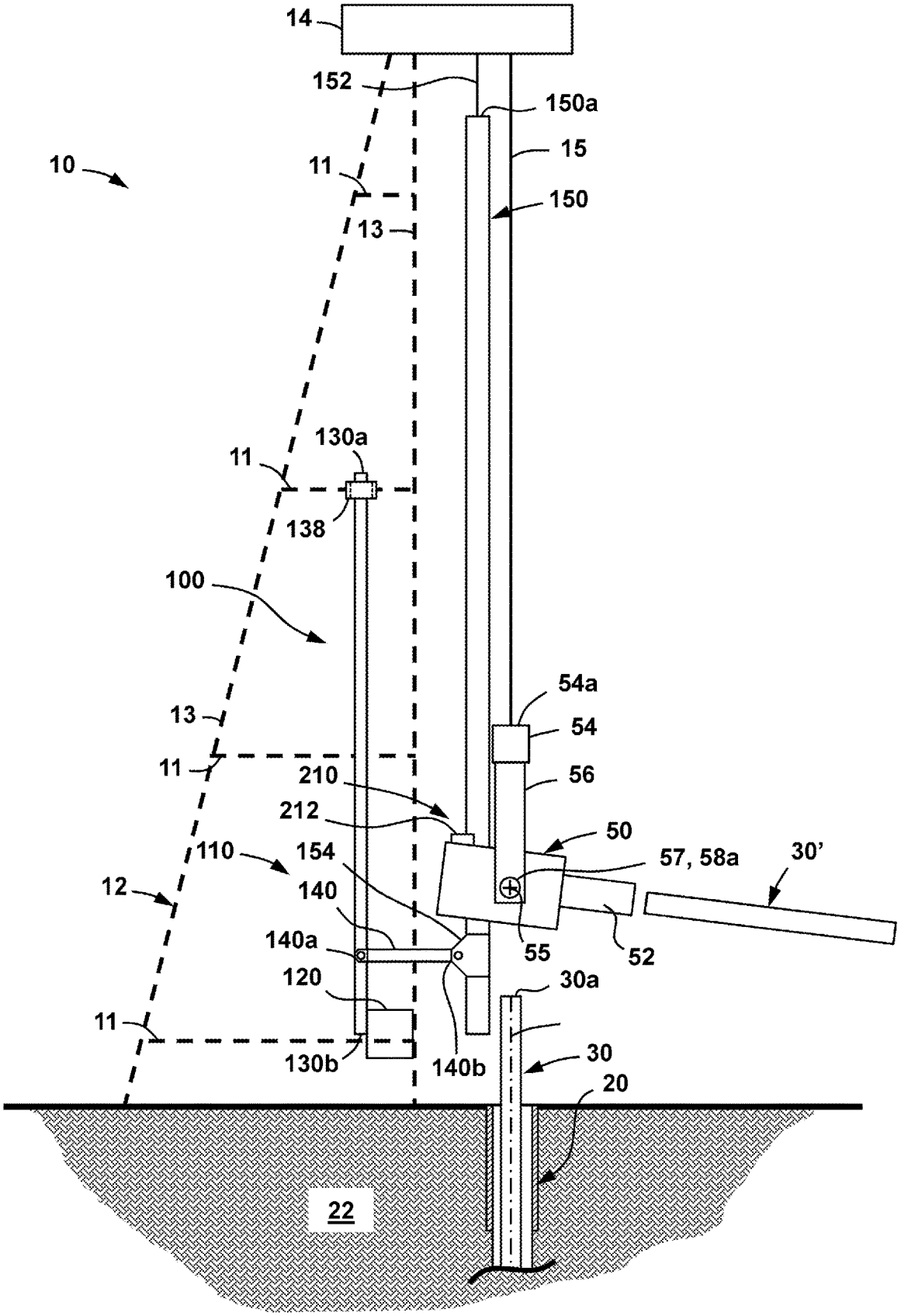
Figure 23:
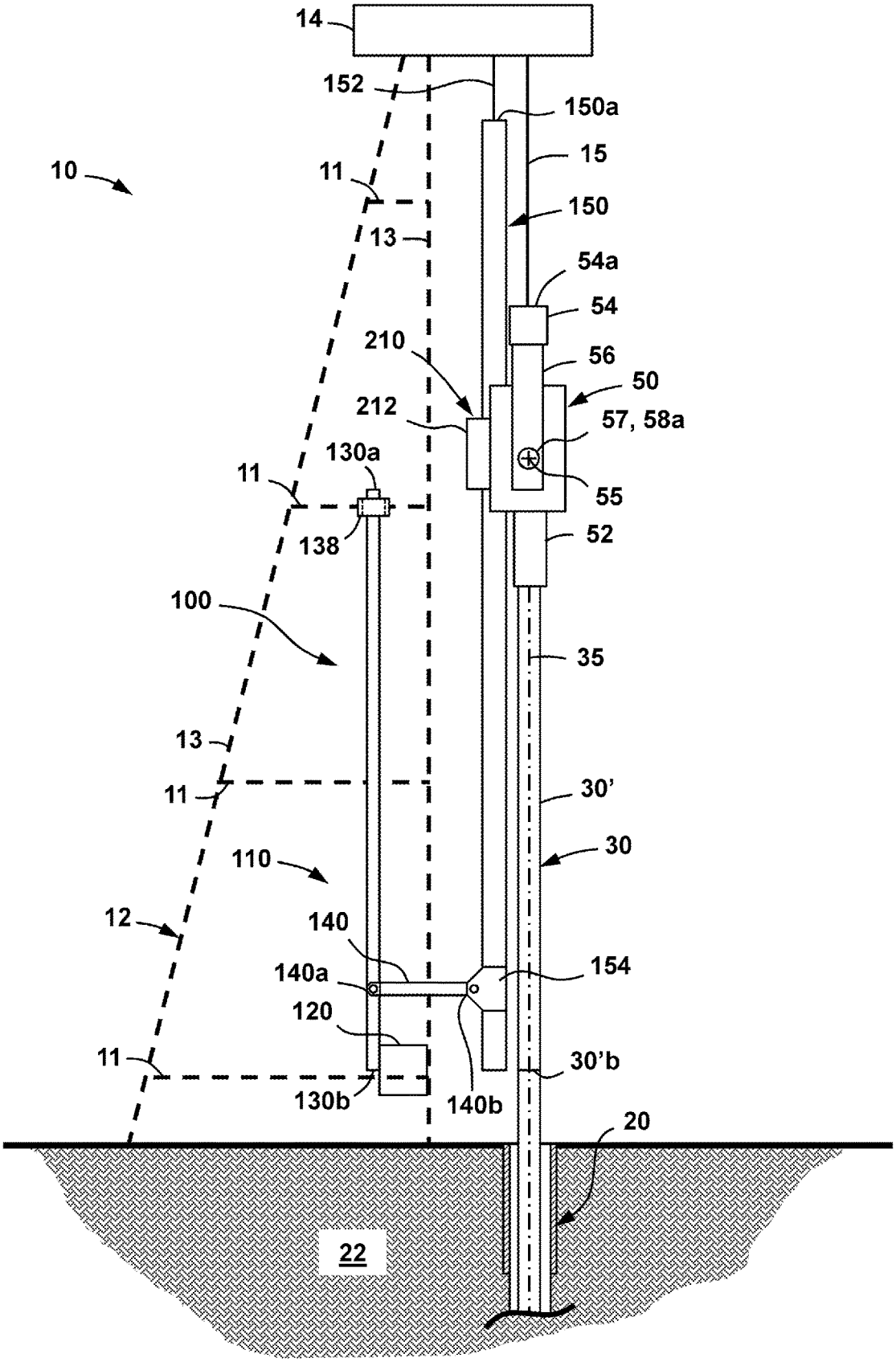

Referring now to FIGS. 21-23, eventually, power swivel 50 and upper end 30*a* of drillstring 30 progress to an axially lowermost limit (e.g., with upper end 30*a* being proximate the upper end of borehole 20). At this point, stem 52 is uncoupled (e.g., unthreaded) from upper end 30*a*; however, due to the distribution of weight within power swivel 50 (e.g., motor 51 and gear box 53 shown in FIG. 14), upon uncoupling drillstring 30 from power swivel, the center of gravity shifts horizontally away from axis 55 such that power swivel 50 pivots about axis 55 (e.g., to position 59B shown in FIG. 14) to place stem 52 in a substantially horizontal position as shown in FIG. 22. Thereafter, a new section (or joint) of drill pipe 30' may be coupled (e.g., threaded to stem 52) and the power swivel 50 and drill pipe 30' may be raised vertically upward via line 15 along guide beam 150. The coupling of drill pipe 30' top stem 52 moves the center of gravity the coupled for power swivel 50 and drill pipe 30' vertically below axis 55 (e.g., to position 39A as shown in FIG. 14) such that power swivel 50 rotates back about axis 55 to place stem 52 in a substantially vertical orientation such as shown in FIG. 23. Once the now vertically oriented power swivel 50 and drill pipe 30' are raised along guide beam 150, a lower end 30'*b* of drill pipe 30' is coupled (e.g., threaded) to upper end 30*a* of drillstring 30 and the drilling procedure discussed above is repeated with power swivel 50 driving rotation of drillstring 30 (which now includes drill pipe 30') and drill bit 32 to lengthen borehore 20. As previously described, these rotations of power swivel 50 about axis 55 during drilling operations are facilitated and supported by the pivotal coupling between power swivel 50 and dolly assembly 210.

During the above described drilling operations, torque transferred to power swivel 50 from drill string 30 (e.g., torque resulting from rotational resistance experienced by drill bit 32 as it engages with formation 22) is transferred through connector post 58*b* into dolly assembly 210 (i.e., into housing plates 220, 230), and then guide beam 150. The torque is then transferred from guide beam 150 to torque post 130 via connecting member 140. Finally, the torque is transferred and into mast 12 from torque post 130 via mast tie-back member 120. Because cylindrical section 132 of torque post 130 is loosely disposed within mounting collar 138 as previously described, no torque is transferred into mast 12 via collar 138 and support members 139 during these operations. As a result, all or most of the torque transferred to guide beam 150 during drilling operations with power swivel 50 is transferred to the lowermost portion of mast 12. It is preferable to transfer torque into this vertically lowermost portion of mast 12 its more robust construction as compared with the upper portions of mast 12 (e.g., proximate crown 14).

Figure 24:
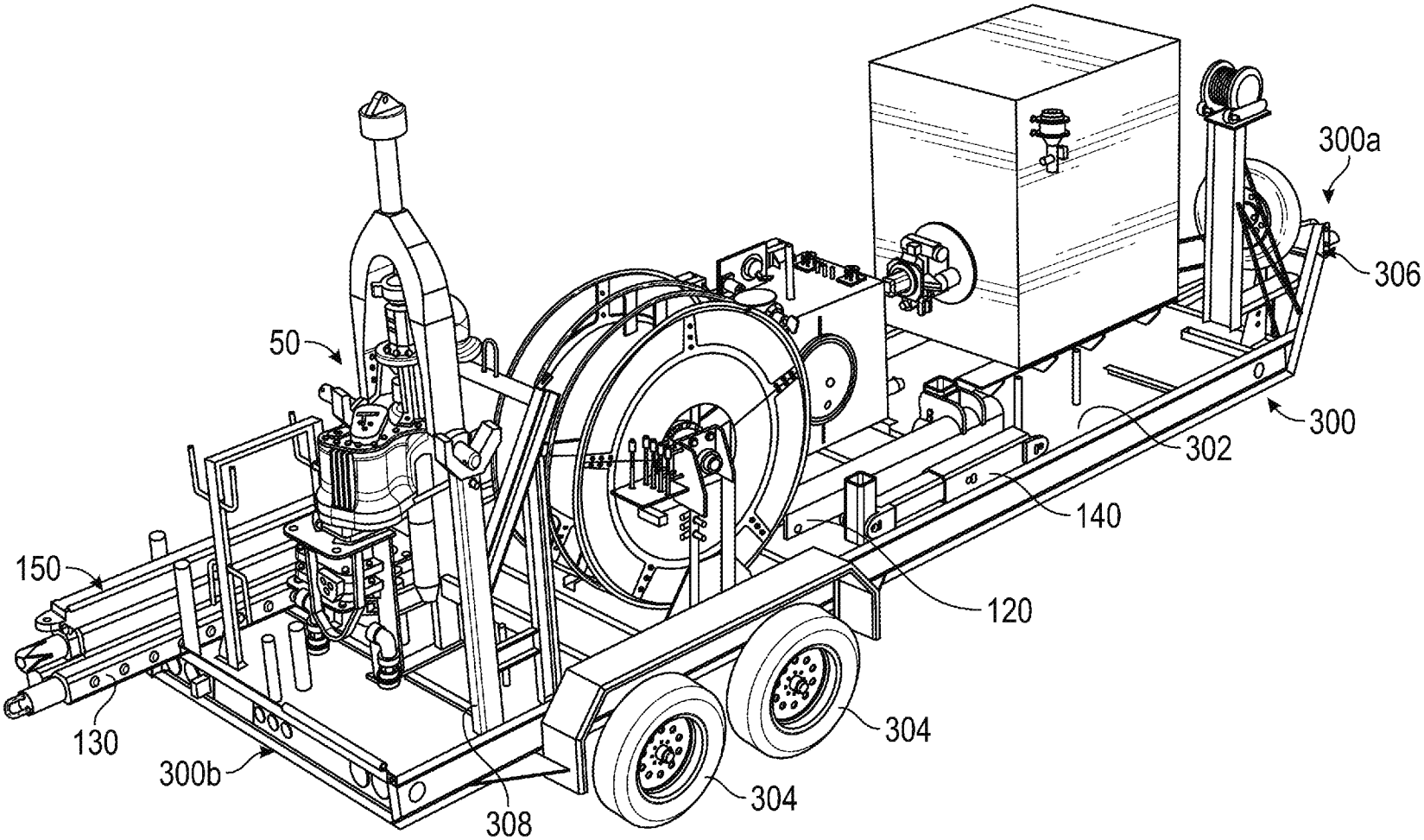
FIGS. 24 and 25 are perspective views of the power swivel and guide system of FIG. 1 disposed on a single shipping support member to form a transportable kit.
Figure 25:
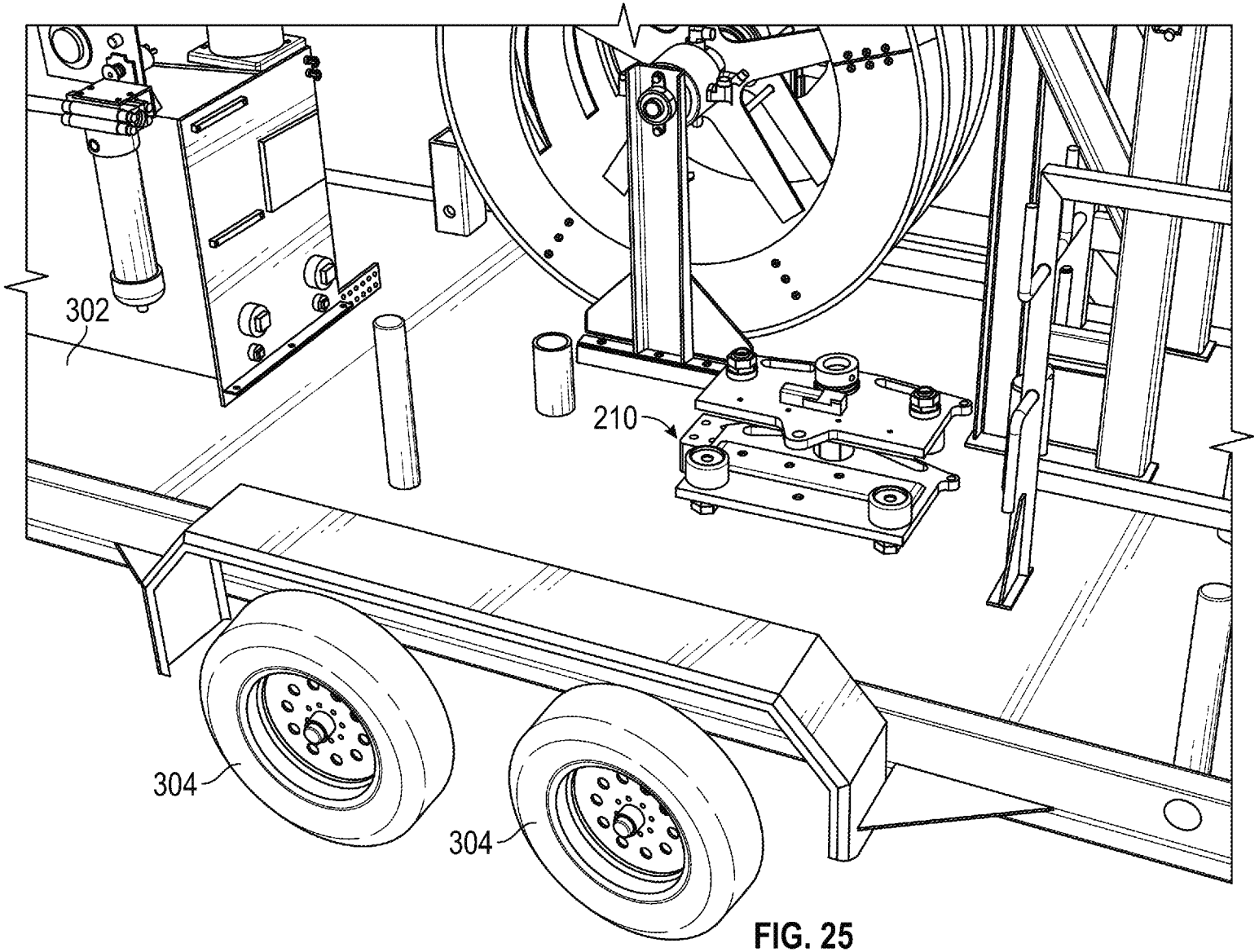

Referring now to FIGS. 24 and 25, in some embodiments, power swivel 50, and guide system 100 (e.g., guide beam 150, a dolly assembly 210, torque transfer assembly 110, etc.) may be delivered to mast 12 on a single shipping support member 300. In this embodiment support member 300 comprises a flatbed trailer, and thus, shipping support member 300 will be referred to herein as "trailer 300" for convenience. However, it should be appreciated that power swivel 50 and guide system 100 may be delivered to mast 12 on other shipping support members (e.g., a shipping container) in other embodiments. In this embodiment, trailer 300 includes a first or front end 300*a*, a second or rear end 300*b* opposite front end 300*a*, a support surface or bed 302 extending between ends 300*a*, 300*b*, and a plurality of support wheels 304 disposed between ends 300*a*, 300*b*. Front end 300*a* includes a connector 306 that is configured to mate and engage with a corresponding connector (e.g., a hitch) on a transport vehicle (e.g., a truck) to enable the towing and transportation of trailer 300.

Bed 302 is sized to receive and support power swivel 50 and each of the components of guide system 100. Specifically, in the arrangement shown in FIGS. 24 and 25, power swivel 50 is supported on a pair of support posts 308 extending upward from deck 302. In addition, the sections 151, 152, 153 (e.g., see FIG. 3) of guide beam 150 and torque post 130 of torque transfer assembly 110 are arranged substantially parallel to one another along one side of deck 302. In addition, mast tie-back member 120 and connecting member 140 are each arranged parallel to one another on an opposite side of deck 302 from torque post 130 and guide beam 150. Further, as best shown in FIG. 25, dolly assembly 210 (e.g., spacer 215, plates 220, 230, etc.) is also disposed on deck 302. Thus, during operations, power swivel 50 and guide system 100 are loaded onto deck 302 of trailer 300, and trailer 300 is connected to a transport vehicle via connector 306. Thereafter, trailer 300 is towed to mast 12 such that power swivel 50 and the components of guide system 100 may be unloaded from trailer 300 and coupled to mast 12 in the manner described above. Thus, power swivel 50 and guide system 100 may be delivered to mast 12 on a trailer 300 as a single kit or assembly.

Figure 26A:
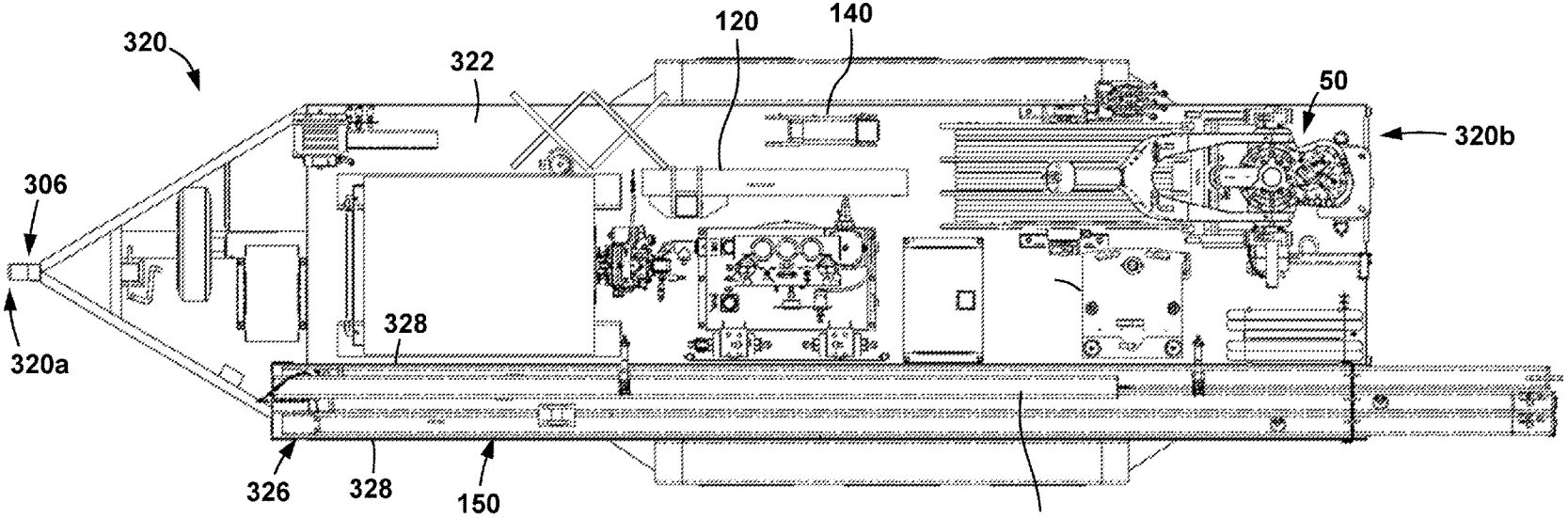
FIGS. 26A and 26B are top and side views, respectively, of the power swivel and guide system disposed on another single shipping support member to form a transportable kit.
Figure 26B:
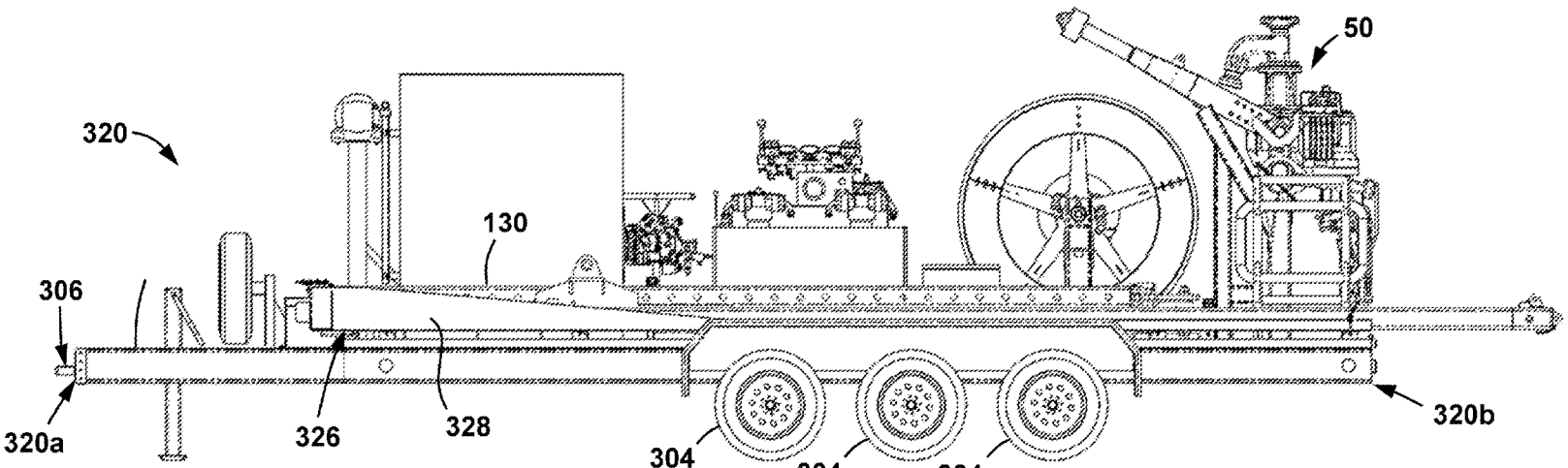

Referring now to FIGS. 26A and 26B, another embodiment of a support member 320 is shown. Like support member 300, support member 320 comprises a flatbed trailer, and thus, shipping support member 320 will be referred to herein as "trailer 320" for convenience. Trailer 320 is substantially similar to trailer 300, and thus, the description below will focus on the components and features of trailer 320 that are different from trailer 300 and like components between trailers 300, 320 will be referred to with life numerals. Specifically, in this embodiment trailer 320 includes a first or front end 320*a*, a second or rear end 320*b* opposite front end 320*a*, a support surface or bed 322 extending between ends 320*a*, 320*b*, and a plurality of support wheels 304 disposed between ends 320*a*, 320*b*. Front end 320*a* includes connector 306, which is the same as previously described above.

Like bed 302 of trailer 300, bed 322 of trailer 320 is sized to receive and support power swivel 50 and each of the components of guide system 100. However, unlike trailer 300, bed 322 of trailer 320 supports each of the sections 151, 152, 153 of guide post 150 and torque post 130 within a tray or cradle assembly 326 that is disposed or supported on bed 322. As best shown in FIG. 26B, tray 326 includes a pair of angled support walls 328 (note: only one wall 328 is shown in FIG. 26B) that prevent sections 151, 152, 153 and post 130 from sliding laterally off of trailer 320 during transportation operations. In addition, without being limited to this or any other theory, tray 326 provides a run way or corridor for sections 151, 152, 153 and post 160 to slide or traverse on and off of trailer 320 during operations so that the risk of impact between sections 151, 152, 153 and post 130 and other components (e.g., power swivel 50) on trailer 320 are reduced. Thus, power swivel 50 and guide system 100 may be delivered to mast 12 on a trailer 320 as a single kit or assembly.

Figure 27:
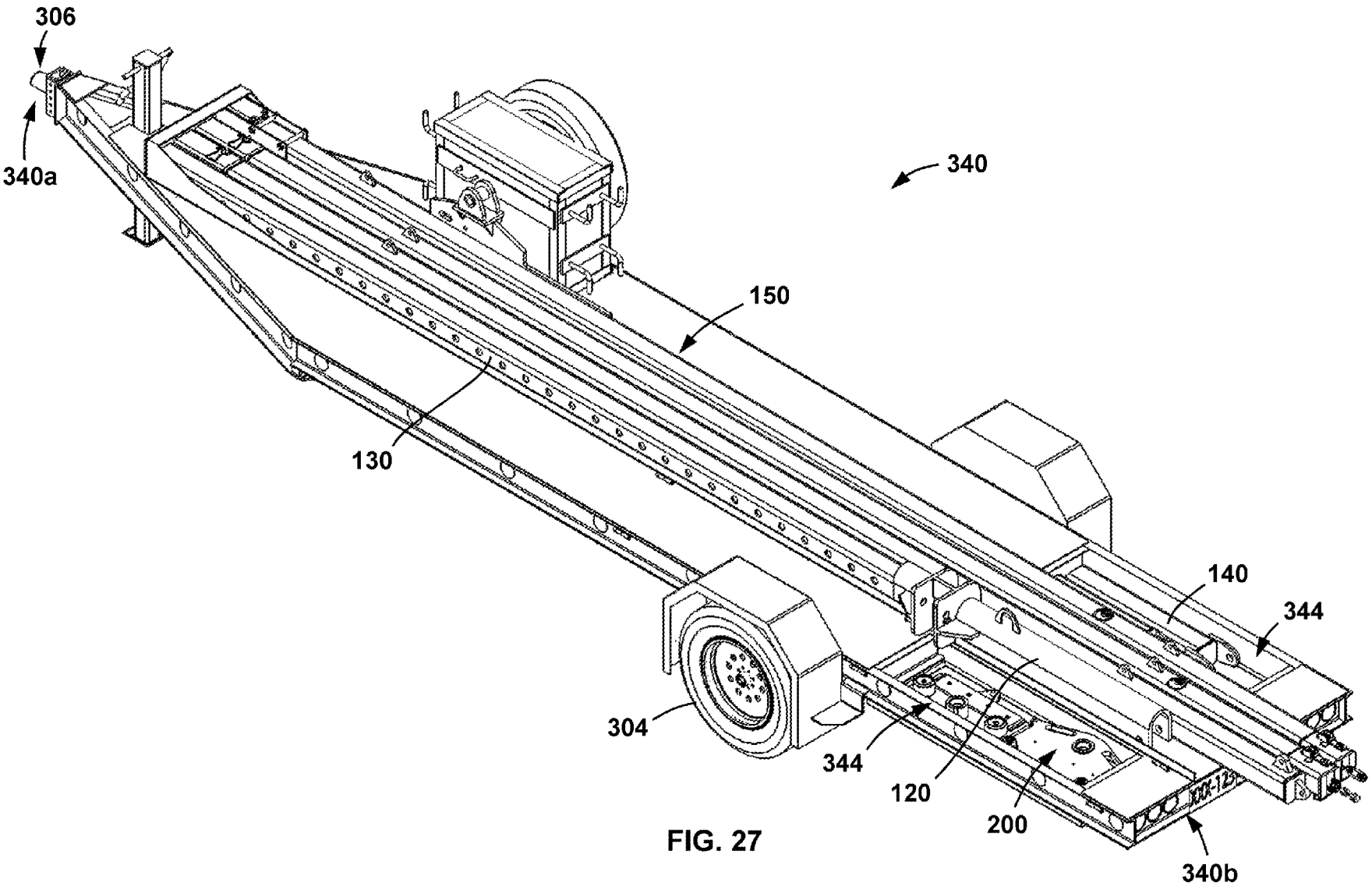
FIG. 27 is a perspective view of the guide support system disposed on another single shipping support member to form a transportable kit.

Referring now to FIG. 27, another embodiment of a support member 340 is shown. Like support member 300, support member 340 comprises a flatbed trailer, and thus, shipping support member 340 will be referred to herein as "trailer 340" for convenience. In this embodiment trailer 340 includes a first or front end 340*a*, a second or rear end 340*b* opposite front end 340*a*, a support surface or bed 342 extending between ends 340*a*, 340*b*, and a plurality of support wheels 304 disposed between ends 340*a*, 340*b*. Front end 340*a* includes connector 306, which is the same as previously described above. In addition, in this embodiment bed 342 of trailer 340 is sized to receive and support only the components of guide system 100, and is not configured to additionally support power swivel 50 as well. Specifically, bed 342 of trailer 320 supports each of the sections 151, 152, 153 of guide post 150 and torque post 130 within a tray or cradle assembly 326 that is disposed or supported on bed 342 and is the same as previously described above. As a result, tray 326 includes the pair of angled support walls 328 that prevent sections 151, 152, 153 and post 130 from sliding laterally off of trailer 320 during transportation operations, as previously described. Also, in this embodiment, mast tie-back member 120 is also disposed within tray assembly 326 In addition, bed 342 includes a pair of recessed cavities 344 that are configured to receive the other components of guide system 100 (e.g., dolly assembly 210, connecting member 140, etc.). Thus, guide system 100 may be delivered to mast 12 on a trailer 340 as a single kit or assembly.

While embodiments disclosed herein have included a guide beam 150 having sections 151, 152, 153 coupled to one another via a tensioning assembly 90 and connectors 160, 170 (see FIG. 3), it should be appreciated that in other embodiments, the sections (e.g., sections 151, 152, 153) of the guide beam may be coupled to one another by means of other coupling assemblies. For example, referring now to FIG. 28, another embodiment of guide beam 450 is shown. Guide beam 450 includes a first or upper end 450*a*, and a second or lower end 450*b* opposite upper end 450*a*. During operations, upper end 450*a* is coupled and suspended to line 49 that extends from crown 14 (or some other structural member, component, or feature disposed on mast 12—see FIGS. 1 and 2). In addition, mounting bracket 154 (previously described) is disposed along guide beam 450 between ends 450*a*, 450*b*. In this embodiment, mounting bracket 154 is more proximate lower end 450*b* than upper end 450*a*. Mounting bracket 154 is used to couple guide beam 450 to torque transfer assembly 110 (particularly to connecting member 140) in substantially the same manner as was described above for guide beam 150.

Figure 28:
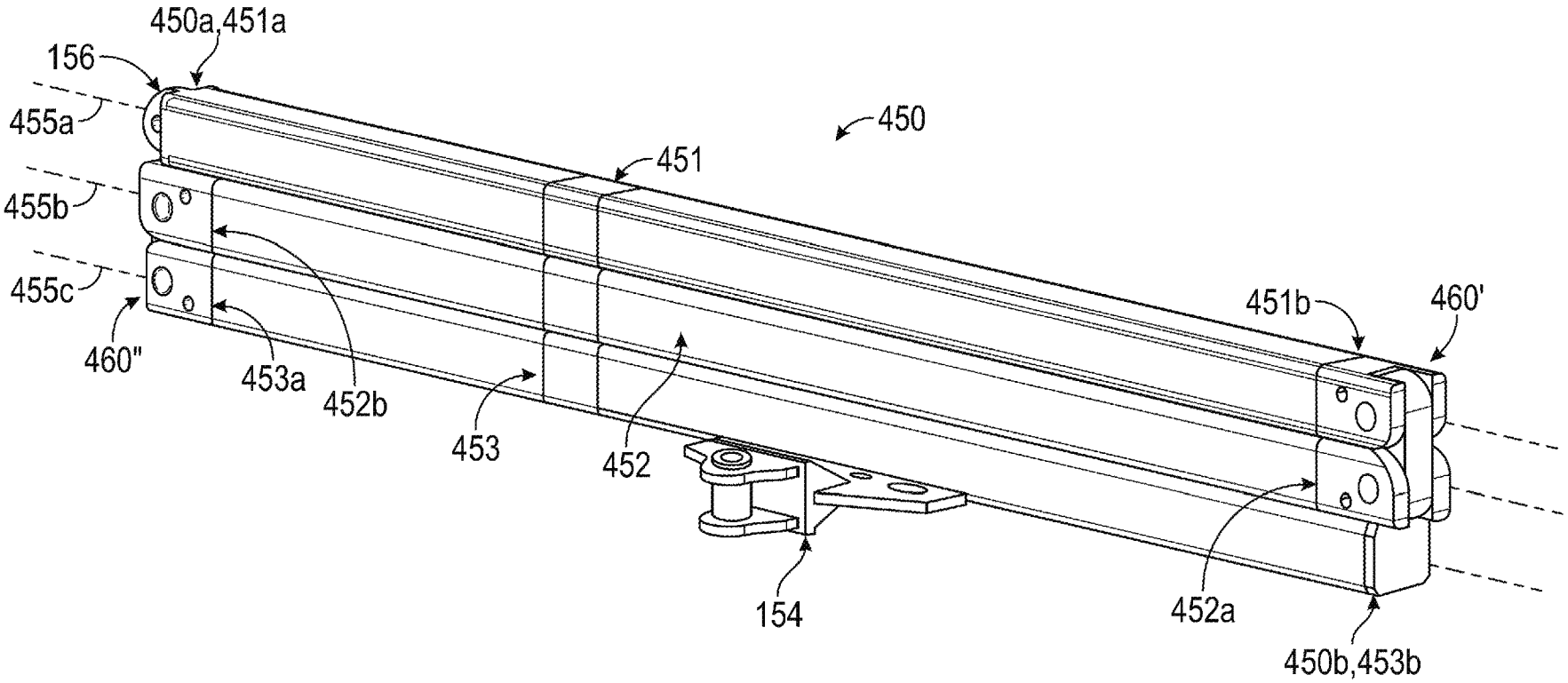
FIG. 28 is a perspective view of another guide beam for use with the system of FIG. 1 in accordance with at least some embodiments.

Referring still to FIG. 28, guide beam 450 further comprises three (3) elongate sections 451, 452, 453 that are configured to be coupled end-to-end. Specifically, guide beam 450 includes a first or upper section 451, a second or middle section 452, and a third or lower section 453. Each section 451, 452, 453 includes a central axis 455*a*, 455*b*, 455*c*, respectively, a first or upper end 451*a*, 452*a*, 453*a*, respectively, a second or lower end 451*b*, 452*b*, 453*b*, respectively, axially opposite upper end 451*a*, 452*a*, 453*a*, respectively. Mounting bracket 154 is disposed along lower section 453.

Upper end 451*a* of upper section 451 is coincident with upper end 450*a* of guide beam 450. As shown in FIG. 28, upper end 451*a* of upper section 451 includes connector 156 (previously described) that connects to line 49 to suspend guide beam 450 from mast 12 (e.g., from crown 14) during operations. Lower end 453*b* of lower section 453 is coincident with lower end 450*b* of guide beam 450. In addition, the interconnecting ends (e.g., ends 451*b*, 452*a*, 452*b*, 453*a*) of sections 451, 452, 453 coupling assemblies 460', 460" that rotatably couple sections 451, 452, 453 to one another and allow for proper axial alignment between members 451, 452, 453 during operations. Specifically, a first coupling assembly 460' is coupled to and between lower end 451*b* of upper section 451 and upper end 452*a* of middle section 452, and a second coupling assembly 460" is coupled to and between lower end 452*b* of middle section 452 and upper end 453*a* of lower section 453.

Figure 29:
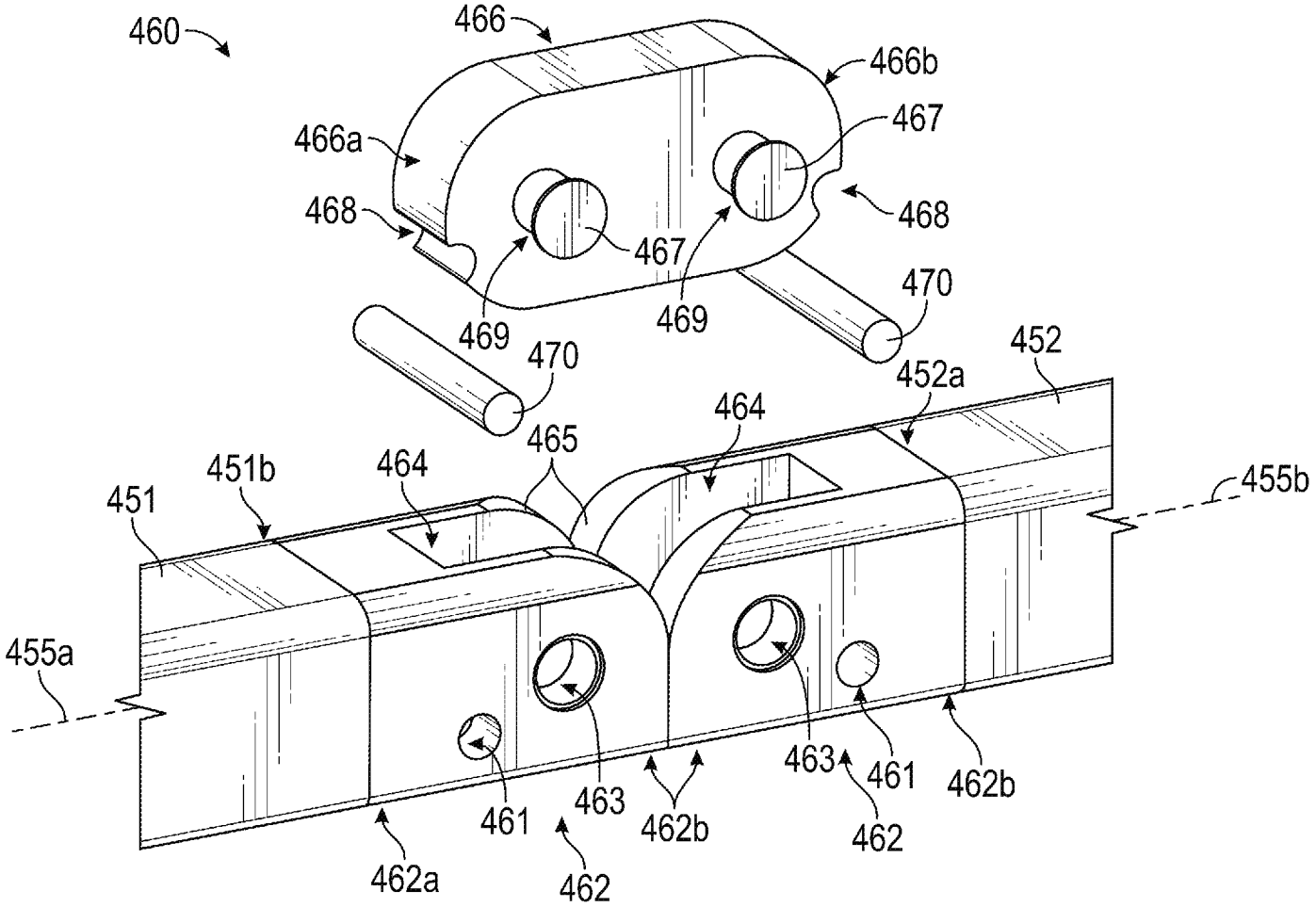
FIG. 29 is an exploded view of a link assembly for coupling the sections of guide beam of FIG. 28 to one another.
Figure 30:
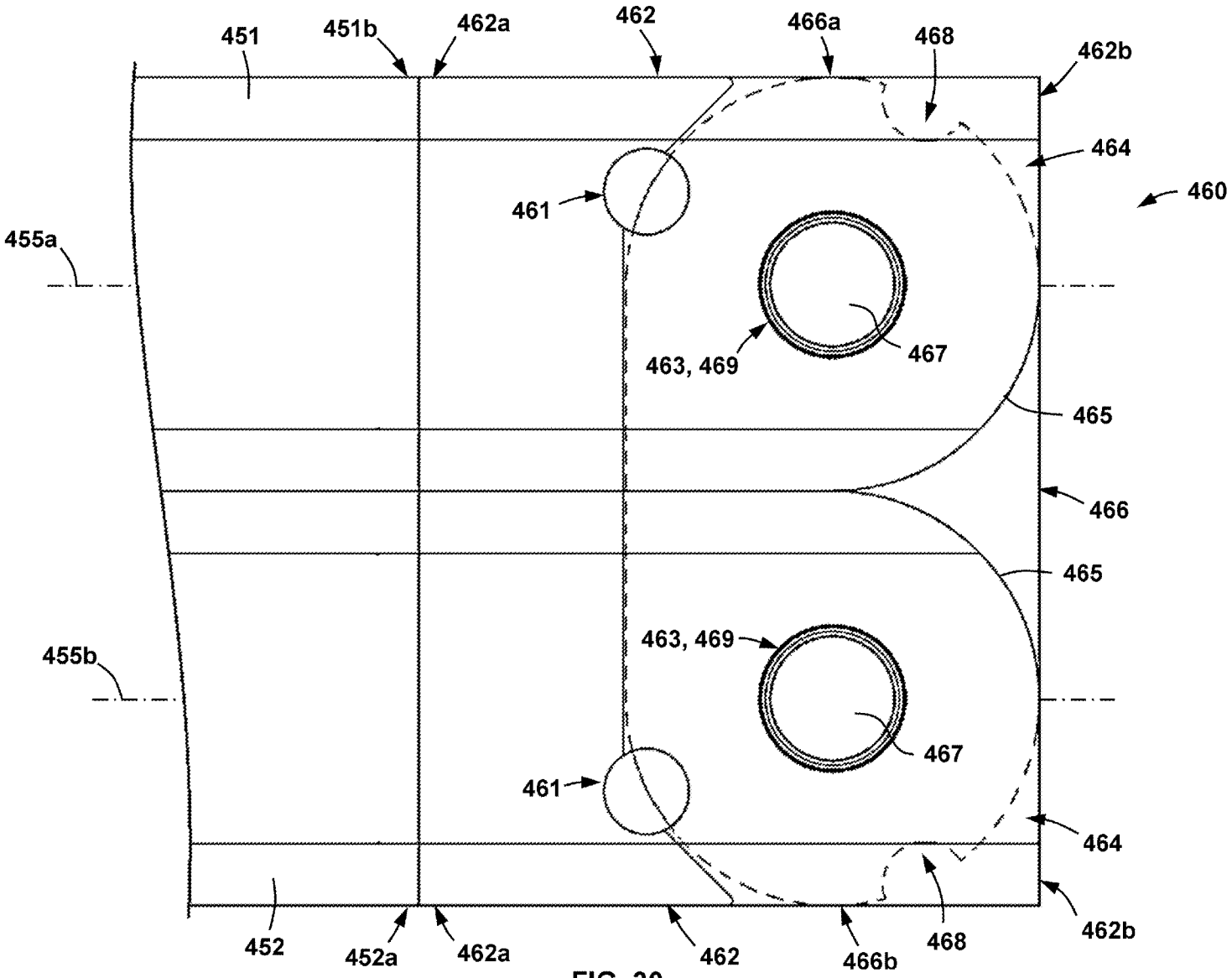
FIG. 30 is a side view of the link assembly of FIG. 29 where the sections of the guide beam of FIG. 28 that are coupled together by the link assembly are in a folded position.

Referring now to FIGS. 29 and 30, first coupling assembly 460' coupled to ends 451*b*, 452*a* of sections 451, 452, respectively, is shown, it being understood that second coupling assembly 460" coupled between ends 452*b*, 453*a* of sections 452, 453, respectively, is substantially the same. Link assembly 460' includes a pair of bracket members 462 and a link 466 pivotably coupled to each of the bracket members 462.

Each of the bracket members 462 is configured substantially the same, and thus, only bracket member 462 coupled to upper section 451 will be described in detail below in the interest of brevity. Specifically, bracket member 462 includes a first end 462*a* abutting lower end 451*b* of upper section 451, a second end 462*b* opposite first end 462*a*, and a curved surface 465 at second end 462*b* that, as will be described in more detail below, cooperates with another similar curved surface 465 on the other bracket member 462 of coupling assembly 460' (i.e., the bracket member coupled to middle section 452) to allow relative rotation of sections 451, 452 about link 466. In addition, bracket member 462 includes a slot 464 extending radially therethrough and axially from second end 462*b*. A mounting aperture 463 extends radially through bracket member 462 between ends 462*a*, 462*b*, and a locking aperture 461 extends through bracket member 462 adjacent to mounting aperture 463 in a direction that is parallel to and offset from a radius of axis 455*a*. In addition each of the mounting aperture 463 and locking aperture 461 extend radially through slot 464. In this embodiment, slot 464 extends through bracket member 462 in a first radial direction and apertures 461, 463 each extend through bracket member 462 in a second direction that is shifted 90° from the first radial direction (i.e., the first radial direction is perpendicular to the second direction).

Link 466 is an elongate member with a first curved end 466*a* and a second curved end 466*b* opposite first curved end 466*a*. In addition, link 466 includes a pair of cylindrical locking recesses 468, each recess 468 extending into one of the ends 466*a*, 466, and a pair of mounting apertures 469, with one of the apertures 469 being proximate first end 466*a* and another of the apertures 469 being proximate second end 466*b*.

During operations, first ends 462*a* of bracket members 462 are mounted to ends 451*b*, 452*a* of sections 451, 452, respectively, such that second ends 462*b* are proximate one another and slots 464 are each aligned along the same radial direction. Thereafter, link 466 is inserted radially within the aligned slots 464 such that mounting apertures 469 on link are aligned with apertures 462 in bracket members 462. Particularly, the mounting aperture 469 proximate first end 466*a* of link 466 is aligned with the mounting aperture 463 in bracket member 462 secured to lower end 451*b* of upper section 451, and the mounting aperture 469 proximate second end 466*b* of link 466 is aligned with mounting aperture 463 in bracket member 462 secured to upper end 452*a* of middle section 452. A pair of mounting pins 467 are then inserted through the aligned apertures 463, 469 to pivotably couple link 466 to each of the bracket members 462. As a result, sections 451, 452 of guide beam 450 are pivotably coupled to one another about link 466. First ends 462*a* of bracket members 462 may be secured to ends 451*b*, 452*a* of sections 451, 452, respectively, in any suitable manner, such as, for example, welding, bolts, screws, rivets, adhesive, interference fit, etc.

Figure 31:
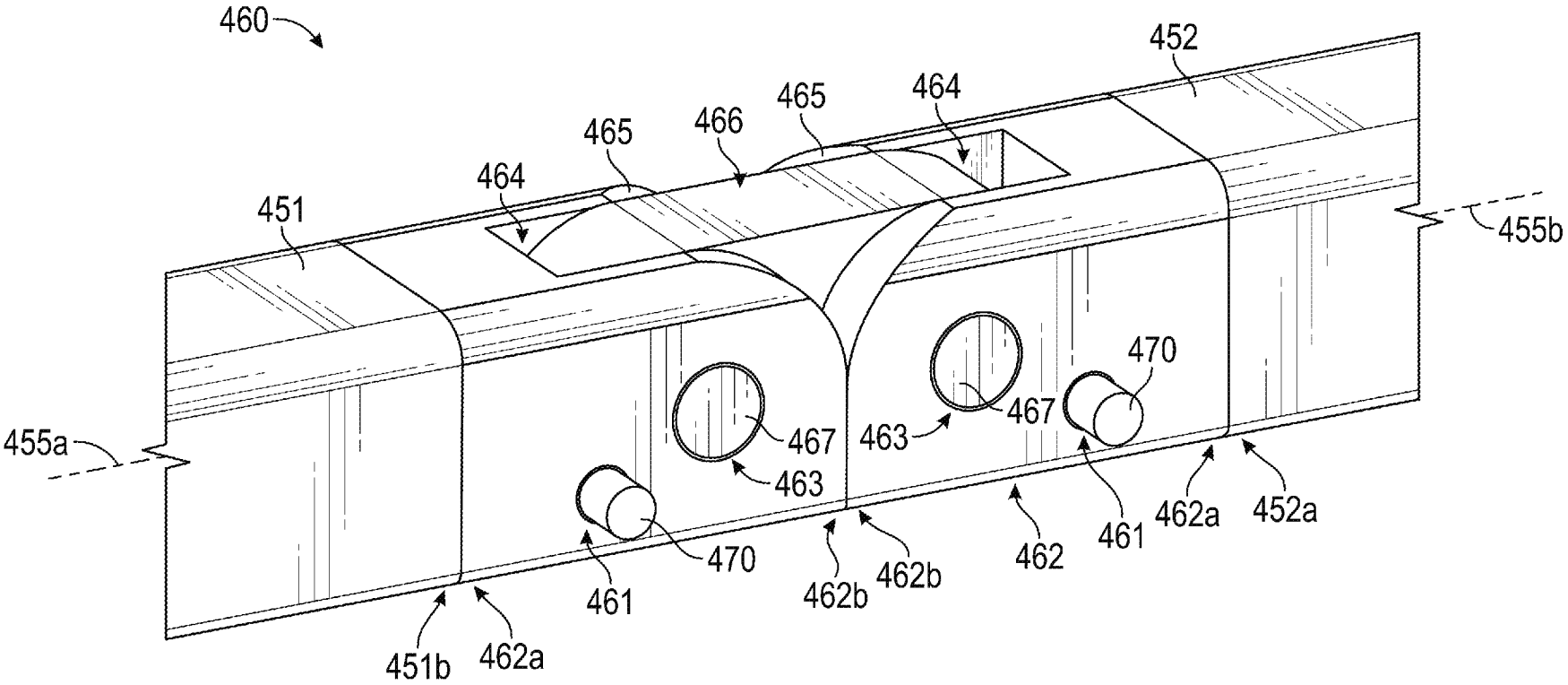
FIG. 31 is a perspective view of the link assembly of FIG. 29 where the sections of the guide beam of FIG. 28 that are coupled together by the link assembly are in an aligned position.

Referring now to FIGS. 30 and 31, once coupling assembly 460' is coupled between sections 451, 452 in the manner described above, sections 451, 452 may be pivoted about link 466 between a folded position (shown in FIG. 29) and an aligned position (shown in FIG. 31). In the folded position (FIG. 30), the axes 455*a*, 455*b* of sections are substantially parallel to one another and link 466 extends generally radially relative to each of the axes 455*a*, 455*b*. In the aligned position (FIG. 31), axes 455*a*, 455*b* of sections 451, 452, respectively, are generally coaxially aligned with one another, ends 462*b* are engaged, and link 466 extends generally axially with respect to axes 455*a*, 455*b*. During transition of sections 451, 452 between the folded and aligned positions (FIGS. 30 and 31, respectively), curved surfaces 465 on bracket members 462 oppose and engage one another to facilitate the relative pivoting thereof. In addition, while not specifically shown in FIG. 31, it should be appreciated that when sections 451, 452 are in the extended position (FIG. 31), notches 468 on link 466 are aligned with locking apertures 461 in bracket members 462. Thus, to lock or secure sections 451, 452, in the aligned position, a pair of locking pins 470 are inserted through the aligned apertures 461 and notches 468. Locking pins 470 may be inserted within apertures 461 and notches 468 in any suitable manner, such as, for example, manually, hydraulic ally, pneumatically, etc. In some embodiments, pins 470 may be inserted into apertures 461 and notches 468 with a biasing member (e.g., spring.). It should be appreciated that sections 452, 453 may also be transitioned between a folded position and an aligned position about coupling assembly 460" in substantially the same manner as described above for sections 451, 452 about coupling assembly 460'.

Referring again to FIG. 28, during operations guide beam 450 may be transitioned from a folded position (FIG. 28) to an extended position (not specifically shown). When in the folded position (FIG. 28) sections 451, 452 are in the folded position about link assembly 460 shown in FIG. 30 with axes 455*a*, 455*b* extending parallel to one another, and sections 452, 453 are similarly placed in a similar folded position about coupling assembly 460" with axes 455*b*, 455*c* extending parallel to one another. Thus, when guide beam 450 is in the folded position (FIG. 28) each of the axes 455*a*, 455*b*, 455*c* of sections 451, 452, 453, respectively, extend parallel to one another, thereby facilitating storage and transport of guide beam 450 (e.g., transport via shipping support member 300, previously described). In addition, guide beam 450 may also be transitioned to the extended position where sections 451, 452 are pivoted about coupling assembly 460' from the folded position such that axes 455*a*, 455*b* are generally coaxially aligned with one another (e.g., see FIG. 31). Similarly, when guide beam 450 is transitioned to the extended position, sections 452, 453 are pivoted about coupling assembly 460" from the folded position such that axes 455*b*, 455*c* are generally coaxially aligned with one another. Thus, when guide beam 450 is in the extended position, the axes 455*a*, 455*b*, 455*c* of sections 451, 452, 453 are all generally coaxially aligned, so that sections extend end-to-end along a common axis between ends 450*a*, 450*b*. Guide beam 450 may then be secured in the extended position by inserting the locking pins 470 within aligned notches 468 on links 466 and locking apertures 461 in bracket members 462 for each of the link assemblies 460', 460".

During operations with guide beam 450, upper end 450*a* is coupled to line 49 and beam 450 is then suspended from derrick 12 in the manner described such that the force of gravity causes beam 450 to transition to the extended position. The guide beam 450 may then be secured in the extended position through the insertion of locking pins 470 in the manner described above, such that guide beam 450 forms an elongate rigid member. Thereafter, operations with system 10 (including guide beam 450 in place of guide beam 150) may proceed in the same manner as described above.

It should be appreciated that sections 451, 452, 453 of guide beam ay be coupled to one another with various other mechanisms. As a result, additional example embodiments for coupling sections 451, 4562, 453 of guide beam 450 are described below. However, like assemblies 460', 460" these additional embodiments may also be used to couple sections 151, 152, 153 of guide beam 150 to one another.

Figure 32:
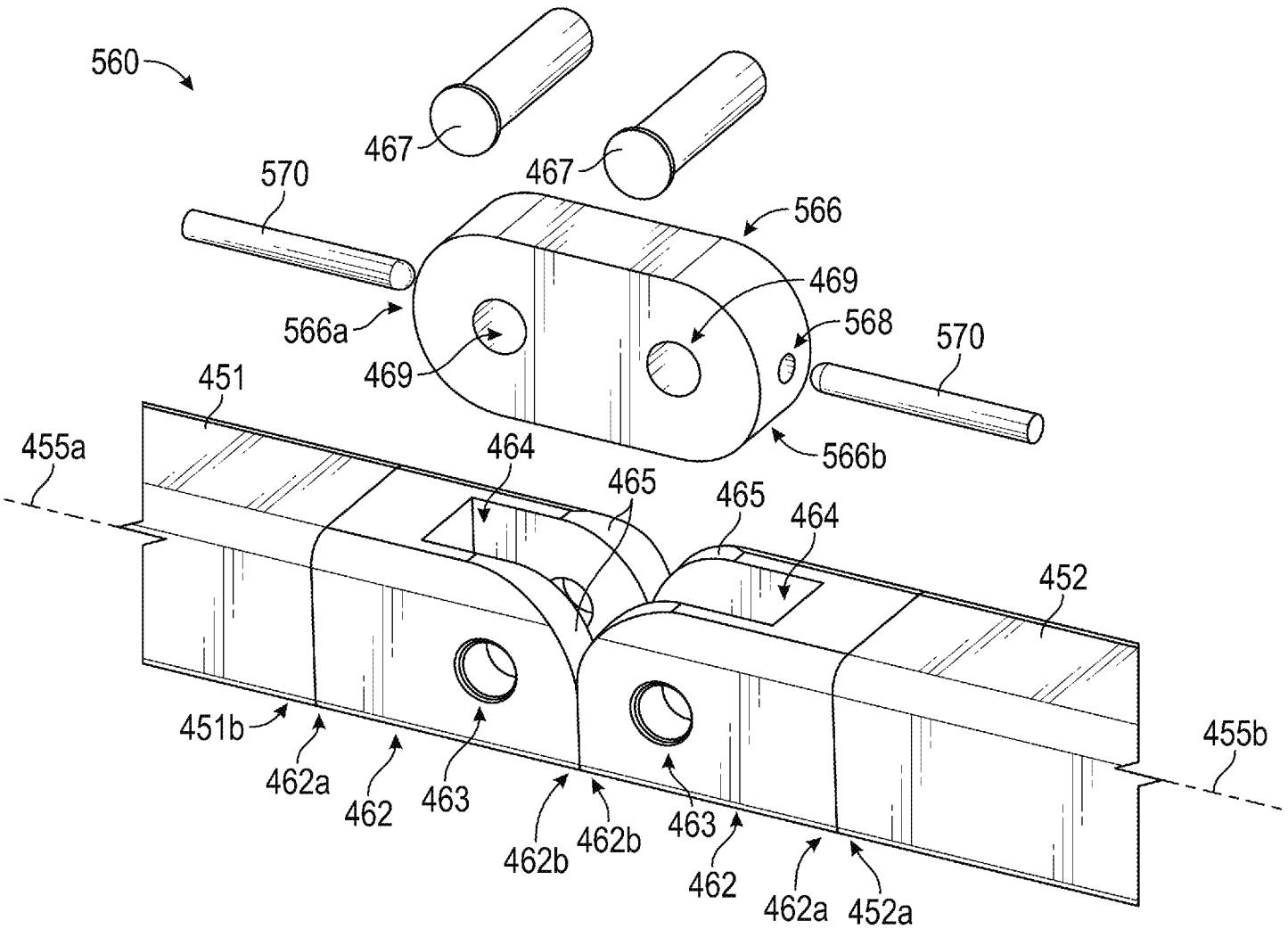
FIG. 32 is a perspective view of another link assembly for coupling the sections of the guide beam of FIG. 28 to on another.
Figure 33:
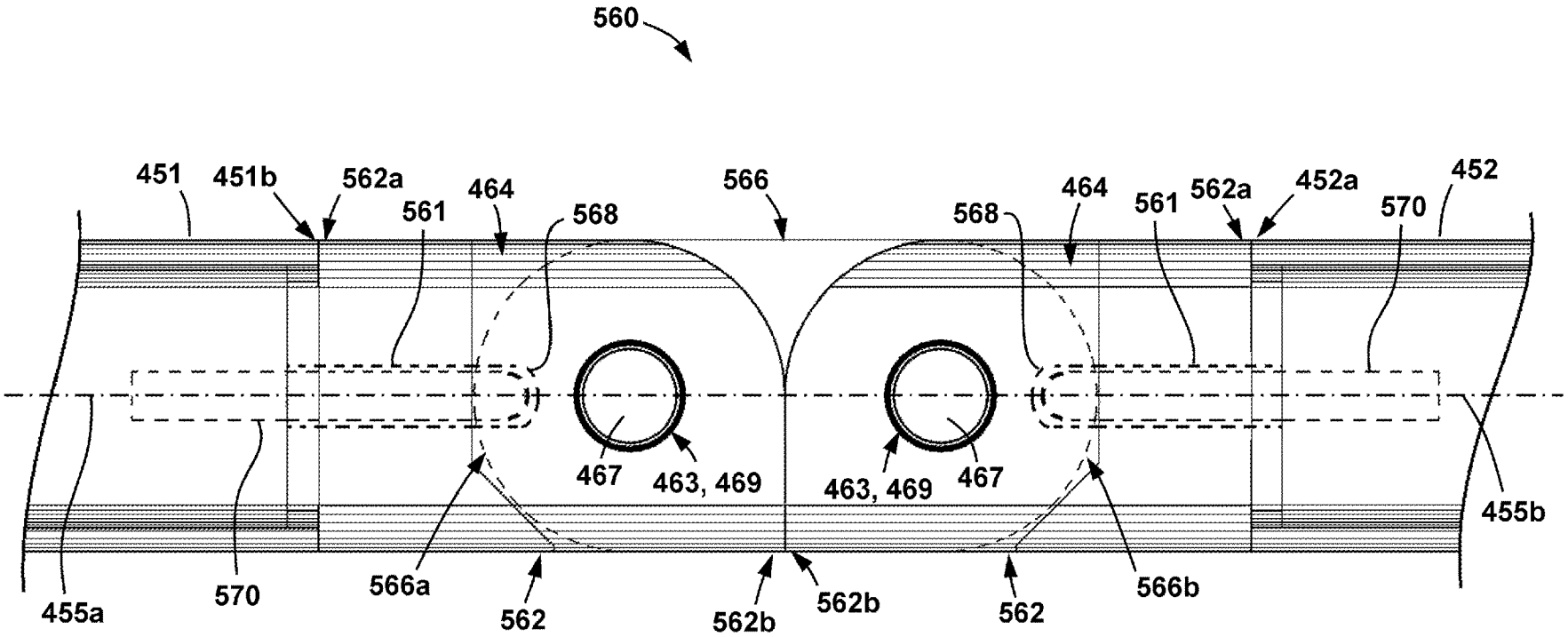
FIG. 33 is a side view of the link assembly of FIG. 33 where the sections of the guide beam of FIG. 28 that are coupled together by the link assembly are in an aligned position.

Referring now to FIGS. 32 and 33, another embodiment of a coupling assembly 560 for use in place of either or both of the coupling assemblies 460', 460" is shown. Coupling assembly 560 shares commonality with coupling assemblies 460', 460" previously described, and thus, like numerals will be used for like components and the description below will concentrate on the differences between coupling assembly 560 and coupling assemblies 460', 460".

Specifically, coupling assembly 560 includes a pair of bracket members 562 pivotably coupled to a link 566. Bracket members 562 each include a first end 562*a*, and a second end 562*b* opposite first end 562*a*. In general, bracket members 562 are the same as bracket members 462 except that bracket members 562 do not include locking apertures 461 (see FIGS. 29-31). Rather, as best shown in FIG. 33, bracket members 562 include locking apertures 561 extending axially into slots 464 (note: locking apertures 561 are shown as dotted lines in FIG. 33). Link 566 includes a first end 566*a*, and a second end 566*b* opposite first end 566*a*. In general, link 566 is the same as link 466 except that locking notches 468 are replaced with locking apertures 568 that each extend into link 566 from the ends 566*a*, 566*b*.

When coupling assembly 560 is installed between two of the sections 451, 452 (note: assembly 560 may also be coupled between sections 452, 453 in the same manner as shown for sections 451, 452), bracket members 562 are mounted to ends 451*b*, 452*a* of section 451, 452 in the same manner as previously described above, and link 566 is inserted within slots 464 and pivotably coupled to bracket members 562 via the insertion of mounting pins 467 into the aligned apertures 463, 469 of link 566 and bracket members 562, respectively. Thereafter, sections 451, 452 are free to transition between the folded and aligned positions as previously described (e.g., see FIGS. 30 and 33). As shown in FIG. 33, to lock sections 451, 452 in the extended position, locking pins 570 are installed in each of the sections 451, 452 that extend through locking apertures 561 in bracket members 561 and into locking apertures 568 in link 566 (note: locking apertures 568 are only aligned with apertures 561 and pins 570 when sections 451, 452 are placed in the aligned position as shown in FIG. 33).

Locking pins 570 may be actuated through apertures 561 in bracket member 562 and into apertures 561 in link 566 by any suitable method or mechanism. For example, in some embodiments, pins 570 are manually actuated through apertures 561 and into apertures 568 (e.g., via a handle or other manipulation device disposed on the exterior of sections 451, 452). As another example, in some embodiments, pins 570 are biased within sections 451, 452 (e.g., with a spring or other biasing member) such that when sections 451, 452 are placed in the extended position (FIG. 34), pins 570 are automatically actuated through apertures 561 in bracket members 562 and into apertures 568 in link 566. As still another example, in some embodiments, pins 570 may be actuated through apertures 561 in bracket members 562 and into apertures 568 in links 566 by a linear actuator (e.g., hydraulic cylinder, linear motor, pneumatic actuator, etc.) so that pins 570 may be controllably extended and/or retracted into/from apertures 561, 568 during operations to selectively lock and unlock sections 451, 452 from the aligned position.

Therefore, with coupling assembly 560 coupled between sections 451, 452 (and a similar link assembly 560 also coupled between sections 452, 453), guide beam 450 may be transitioned form a folded position (e.g., see FIG. 28) to an extended position (with axes 455*a*, 455*b*, 455*c* all generally coaxially aligned). Once guide beam 450 is in the extended position and is supported from derrick 12, in the manner described above operations with system 10 may continue as previously described.

In some embodiments, sections 451, 452, 453 may be successively coupled to one another and suspended from derrick 12 (i.e., rather than transition the already coupled sections 451, 452, 453 between folded and aligned positions with coupling assemblies 460', 46", 560). For example, in these embodiments, section 451 is first suspended from derrick 12 via connector 156 at upper end 451*a*. Then upper end 452*a* of middle section 452 is coupled to lower end 451*b* of upper section 451 such that axes 455*a*, 455*b* are generally coaxially aligned and both sections 451, 452 are suspended from derrick 12. Thereafter, upper end 453*a* of lower section 453 is coupled to lower end 452*b* of middle section 452 such that axes 455*a*, 455*b*, 455*c* of sections 451, 452, 453 are all generally coaxially aligned and sections 451, 452, 453 are all suspended from derrick 12.

A few example embodiments of coupling assemblies following this successive coupling and suspension methodology will now be described below. In these embodiments, the description will be limited to the coupling of lower end 451*b* of upper section 451 to the upper end 452*a* of middle section 452 in the interests of brevity; however, it should be appreciated that these embodiments may be applied to coupled lower end 452*b* of middle section 452 and upper end 4523*a* of lower section 453 (or to coupled ends 151*b*, 152*a* of sections 151, 152, and ends 152*b*, 153*a* of sections 152, 153 of beam 150).

Figure 34:
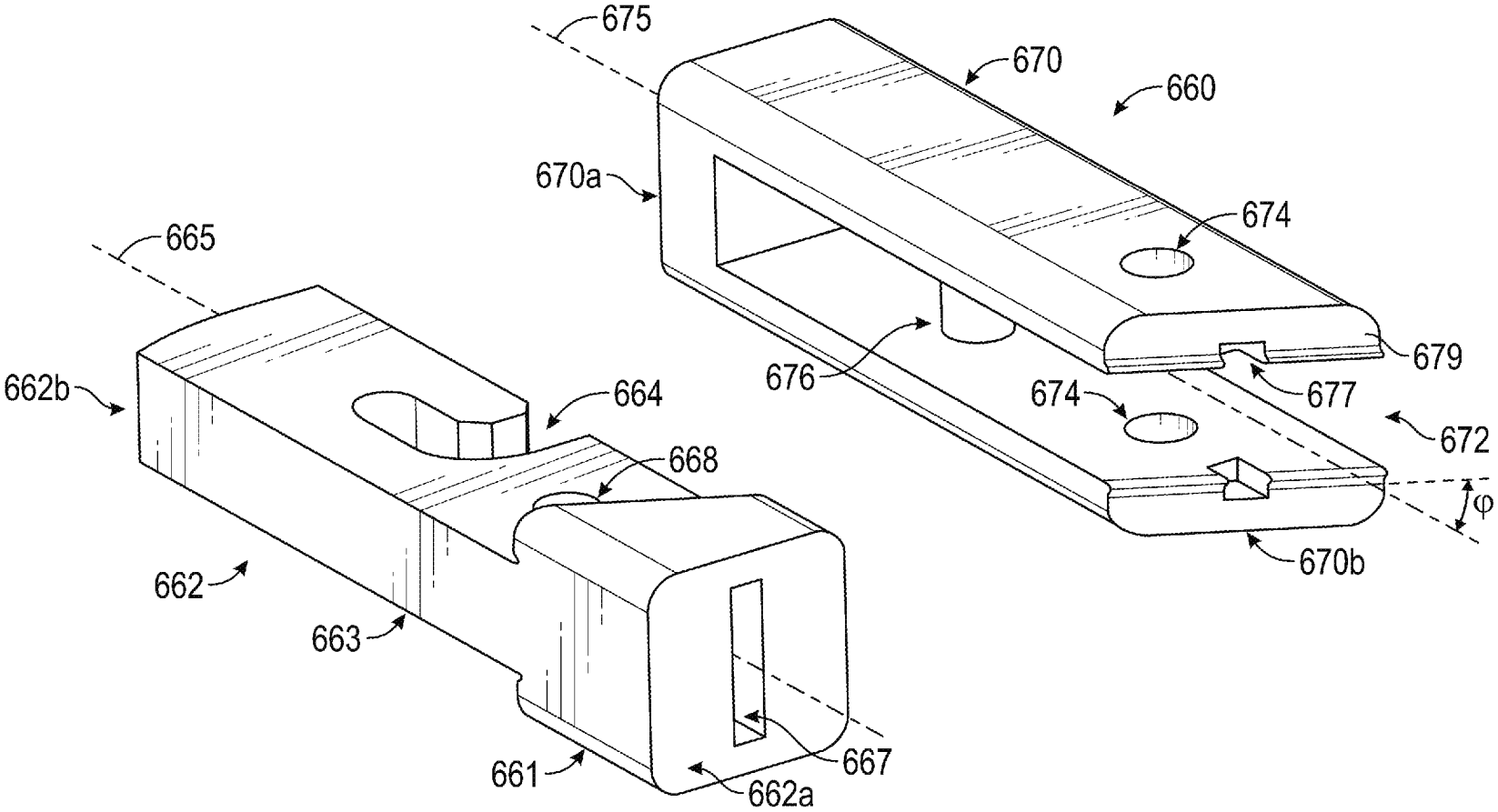
FIGS. 34 and 35 are perspective views of a male and female member of a connection assembly for coupling the sections of the guide beam of FIG. 28 to one another.
Figure 35:
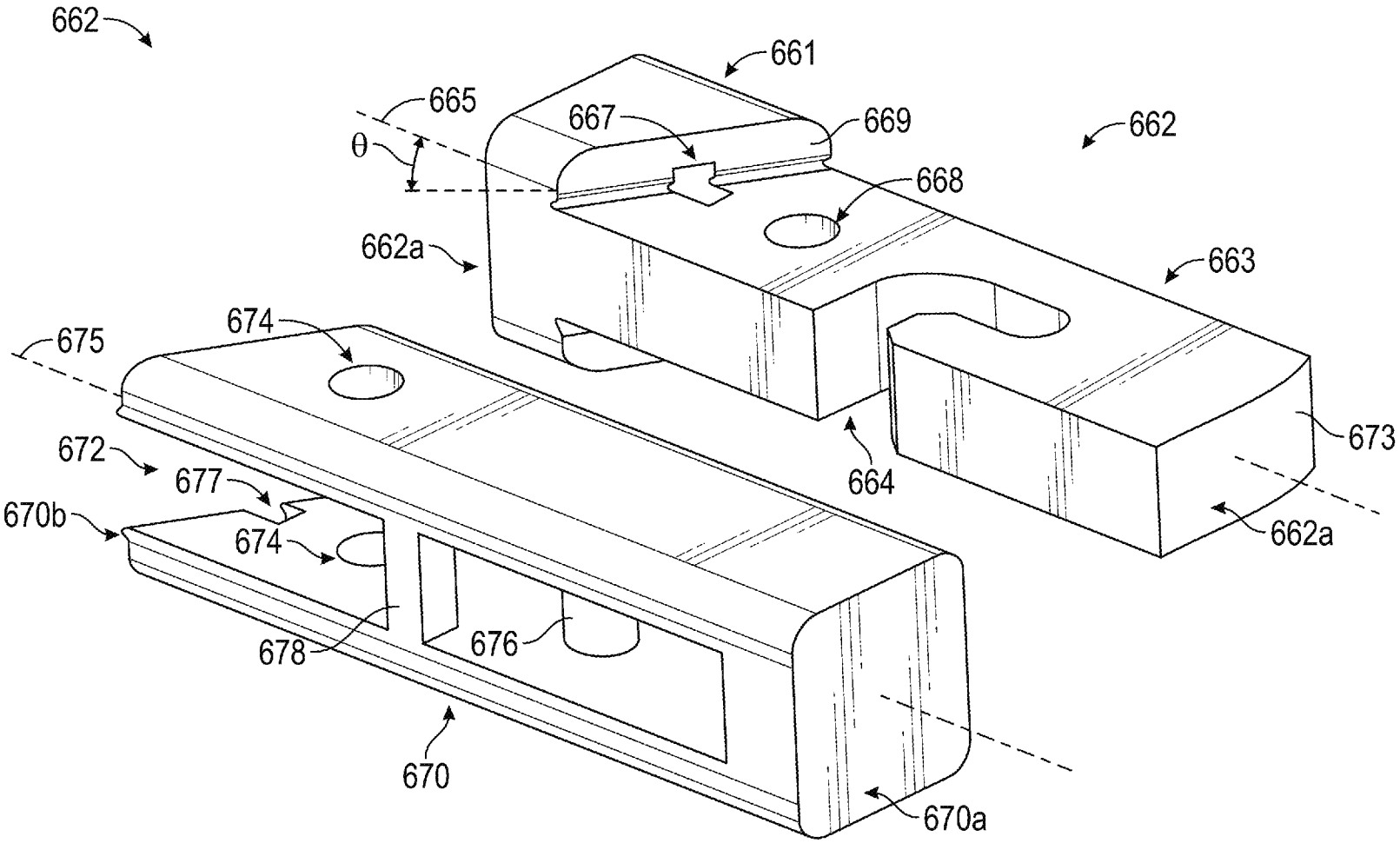

For example, referring now to FIGS. 34 and 35, in some embodiments, sections 451, 452, 453 of guide beam 450 (or sections 151, 152, 153 of guide beam 150) may be coupled to one another with one or more coupling assemblies 660. Connector assembly 660 generally includes a male member 662 that may be mounted to one of the sections 451, 452 of beam 450, and a female member 670 that may be mounted to another one of the sections 451, 452. In this embodiment, male member 662 is coupled to upper end 452*a* of middle section 452 and female member 670 is coupled to lower end 451*b* of upper section 451.

Male member 662 includes a central axis 665 that is aligned with axis 455*b* of section 452, respectively, during operations. In addition, male member 662 includes a first end 662*a*, a second end 662*b* opposite first end 662*a*, a base 661 extending axially from first end 662*a*, and a projection 663 extending axially from base 661 to second end 662*b*. Base includes a planar surface 669 at the transition between base 661 and projection 663 that extends at an angle θ relative to axis 665 (See FIG. 35). In some embodiments, the angle θ may range between 0° and 90° and in other embodiments may range between 30° and 60°, and in still other embodiments may equal 45°. Thus, surface 669 may be referred to here as an inclined planar surface. A locking recess 667 extends axially from first end 662*a* and through base 661. In this embodiment, locking recess 667 is rectangular in shape; however, other shapes (e.g., circular, elliptical, etc.) are possible in other embodiments. In addition, a J-shaped recess or slot 664 (or more simply a "J-slot 664") extends into projection 663, and a locking aperture 668 extends through projection 663 axially between J-slot 664 and base 661. Further, as best shown in FIG. 35, second end 662*b* of male member 662 includes a curved surface 673 that facilitates rotation of male member 662 relative to female member 670 during operations, as described in more detail below.

Referring still to FIGS. 34 and 35, female member 670 includes a central axis 675 that is aligned with axis 455*b* of sections 452 during operations. In addition female member 670 includes a first end 670*a*, a second end 670*b* opposite first end 670*a*. Second end 670*b* includes a planar surface that extends at an angle φ relative to axis 675 (see FIG. 34). In some embodiments, the angle φ may range between 0° and 90° and in other embodiments may range between 30° and 60°, and in still other embodiments may equal 45°. As a result, in at least some embodiments, the angles θ, φ of surfaces 669, 679, respectively may substantially match or equal one another. Thus, planar surface 679 may be referred to herein as an inclined planar surface. Further, female member 670 includes a recess 672 extending axially from second end 670*b* and inclined planar surface 679 toward first end 670*a*. A cylindrical mounting member 676 and an alignment member 678 each extend across recess 672 in a radial direction. In addition, a locking aperture 674 also extends radially through female member 670 and radially across recess 672. Further, a locking recess 677 extends axially into inclined planar surface 679 and radially across recess 672. Locking recess 677 may be sized and shaped to correspond with locking recess 667 on male member 662, and thus, in this embodiment recess 677 is rectangular in shape.

Referring now to FIGS. 36A-36F, during operations, members 662, 670 of coupling assembly 660 are coupled to the ends 452*a*, 451*b*, respectively, of two of the sections 452, 451, respectively, of guide beam 450 as previously described. First ends 670*a*, 662*a* of members 670, 662, respectively are mounted to ends 451*a*, 452*b* of sections 451, 452, respectively, in any suitable manner, such as, for example, welding, bolts, screws, rivets, adhesive, interference fit, etc.

Figure 36B:
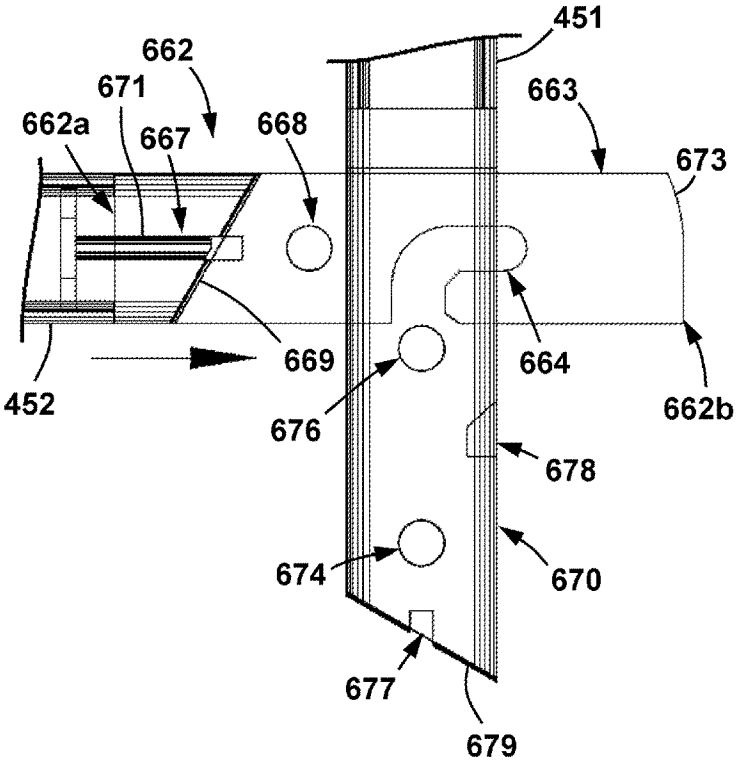
FIGS. 36A-36F are sequential side views of the male and female members of FIGS. 34 and 35 being coupled to one another.
Figure 36A:
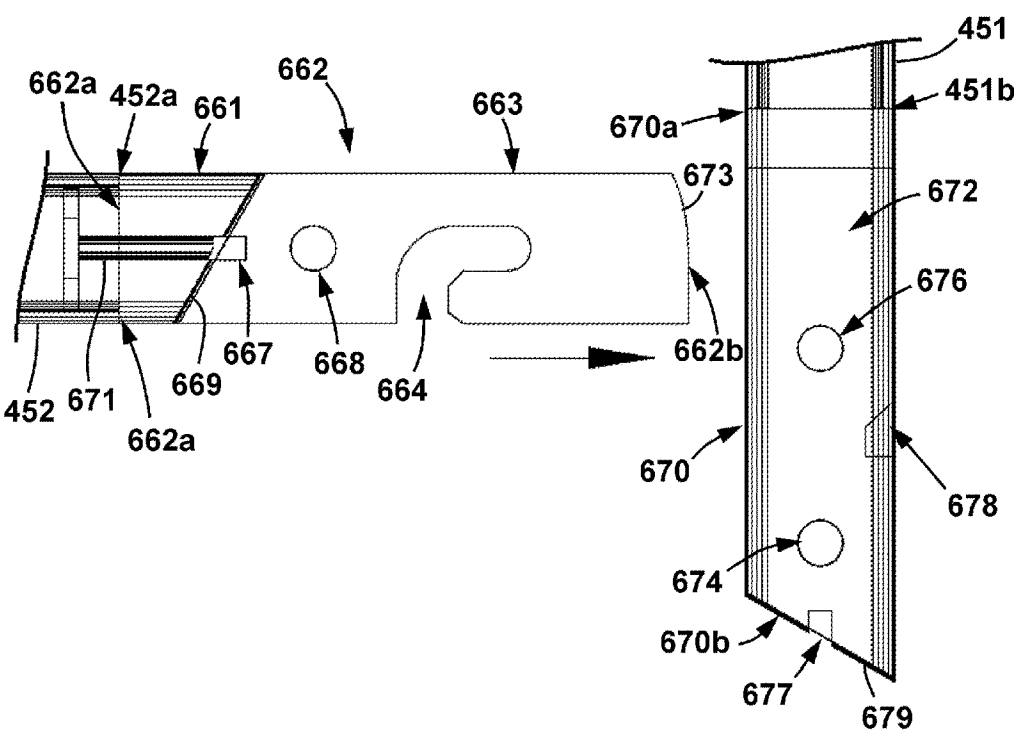
Figure 36D:
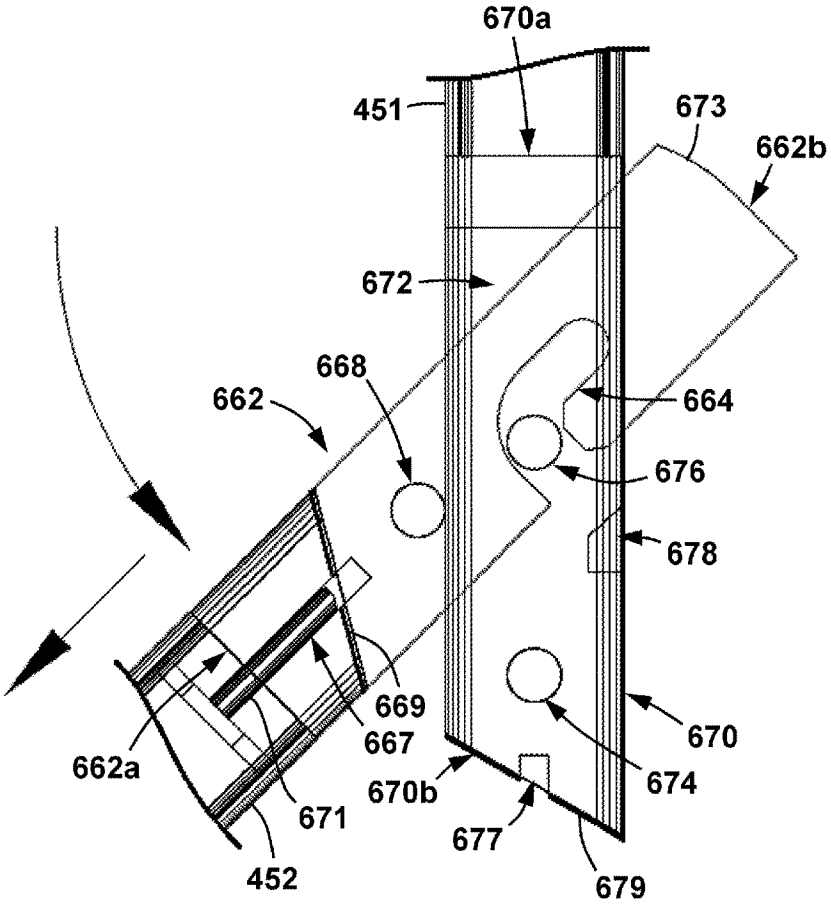
Figure 36C:
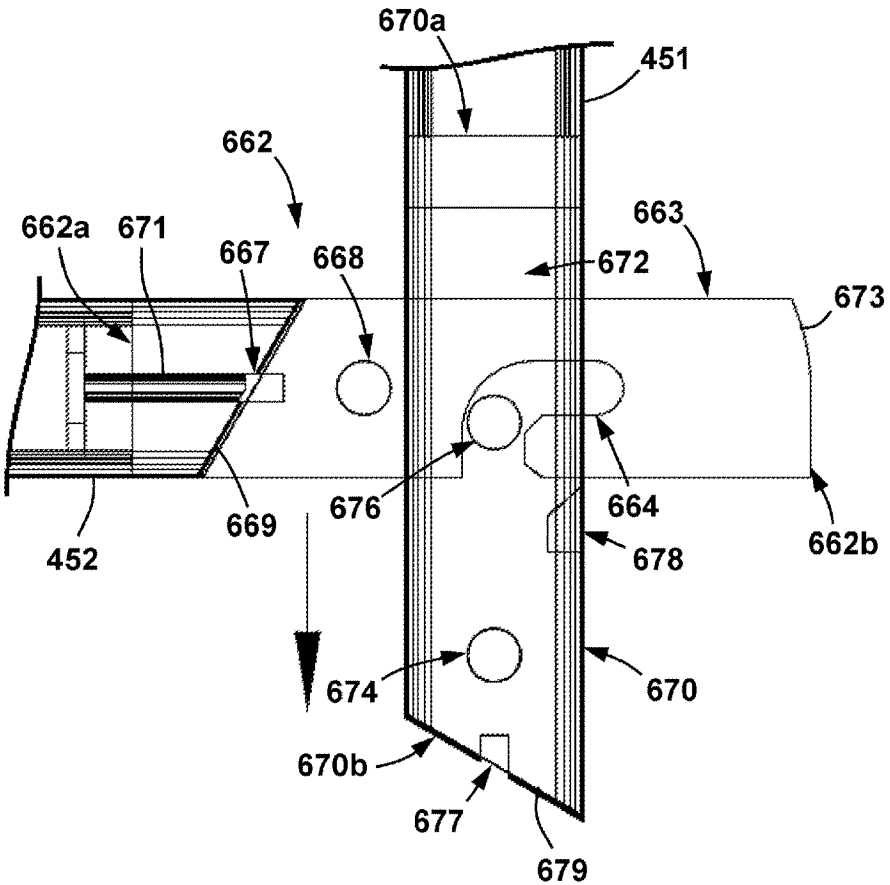
Figure 36F:
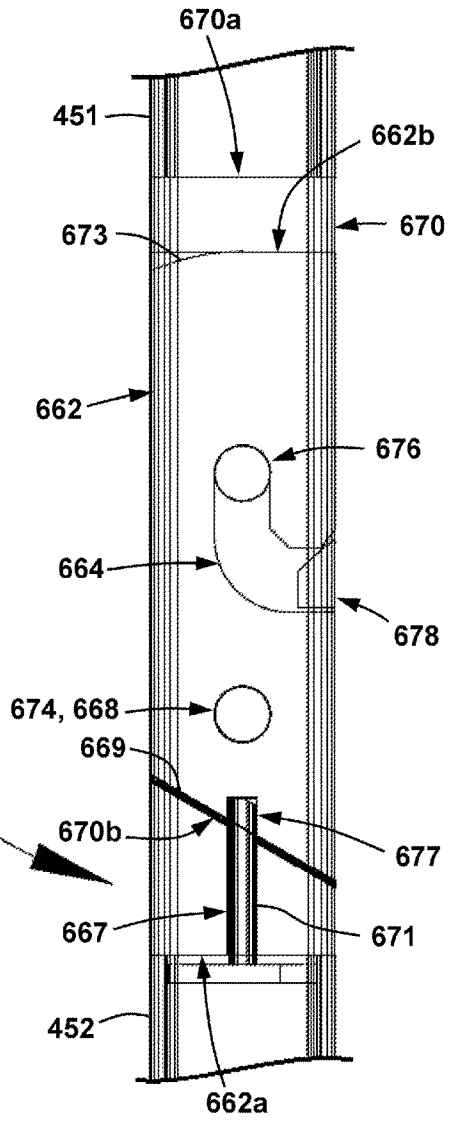
Figure 36E:
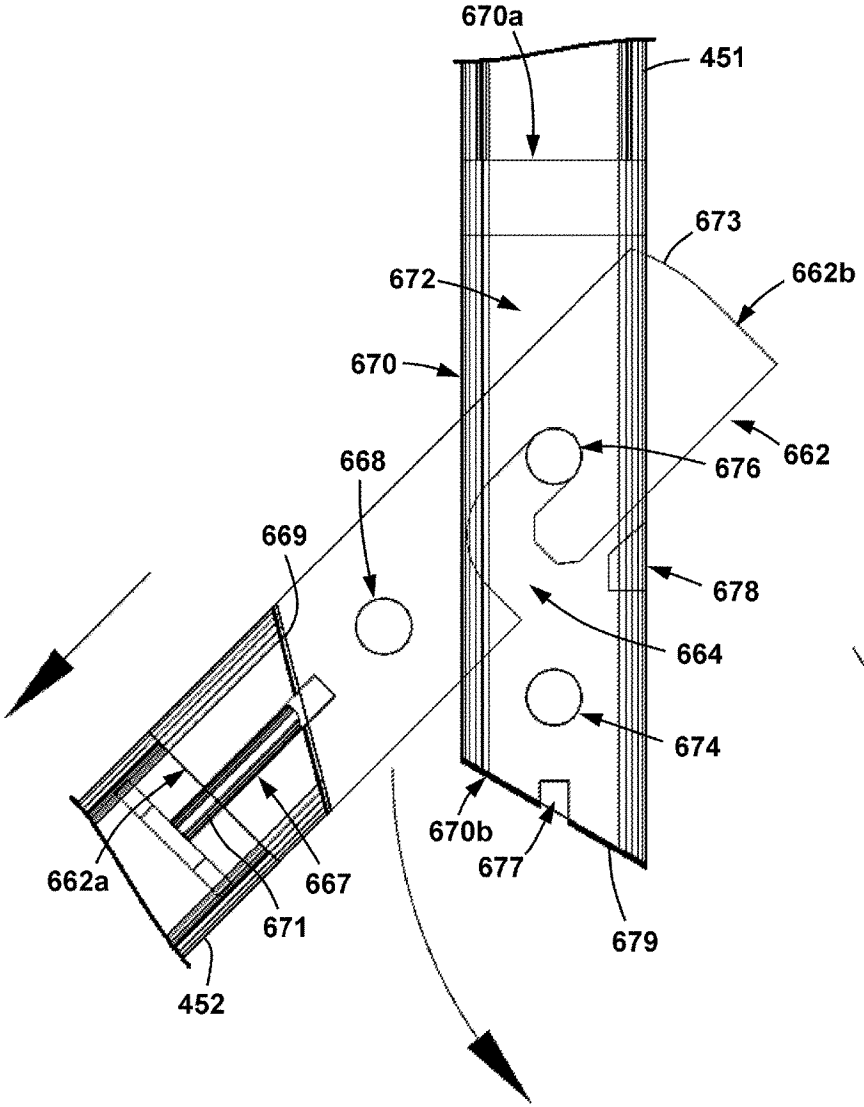

Once members 670, 662 are mounted to sections 451, 452, respectively, sections 451, 452 are coupled to one another by inserting projection 663 of male member 662 into recess 672 of female member 670. Specifically, referring to FIGS. 36A-36C, projection 663 is inserted within recess 672 such that cylindrical mounting member 676 is received within J-slot 664 in projection 663. Referring now to FIGS. 36D-36F, once mounting member 676 is received within J-slot 664, male member 662 and section 452 are rotated about mounting member 676 to allow member 676 to fully seat within slot 664, to align locking aperture 668 in male member 662 with locking aperture 674 in female member 670, and to receive alignment member 678 into J-slot 664. Curved surface 673 at second end 662*b* of male member 662 facilitates the relative rotation between members 662, 670 by providing clearance between end 662*b* of male member 662 and the inner surface of recess 672 of female member 670. In addition, as is best shown in FIG. 36F male member 662 and section 452 are rotated about mounting member 676 until planar inclined surface 669 on male member 662 engages or abuts with planar inclined surface 679 on female member 670 and mounting aperture 667 on male member 662 is aligned with mounting recess 677 on female member. Thereafter, a rectangular locking plate 671 mounted within middle section 452 may be actuated translate axially through the locking aperture 667 and into the locking recess 677 such that members 662, 670 may be locked to one another (i.e., so that members 662, 670 may not be uncoupled from one another).

Locking plate 671 may be actuated through aperture 667 in male member 662 and into recess 677 in female member 670 by any suitable method or mechanism. For example, in some embodiments, plate 670 is manually actuated through aperture 667 and into recess 677 (e.g., via a handle or other manipulation device disposed on the exterior of section 452). As another example, in some embodiments, plate 671 is biased within section 452 (e.g., with a spring or other biasing member) such that when sections 451, 452 are coupled to one another and surfaces 669, 679 abut as shown in FIG. 36H, plate 671 automatically actuates through apertures 667 in male members 662 and into recess 677 in female member 670. As still another example, in some embodiments, plate 671 may be actuated through aperture 667 in male member 662 and into recess 677 in female member 670 by a linear actuator (e.g., hydraulic cylinder, linear motor, pneumatic actuator, etc.) so that plate 671 may be controllably extended and/or retracted into/from aperture 667, and recess 677 during operations to selectively lock and unlock sections 451, 452 from one another. Further, in other embodiments plate 671 may be formed into other shapes other than rectangular (e.g., circular, elliptical, etc.). In at least some embodiments plate 671 is shaped to match the shape of recesses 667, 677.

In addition to locking plate 671, a locking pin (not shown) may be inserted into the aligned locking apertures 668, 674 after projection 663 is seated within recess 672 as described above. In some embodiments, no locking plate 671 is included and male member 662 and female member 672 are secured to one another with the locking pin (not shown) extending through apertures 668, 674. In other embodiments, male member 662 and female member 670 are secured to one another with both plate 671 and the locking pin (not shown) extending through apertures 668, 674. In still other embodiments, only plate 671 is utilized to secure male member 662 and female member 670 to one another (i.e., no locking pin is inserted through the aligned apertures 668, 674, and potentially, apertures 668, 674 are not included on members 662, 670, respectively).

Figure 38:
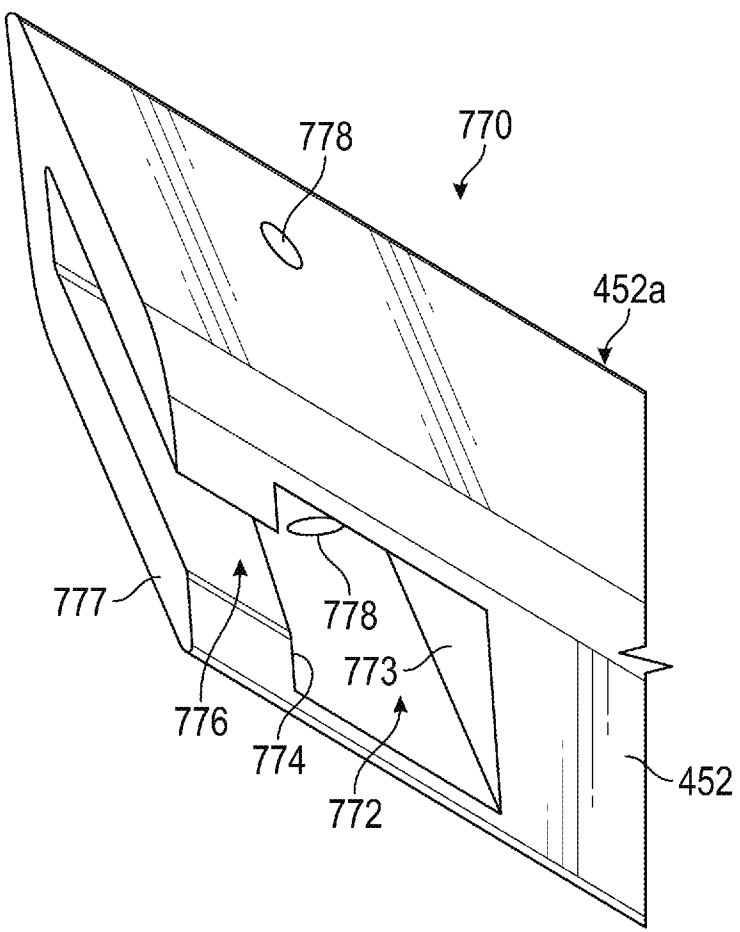
FIGS. 37 and 38 are perspective views of another male and female member, respectively, for coupling the sections of the guide beam of FIG. 28 to one another.
Figure 37:
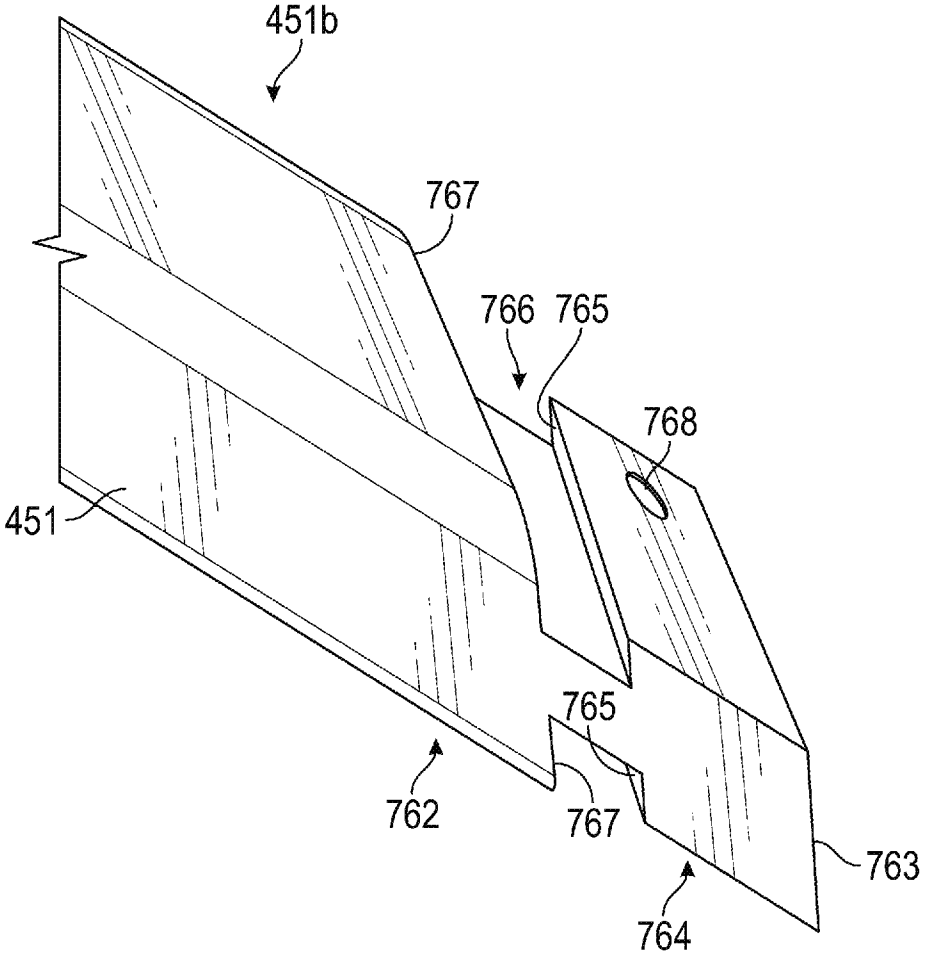

Referring now to FIGS. 37 and 38, in some embodiments, sections 451, 452, 453 of guide beam 450 (or sections 151, 152, 153 of guide beam 150) may be coupled to one another with one or more coupling assemblies that comprise mating wedge lock connectors. For example, in this embodiment upper section 451 of beam 450 includes a male member 762 at lower end 451*b* that may be received within a female member 770 disposed at upper end 452*a* of middle section 452.

As shown in FIG. 37, male member 762 includes a projection 764 that is defined by a pair of inclined, axially spaced planar surfaces 763, 765. A neck or connector members 766 extends axially from inclined planar surface 765 to another inclined planar surface 767 at lower end 451*b* of upper section 451. Neck 766 has a smaller width in a first radial direction than both lower end 451*b* of section 451 and projection 764. A locking aperture 768 extends through projection 764 in a direction that is parallel to a radius of axis 455*a*.

As shown in FIG. 38, female member 770 includes a first recess 772 extending into middle section 452 from a lateral surface thereof, that is defined by a pair of inclined, axially spaced planar surfaces 773, 774. A second recess 776 extends axially from first recess 772 to another inclined planar surface 777 at the axial end of female member 770. A locking aperture 778 extends through middle section 452 at recess 772 in a direction that is parallel to a radius of axis 455*b*.

Figure 39:
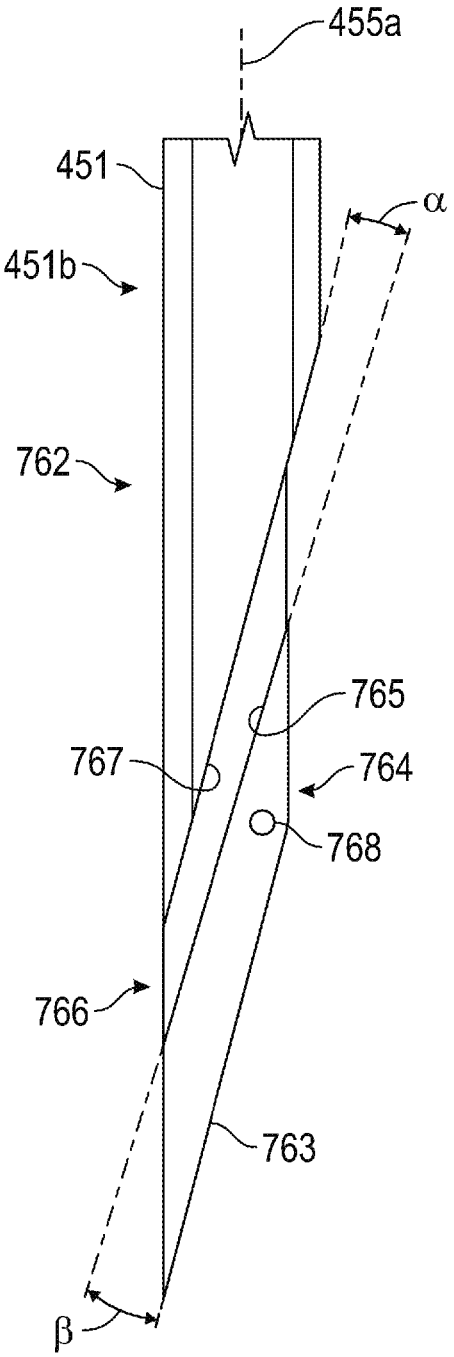
FIG. 39 is a side view of the male member of FIG. 37.

Referring now to FIG. 39, in this embodiment, the inclined planar surfaces 763, 765 defining projection 764 on male member 762 are not parallel to one another and instead extend at an angle β relative to one another. In some embodiments, the angle β ranges from 3° to 5°, and in other embodiments may equal 3°. In addition, in this embodiment the inclined planar surface 765 and the inclined planar surface 767 on either axial end of neck 766 of male member 762 also do not extend parallel to one another and instead extend at an angle α relative to one another. In some embodiments, the angle β ranges from 3° to 5°, and in other embodiments may equal 3°. Thus, surfaces 763, 765 and surfaces 765, 767 on male member 762 each form a wedge profile when viewed in the radial direction with respect to axis 455*a* of upper section 451. The surface 767 on male member 762 may be angled from 45° to 60° relative to axis 455*a*, and the surface 773 on female member 770 may be angled from 45° to 60° relative to axis 455*b*.

Figure 40:
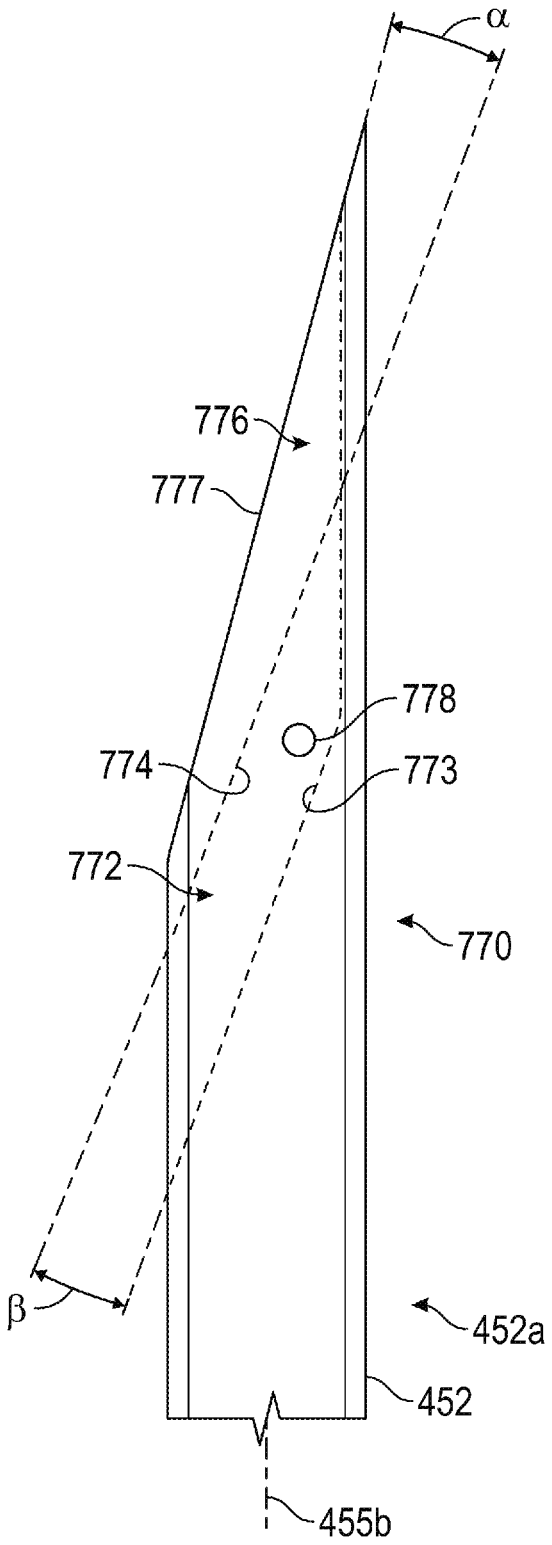
FIG. 40 is a side view of the female member of FIG. 38.

Referring now to FIG. 40, in this embodiment, the inclined planar surfaces 773, 774 defining recess 772 on female member 770 are not parallel to one another and instead extend at the angle β relative to one another, where the angle β is the same as previously described above for surfaces 763, 765 on male member 762. In addition, in this embodiment the inclined planar surface 774 and the inclined planar surface 777 on either axial end of recess 776 of female member 770 also do not extend parallel to one another and instead extend at the angle α relative to one another, where the angle α is the same as previously described above for surfaces 765, 767 on male member 762. Thus, surfaces 773, 774 and surfaces 774, 777 on female member 770 each form a wedge profile when viewed in the radial direction with respect to axis 455*b* of middle section 452.

Figure 41:
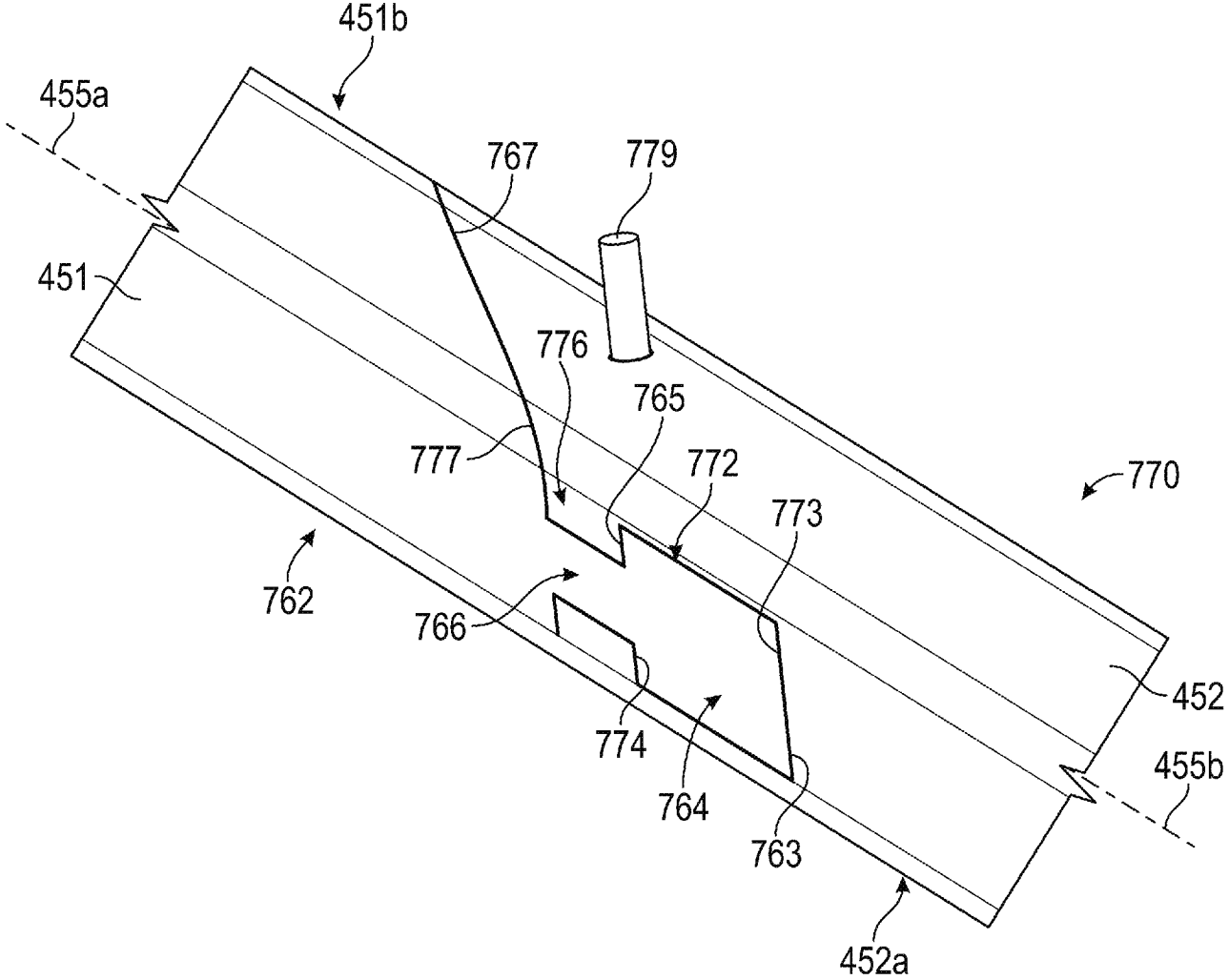
FIG. 41 is a perspective view showing the male member of FIG. 37 coupled to the female member of FIG. 38.

Referring now to FIG. 41, to couple upper and middle sections 451, 452, respectively, projection 764 and neck 766 on male member 762 are inserted within first recess 772 and second recess 766, respectively, in female member 770. As a result, during this insertion, inclined planar surfaces 763, 765, 767 on male member 762 are brought into sliding engagement with surfaces 773, 774, 777 on female member 770. Because surfaces 763, 765 and surfaces 765, 767 on male member 762 and 773, 774 and surfaces 774, 777 on female member 770 each form wedge profiles as previously described above, as projection 764 and neck 766 on male member 762 are inserted within first recess 772 and second recess 766, respectively, in female member 770, there is an increasing interference between surfaces 763, 773, between surfaces 765, 774, and between surfaces 767, 777 that works to secure sections 451, 452 to one another. In some embodiments, female members 770 is lowered into engagement with male member 762 so that the force of gravity may be utilized to accomplish the insertion of projection 764 and neck 766 into recesses 772, 776 as described above. For example, upper section 451 may be suspended from crown 14 (see FIG. 1) and then middle section 452 may be raised to align projection 764 and neck 766 on male member 762 at lower end 451*b* of upper section 451 with recesses 772 and 776 respectively, on female member 770 at upper end 452*a* of middle section 452. Thereafter, middle section 452 is lowered (e.g., by releasing or lowering tension in one or more lifting cables attached to middle section 452) to allow female member 770 on middle section 452 to "fall" onto male member 762 on upper section 451 and therefore accomplish the coupling discussed above.

Once projection 764 and neck 766 on male member 762 are fully seated within recesses 772 and 776, respectively, on female member 770 as previously described, locking aperture 768 extending through projection 764 is aligned with locking aperture 778 in female member 770. Thereafter, a locking pin 779 may be inserted through the aligned apertures 768, 778 to secure male member 762 to female member 770 (and thus secure sections 451, 452 to one another).

In the manner described, through use of a guide system for guiding and supporting a power swivel in accordance with the embodiments disclosed herein (e.g., guide system 100), vertical motion of the power swivel (e.g., power swivel 50) may be supported and facilitated by a rigid guide beam system. In addition, through use of a guide system in accordance with the embodiments disclosed herein, the power swivel may be rotatably supported such that rotation of the power swivel about a horizontally oriented axis may be facilitated during drilling operations. Further, through use of a guide system in accordance with the embodiments disclosed herein, all torque that is transferred to the power swivel from the drillstring and drill bit during drilling operations may be transferred into the relatively more structurally robust lower portion of mast 12. Still further, because no additional tensioned cables are required to support power swivel, the weight borne by the drilling mast is limited to the weight of power swivel, guide system, and drill string only during drilling operations.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention claimed below. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for drilling a subterranean borehole, the system comprising:

a mast;

a pipe rotator coupled to the mast, wherein the pipe rotator includes a stem that is configured to be coupled to an end of a drillstring and a motor that is configured to rotate the stem;

a guide system coupled to the mast and configured to guide vertical motion of the pipe rotator relative to the mast, wherein the guide system comprises:

a guide beam coupled to the mast, the guide beam including a longitudinal axis and a radially outer surface;

a dolly assembly coupled the guide beam and coupled to the pipe rotator;

wherein the dolly assembly is configured to traverse axially along the guide beam between the first end and the second end;

wherein the dolly assembly is pivotally coupled to the pipe rotator such that the pipe rotator is configured to pivot about a pivot axis relative to the dolly assembly, guide beam, and mast;

wherein the guide beam comprises:

a plurality of elongate sections;

a tensioning assembly coupled to a first of the elongate sections; and a linear actuator coupled to a second of the elongate sections, the linear actuator including a rod that is actuatable along the longitudinal axis;

wherein the tensioning assembly is coupled to the rod of the linear actuator;

wherein the linear actuator is configured to actuate the rod to move in a direction along the longitudinal axis to translate the second elongate section toward the first elongate section along the longitudinal axis relative to the tensioning assembly;

wherein the second elongate section comprises a central through passage and the tensioning assembly extends within the central through passage.

2. A system for drilling a subterranean borehole, the system comprising:

a mast;

a pipe rotator coupled to the mast, wherein the pipe rotator includes a stem that is configured to be coupled to an end of a drillstring and coupled to a motor that is configured to rotate the stem;

a guide beam coupled to the mast, the guide beam including a longitudinal axis and configured to guide vertical motion of the pipe rotator, wherein the guide beam comprises:

a plurality of elongate sections configured to be disposed generally along the longitudinal axis; and a plurality of coupling assemblies configured to interconnect the plurality of elongate sections and maintain the plurality of elongate sections in position along the longitudinal axis;

wherein each of the coupling assemblies includes a first connector extending from an end of a first of the elongate sections and a second connector extending from an end of a second of the elongate sections to mate and engage with the first connector along the longitudinal axis;

wherein the coupling assemblies further comprise:

a female member mounted to the end of the first elongate section, the female member including a first recess and a mounting member extending within the first recess; and a male member mounted to the end of the second elongate section, the male member including a projection including a J-shaped slot;

wherein the projection of the male member is configured to be inserted with the first recess of the female member such that the mounting member is inserted within the slot to align a central axis of the first elongate section with a central axis of the second elongate section.

3. The system of claim 2, wherein the female member includes an axially extending locking recess;

wherein the male member includes an axially extending locking aperture; and wherein the locking aperture is aligned with the locking recess when the projection is received within the first recess;

wherein the coupling assembly further comprises:

a locking member disposed within the second elongate section that is configured to actuate axially through the locking aperture and the locking recess.

4. A system for drilling a subterranean borehole, the system comprising:

a mast;

a pipe rotator coupled to the mast, wherein the pipe rotator includes a stem that is configured to be coupled to an end of a drillstring and coupled to a motor that is configured to rotate the stem;

a guide beam coupled to the mast, the guide beam including a longitudinal axis and configured to guide vertical motion of the pipe rotator, wherein the guide beam comprises:

a plurality of elongate sections configured to be disposed generally along the longitudinal axis; and a plurality of coupling assemblies configured to interconnect the plurality of elongate sections and maintain the plurality of elongate sections in position along the longitudinal axis;

wherein each of the coupling assemblies includes a first connector extending from an end of a first of the elongate sections and a second connector extending from an end of a second of the elongate sections to mate and engage with the first connector along the longitudinal axis;

wherein the first connector comprises a female connector that includes a throughbore and a radially extending projection disposed within the throughbore;

wherein the second connector comprises a male connector that includes a radially extending recess defined by at least one ramped surface;

wherein when the first elongate section is coupled to the second elongate section, the male connector is inserted within the throughbore of the female connector and the radially extending projection on the female connector is received within the recess on the male connector.

5. The system of claim 4, wherein the male connector comprises a cylindrical portion and a conical portion axially adjacent the cylindrical portion;

wherein the recess extends radially into the conical portion;

wherein the male connector further comprises a slot extending radially into the cylindrical portion; and wherein the slot also extends axially from the recess.

6. The system of claim 4, wherein the female connector includes a plurality of radially extending projections disposed within the throughbore that are uniformly angularly disposed about the longitudinal axis;

wherein the male connector includes a plurality of recesses that are uniformly angularly disposed about the longitudinal axis, wherein each recess is defined by at least one ramped surface; and wherein when the first elongate section is coupled to the second elongate section, the male connector is inserted with the throughbore of the female connector and each of the plurality of radially extending projections are received within a corresponding one of the plurality of recesses on the male connector.

7. A system for drilling a subterranean borehole, the system comprising:

a mast;

a pipe rotator coupled to the mast, wherein the pipe rotator includes a stem that is configured to be coupled to an end of a drillstring and coupled to a motor that is configured to rotate the stem;

a guide beam coupled to the mast, the guide beam including a longitudinal axis and configured to guide vertical motion of the pipe rotator, wherein the guide beam comprises:

a plurality of elongate sections configured to be disposed generally along the longitudinal axis;

a tensioning assembly coupled to a first of the elongate sections; and a linear actuator coupled to a second of the elongate sections, the linear actuator including a rod that is actuatable along the longitudinal axis;

wherein the tensioning assembly is coupled to the rod of the linear actuator;

wherein the linear actuator is configured to actuate the rod to move in a direction along the longitudinal axis to translate the second elongate section toward the first elongate section along the longitudinal axis relative to the tensioning assembly;

wherein the second elongate section comprises a central through passage and the tensioning assembly extends within the central through passage; and a plurality of coupling assemblies configured to interconnect the plurality of elongate sections and maintain the plurality of elongate sections in position along the longitudinal axis.

8. The system of claim 7, wherein the coupling assemblies comprise:

a female connector coupled to the second elongate section, wherein the female connector includes a throughbore and a radially extending projection disposed within the throughbore; and a male connector coupled to the first elongate section, wherein the male connector includes a radially extending recess defined by at least one ramped surface;

wherein the male connector is configured to be inserted within the throughbore of the female connector and the radially extending projection on the female connector is configured to be received within the recess on the male connector when the first elongate section is coupled to the second elongate section.

9. The system of claim 8, wherein the male connector comprises a cylindrical portion and a conical portion axially adjacent the cylindrical portion;

wherein the recess extends radially into the conical portion;

wherein the male connector further comprises a slot extending radially into the cylindrical portion; and wherein the slot also extends axially from the recess.

10. The system of claim 8, wherein the female connector includes a plurality of radially extending projections disposed within the throughbore that are uniformly angularly disposed about the longitudinal axis;

wherein the male connector includes a plurality of recesses that are uniformly angularly disposed about the longitudinal axis, wherein each recess is defined by at least one ramped surface; and wherein the male connector is configured to be inserted with the throughbore of the female connector and each of the plurality of radially extending projections are configured to be received within a corresponding one of the plurality of recesses on the male connector when the first elongate section is coupled to the second elongate section.

11. The system of claim 8, wherein the female connector includes a first bore extending perpendicularly through a plane containing the longitudinal axis;

wherein the male connector includes a second bore extending perpendicularly through a plane containing the longitudinal axis;

wherein the first bore is configured to align with the second bore when the male connector is disposed within the female connector; and wherein the coupling assemblies further comprise a first pin that is configured to be inserted with the aligned first bore and second bore.

12. The system of claim 11, wherein the female connector further includes a locking assembly, wherein the locking assembly comprises:

a bracket mounted to the female connector;

a sliding member slidably disposed within the bracket, the sliding member including:

a first aperture including a hole and a slot extending from the hole; and a second aperture spaced from the first aperture; and a second pin disposed within the second aperture, wherein the second pin is biased into the second aperture.

13. A system for drilling a subterranean borehole, the system comprising:

a mast;

a pipe rotator coupled to the mast, wherein the pipe rotator includes a stem that is configured to be coupled to an end of a drillstring and coupled to a motor that is configured to rotate the stem;

a guide beam coupled to the mast, the guide beam including a longitudinal axis and configured to guide vertical motion of the pipe rotator, wherein the guide beam comprises:

a plurality of elongate sections;

a tensioning assembly coupled to a first of the elongate sections; and a linear actuator coupled to a second of the elongate sections, the linear actuator including a rod that is actuatable along the longitudinal axis;

wherein the tensioning assembly is coupled to the rod of the linear actuator;

wherein the linear actuator is configured to actuate the rod to move in a direction along the longitudinal axis to translate the second elongate section toward the first elongate section along the longitudinal axis relative to the tensioning assembly;

wherein the second elongate section comprises a central through passage and the tensioning assembly extends within the central through passage.

14. The system of claim 13, wherein the guide beam comprises:

a female connector coupled to the second elongate section, wherein the female connector includes a throughbore and a radially extending projection disposed within the throughbore;

a male connector coupled to the first elongate section, wherein the male connector includes a radially extending recess defined by at least one ramped surface;

wherein when the first elongate section is coupled to the second elongate section, the male connector is inserted within the throughbore of the female connector and the radially extending projection on the female connector is received within the recess on the male connector.

15. The system of claim 14, wherein the male connector comprises a cylindrical portion and a conical portion axially adjacent the cylindrical portion;

wherein the recess extends radially into the conical portion;

wherein the male connector further comprises a slot extending radially into the cylindrical portion; and wherein the slot also extends axially from the recess.

16. The system of claim 14, wherein the female connector includes a first bore extending perpendicularly through a plane containing the longitudinal axis;

wherein the male connector includes a second bore extending perpendicularly through a plane containing the longitudinal axis;

wherein the first bore is configured to align with the second bore when the male connector is inserted within the female connector and receive a first pin therethrough;

wherein the female connector further includes a locking assembly, wherein the locking assembly comprises:

a bracket mounted to the female connector;

a sliding member slidably disposed within the bracket, the sliding member including:

a first aperture including a hole and a slot extending from the hole;

a second aperture spaced from the first aperture; and a second pin disposed within the second aperture, wherein the second pin is biased into the second aperture; and wherein the locking assembly is transitionable between an unlocked position wherein the hole of the first aperture is aligned with the first bore of the female connector and a locked position wherein the slot of the first aperture is aligned with the first bore of the female connector.

* * * * *